US008573023B2

(12) United States Patent
Matsuda et al.

(10) Patent No.: US 8,573,023 B2
(45) Date of Patent: Nov. 5, 2013

(54) PRESS-MOLDED PRODUCT AND METHOD OF MANUFACTURING SAME

(71) Applicant: Nissan Motor Co., Ltd., Yokohama (JP)

(72) Inventors: Shinichi Matsuda, Yokohama (JP); Kenji Kanamori, Yokohama (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 0 days.

(21) Appl. No.: 13/674,155

(22) Filed: Nov. 12, 2012

(65) Prior Publication Data

US 2013/0061647 A1 Mar. 14, 2013

Related U.S. Application Data

(63) Continuation of application No. 12/124,322, filed on May 21, 2008.

(30) Foreign Application Priority Data

May 31, 2007 (JP) ..... 2007-145670
May 31, 2007 (JP) ..... 2007-145681
Feb. 8, 2008 (JP) ..... 2008-029786

(51) Int. Cl.
*B21D 31/00* (2006.01)

(52) U.S. Cl.
USPC ..... 72/377; 72/352; 72/379.2

(58) Field of Classification Search
USPC ..... 72/354.6, 354.8, 358, 359, 379.2, 380, 72/382, 386, 396, 377
See application file for complete search history.

(56) References Cited

U.S. PATENT DOCUMENTS 3,750,450 A * 8/1973 Sharp et al. ..... 72/353.2
4,434,640 A * 3/1984 Walter et al. ..... 72/348
5,924,188 A 7/1999 Tokunou et al.
2004/0216505 A1 11/2004 Knaup
2007/0125149 A1* 6/2007 Yoshitome et al. ..... 72/356

FOREIGN PATENT DOCUMENTS

EP 0 592 908 4/1993
JP 10-180470 A 7/1998
JP 10-329503 12/1998
JP 2001-163257 A 6/2001
JP 2001-198641 7/2001
JP 2001-238297 8/2001
JP 2001-314921 11/2001
JP 2005-152975 6/2005
JP 2005-199749 A 7/2005
JP 2006-290294 A 10/2006
JP 2006-341687 A 12/2006

* cited by examiner

*Primary Examiner* — Dana Ross
*Assistant Examiner* — Matthew G Katcoff
(74) *Attorney, Agent, or Firm* — Young Basile

(57) ABSTRACT

Methods and apparatuses for manufacturing a press-molded product with a preform including a pair of side wall portions and a connecting wall portion are taught. The preform is pressed with a mold until at least one wall portion is bent toward a gap within the mold, and a plate thickness is increased at the at least one wall portion and the connecting wall portion by pressing other wall portions.

17 Claims, 50 Drawing Sheets

| | Press-molding result | | | |
|---|---|---|---|---|
| Pressing-in ratio [%] | 26 | 28 | 30 | 32 |
| Molding performance | OK | OK | OK | NG |

OK : Normal
NG : Buckling is generated

PRESS-MOLDED PRODUCT AND METHOD OF MANUFACTURING SAME

CROSS REFERENCE RELATED TO APPLICATIONS

This application is a divisional application of U.S. patent application Ser. No. 12/124,322, filed on May 21, 2008 and claims priority to the Japanese Patent Application Serial Nos. 2007-145670, filed May 31, 2007, 2007-145681, filed May 31, 2007, and 2008-029786, filed Feb. 8, 2008, each of which is incorporated herein in its entirety by reference.

TECHNICAL FIELD

The present invention relates to a press-molded product and a method of manufacturing the same.

BACKGROUND

Japanese Laid-Open Patent Application No. 2005-152975 discloses that a press-molded product such as a suspension component of a vehicle is manufactured by a tailored blank. The tailored blank is formed by pre-bonding two sheets of dissimilar steel plates and integrating them. For example, the dissimilar steel plate at one side is formed of a thick steel plate and applied to a local region requiring rigidity or strength. Further, the dissimilar steel plate at the other side is formed of a thin steel plate and is applied to a region that does not require any rigidity or strength.

BRIEF SUMMARY

Methods of manufacturing a press-molded product using a preform comprising wall portions including a pair of spaced side wall portions and a connecting wall portion between the side wall portions are taught herein. One such method comprises pressing the preform within a mold to bend at least one wall portion toward a gap within the mold to form at least one bent portion and increasing a plate thickness of the at least one wall portion and the connecting wall portion by compressing others of the wall portions using the mold.

Embodiments of the press-molded product manufactured by the method and embodiments of an the apparatus used to manufacture the press-molded product are also taught herein.

BRIEF DESCRIPTION OF THE DRAWINGS

The description herein makes reference to the accompanying drawing wherein like reference numerals refer to like parts throughout the several views, and wherein.

DETAILED DESCRIPTION OF EMBODIMENTS OF THE INVENTION

According to a method disclosed in Japanese Laid-Open Patent Application No. 2005-152975 discussed above, it is possible to reduce a weight of the press-molded product because the dissimilar steel plate at one side is formed of the thin steel plate. However, there is a problem in terms of manufacturing costs. That is, since the bonding of the dissimilar steel plates is preformed by welding butting portions of the dissimilar steel plates, high butting precision is required. In this regard, it is difficult to improve productivity, thereby causing an increase in manufacturing costs.

In contrast, according to several embodiments taught below it is possible to reduce the weight and manufacturing costs of a press-molded product.

Figure 1:
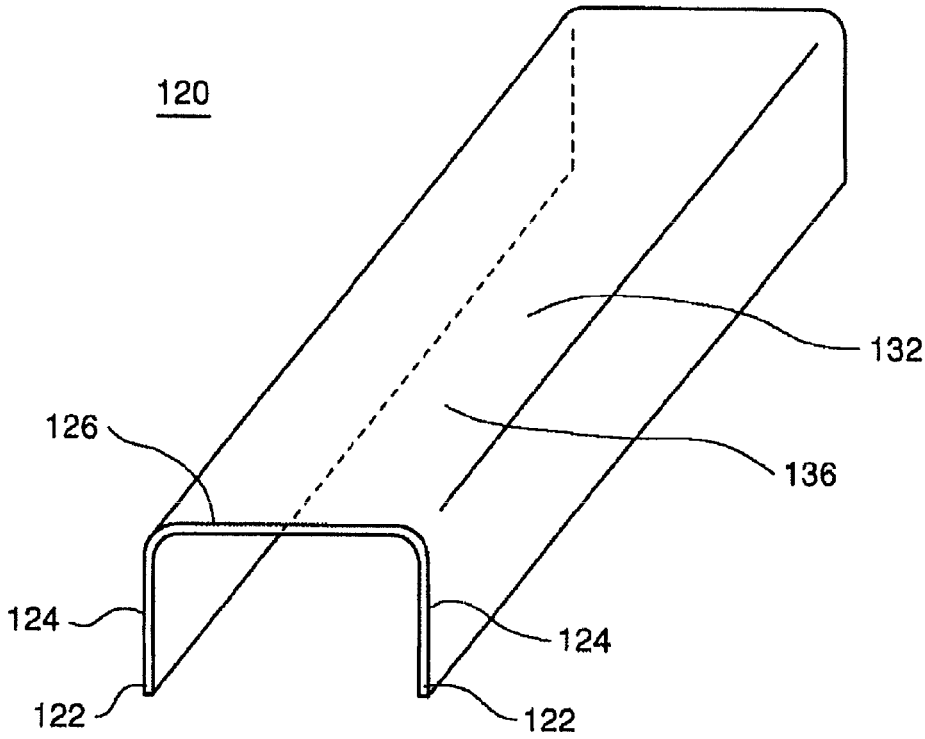
FIG. 1 is a perspective view showing a press-molded product constructed in accordance with a first embodiment.
Figure 2:
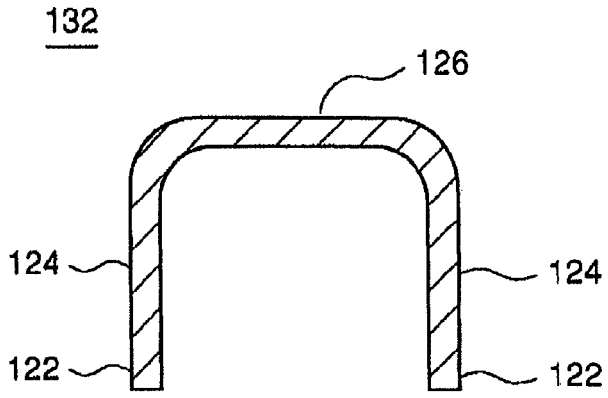
FIG. 2 is a cross-sectional view showing a partial thickness increase portion of the press-molded product according to FIG. 1.
Figure 3:
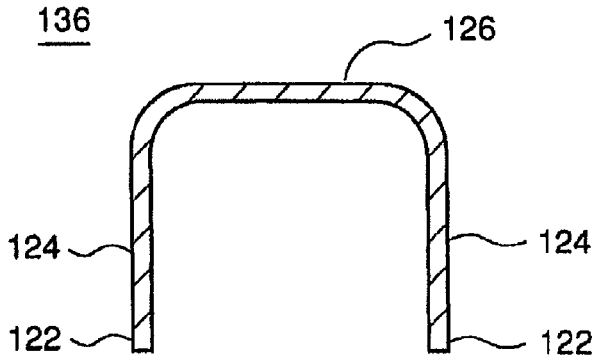
FIG. 3 is a cross-sectional view showing a thickness non-increase portion adjacent to the partial thickness increase portion according to FIG. 1.

The first embodiment is initially explained with reference to FIGS. 1-3.

A press-molded product 120 constructed in accordance with the first embodiment has a generally elongated polygonal shape forming an open cross-section, which comprises a pair of spaced side wall portions 124 and a connecting wall portion 126 for connecting each end of the side wall portions 124. The press-molded product 120 is obtained by press-molding a plate-shaped blank. The press-molded product 120 comprises a partial thickness increase portion 132 arranged at a local region requiring rigidity or strength. Further, a corner portion positioned between the side wall portion 124 and the connecting wall portion 126 to connect the side wall portion 124 and the connecting wall portion 126 has an arc shape. Also, reference numeral 122 refers to an edge portion of each side wall portion 124.

The partial thickness increase portion (i.e., a part along a length direction) 132 extends along a peripheral direction intersecting with a length direction of the press-molded product 120. Plate thicknesses of the side wall portion 124 and the connecting wall portion 126 in the partial thickness increase portion 132 are greater than those of the side wall portion 124 and the connecting wall portion 126 in a thickness non-increase portion 136. The increase in the plate thickness is a result of the material flow caused by pressing-in a part of the blank at the time of press-molding.

As such, although a blank having a thin plate shape is applied, since rigidity or strength is secured by the partial thickness increase portion 132 wherein the plate thicknesses are increased, it is possible to enhance a weight reduction of the press-molded product 120. Further, compared to a tailored blank applying a butt welding operation, since the partial thickness increase portion 132 is formed by a press-molding operation with a desirable productivity, the manufacturing costs of the press-molded product are reduced. Also, the hardness of the partial thickness increase portion 132 is greater than the hardness of the thickness non-increase portion 136 through work-hardening or compressive stress operation by press-molding.

Figure 4:
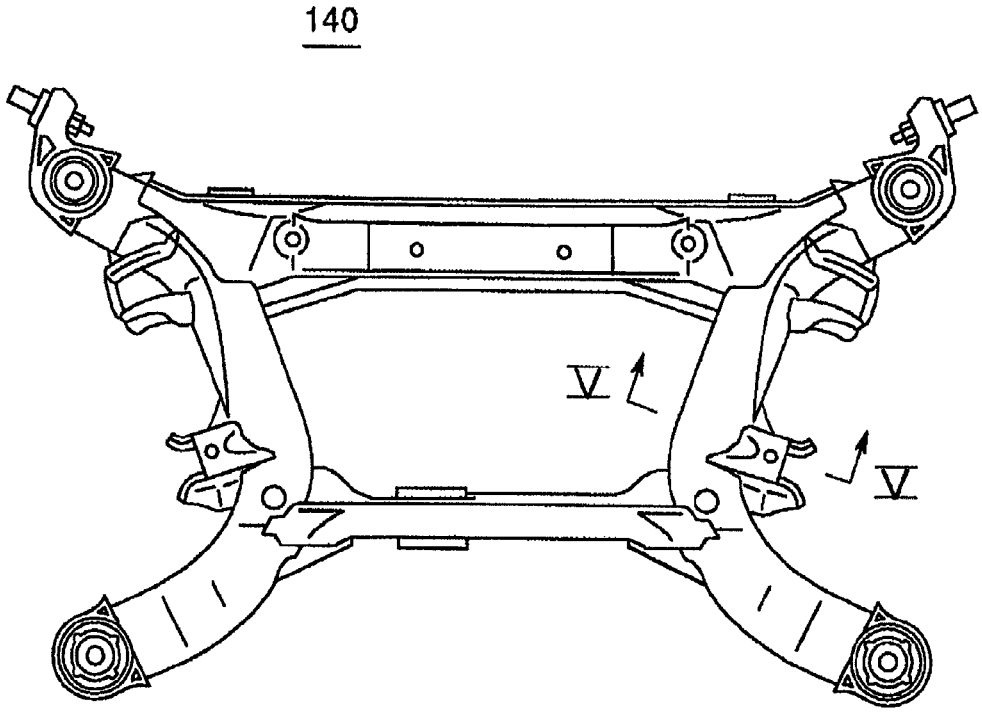
FIG. 4 is a planar view showing a suspension component applying the press-molded product constructed in accordance with the first embodiment.
Figure 5:
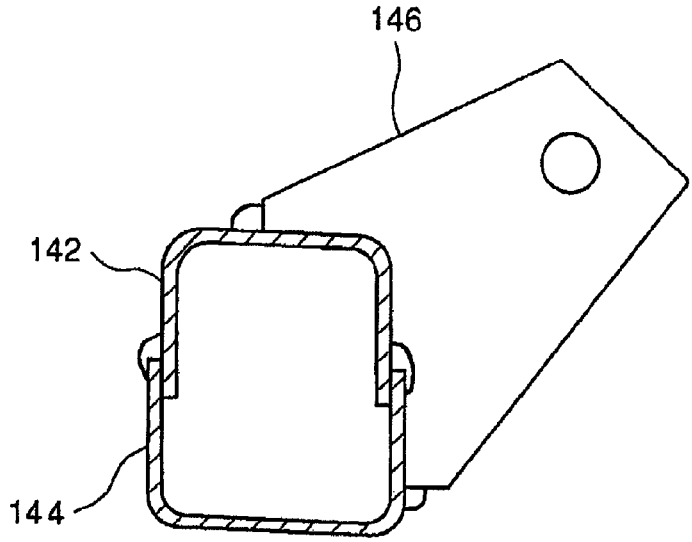
FIG. 5 is a cross-sectional view taken along the line V-V of FIG. 4.
Figure 6:
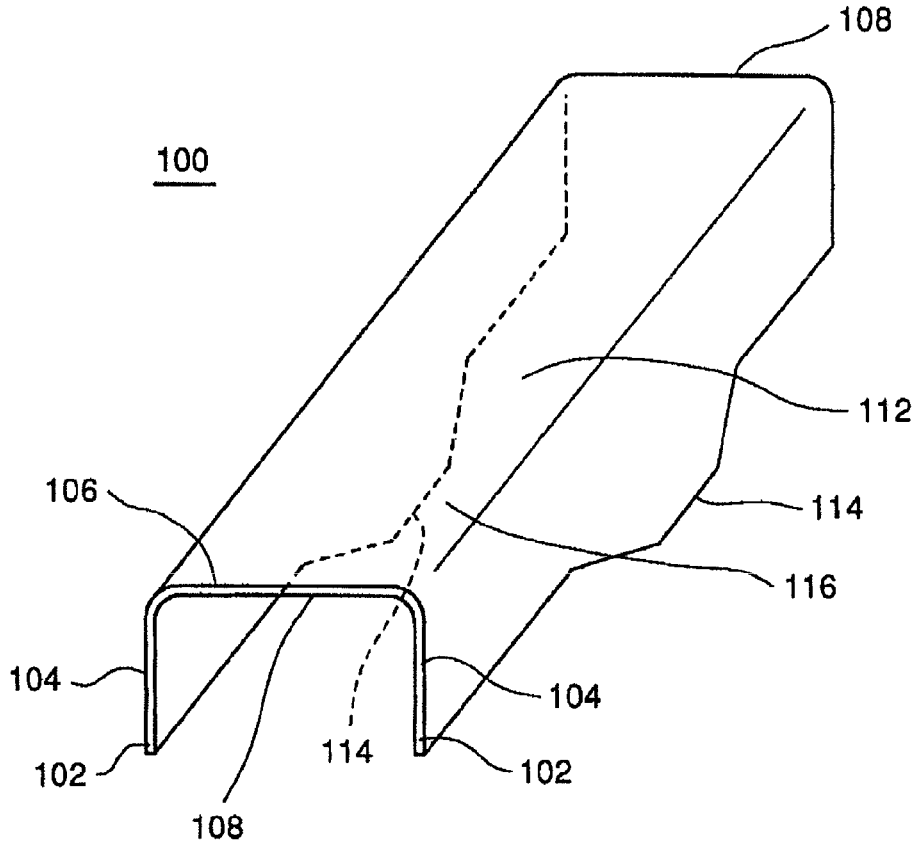
FIG. 6 is a perspective view showing a blank constructed in accordance with the first embodiment.
Figure 7:
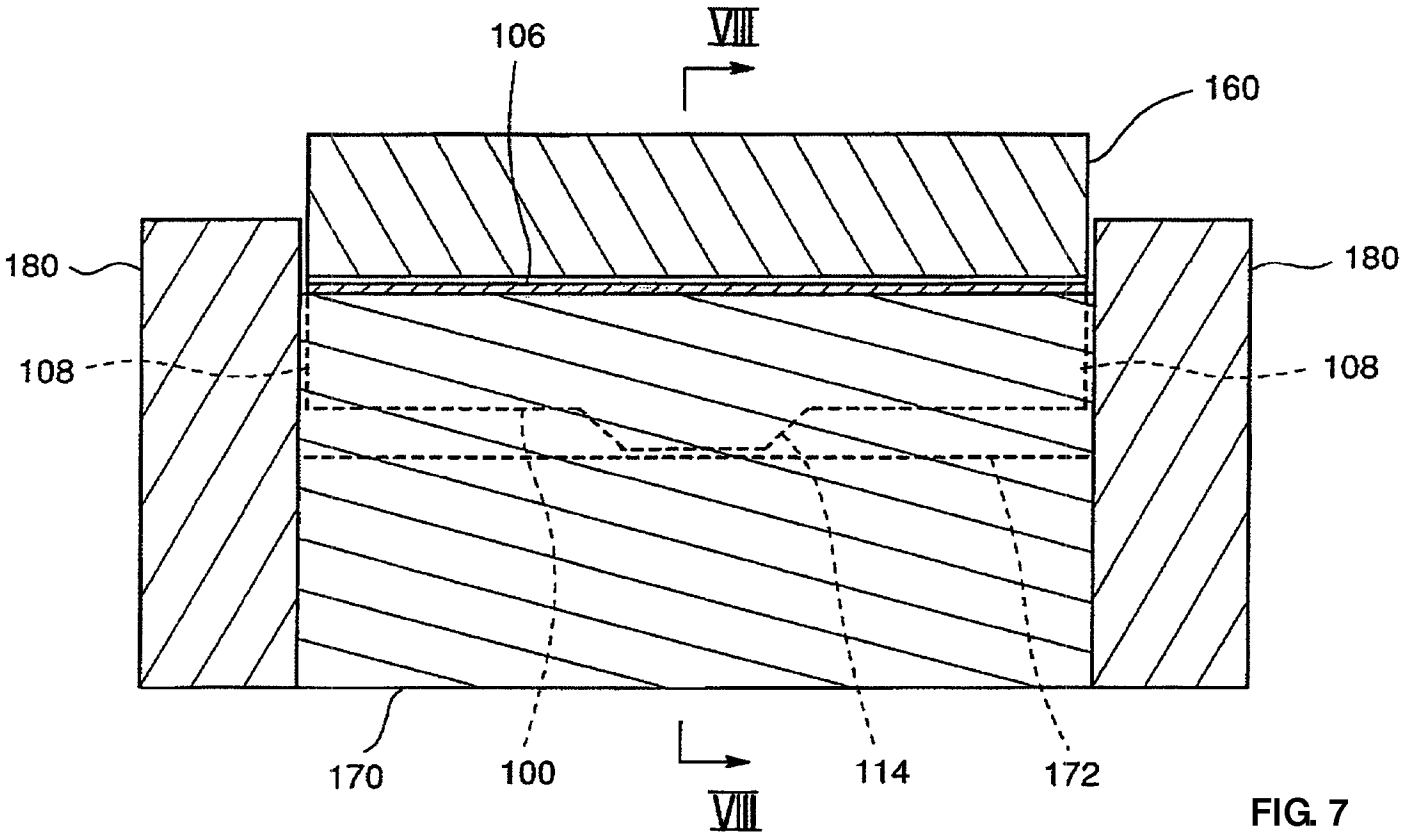
FIG. 7 is a cross-sectional view showing an apparatus for manufacturing the press-molded product constructed in accordance with the first embodiment.
Figure 8:
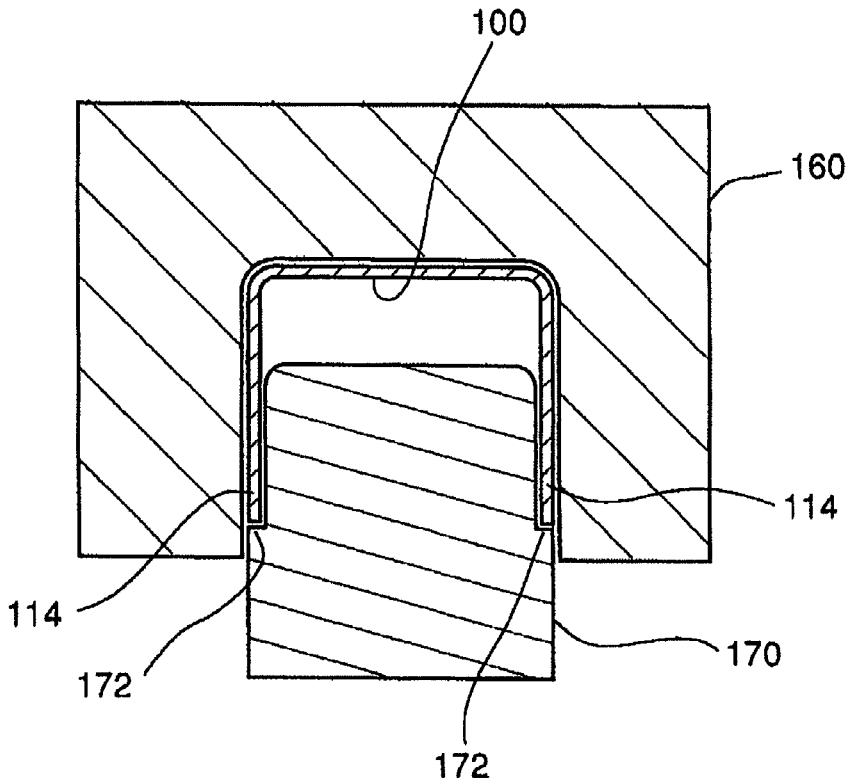
FIG. 8 is a cross-sectional view taken along the line VIII-VIII of FIG. 7.
Figure 9:
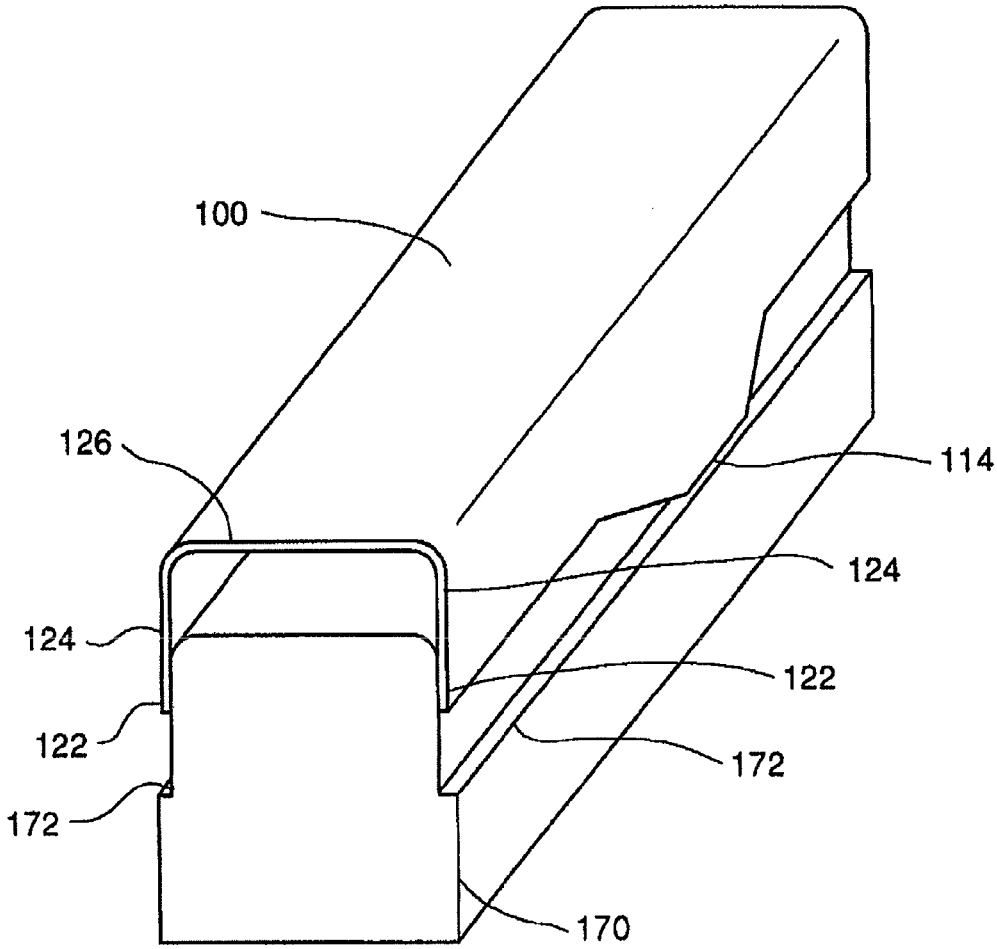
FIG. 9 is a perspective view showing a lower mold shown in FIG. 7.

FIG. 4 is a planar view showing a suspension component applying the press-molded product constructed in accordance with the first embodiment. FIG. 5 is a cross-sectional view taken along the line V-V of FIG. 4.

A suspension component 140 has an approximately rectangular cross-section in a hollow shape, which comprises an upper side member 142 and a lower side member 144 wherein edge portions thereof are welded to each other. The upper side member 142 and the lower side member 144 have a generally elongated polygonal shape forming an open cross-section. It is possible to enhance a reduction of weight and save the manufacturing costs of the suspension component 140 by applying the press-molded product 120.

The local region requiring the rigidity or strength is, for example, a region where a bracket 146 for clamping a separate component such as an arm is fixed. That is, since the bracket 146 is fixed at the partial thickness increase portion 132 of the press-molded product 120, it is possible to secure a desired fixing strength. In particular, the fatigue strength can be improved when a welding operation is applied to the fixation.

Next, an apparatus for manufacturing the blank and press-molded product constructed in accordance with the first embodiment is explained with reference to FIGS. 6-9.

A manufacturing apparatus in accordance with the first embodiment comprises a press-mold for obtaining the press-molded product 120 from a plate-shaped blank 100. The press-mold is capable of forming the partial thickness increase portion 132 by generating a material flow that causes the plate thickness increase by pressing-in a part of the blank 100.

More specifically, the blank 100 is an elongated preform forming an open cross-section formed by press-molding a rolling material. The shape of the blank 100 corresponds to the shape of the press-molded product, here product 120. The blank 100 comprises a pair of spaced side wall portions 104 and a connecting wall portion 106 for connecting each end of the side wall portion 104. Further, a corner portion positioned between the side wall portion 104 and the connecting wall portion 106 to connect the side wall portion 104 and the connecting wall portion 106 has an arc shape.

The blank 100 comprises a thickness increase prearranged portion 112 and a thickness non-increase prearranged portion 116 corresponding to the partial thickness increase portion 132 and thickness non-increase portion 136 of the press-molded product 120, respectively. A peripheral region including the thickness increase prearranged portion 112 comprises a peripheral length extending region and a length of a cross-sectional periphery of the peripheral region that is longer than a length of a cross-sectional periphery of the peripheral region including the partial thickness increase portion 132 of the press-molded product 120. A part of the pressed-in blank 100 is the peripheral length extending region. Thus, it is possible to easily generate the material flow that causes an increase of the plate thickness.

The peripheral length extending region in accordance with the first embodiment is arranged at an end surface of an edge portion 102 of the side wall portion 104 (i.e., an end surface opposite to the connecting wall portion side of the side wall portion 104) and includes an extension (protrusion) 114 extending from the end portion. The extension 114 can be inexpensively formed by punching the rolling material. However, the extension 114 may be formed by a mechanical process. Further, in the first embodiment, the length of the cross-sectional periphery of the peripheral region including the thickness increase prearranged portion 112 is longer than the length of the cross-sectional periphery of the peripheral region including the thickness non-increase prearranged portion 116.

The press-mold comprises an upper mold 160 and a lower mold 170, which can be arranged to be closely spaced to the upper mold 160, and a lateral mold 180. The upper mold 160 is a die portion comprising an inner surface portion corresponding to an outer surface shape of the press-molded product 120. The lower mold 170 is a punch portion comprising an outer surface portion corresponding to an inner surface shape of the press-molded product 120. The press-mold is mold-clamped by arranging the blank 100 between the upper mold 160 and the lower mold 170. In a molding surface of the upper mold 160 and the lower mold 170, a region corresponding to the corner portion between the side wall portion 104 and connecting wall portion 106 of the blank 100 has an arc shaped cross-section in consideration of the material flow. The region of the arc shaped cross-section of the upper mold 160 guides the above corner portion to the connecting wall portion side, thereby constituting a guide for bending the connecting wall portion 106.

The lower mold 170 comprises a step portion (contacting surface) 172, which extends along the edge portion 102 of the arranged blank 100. The extension 114 of the blank 100 contacts the step portion 172 of the lower mold 170 to be pressed-in at the time of mold-clamping the upper mold 160 and lower mold 170. This generates the material flow that causes the increase of the plate thickness.

A cross-sectional thickness of a cavity is established in consideration of a thickness increase caused by the material flow, wherein the cavity is formed by the upper mold 160 and lower mold 170 corresponding to the peripheral region, which includes the thickness increase prearranged portion 112 of the blank 100. That is, the cross-sectional thickness of the cavity at the time of mold-clamping is greater than the plate thickness of the blank 100. This allows the material flow.

The lateral mold 180 is positioned so as to contact the end surfaces 108 at both sides along the length direction of the blank 100, thereby being arranged at a lateral direction of the upper mold 160 and lower mold 170. The lateral mold 180 is used to restrain the material flow along the length direction of the blank 100 by stopping a movement of the end surface 108 of the blank 100 at the time of mold-clamping to thereby be press-molded.

Figure 10:
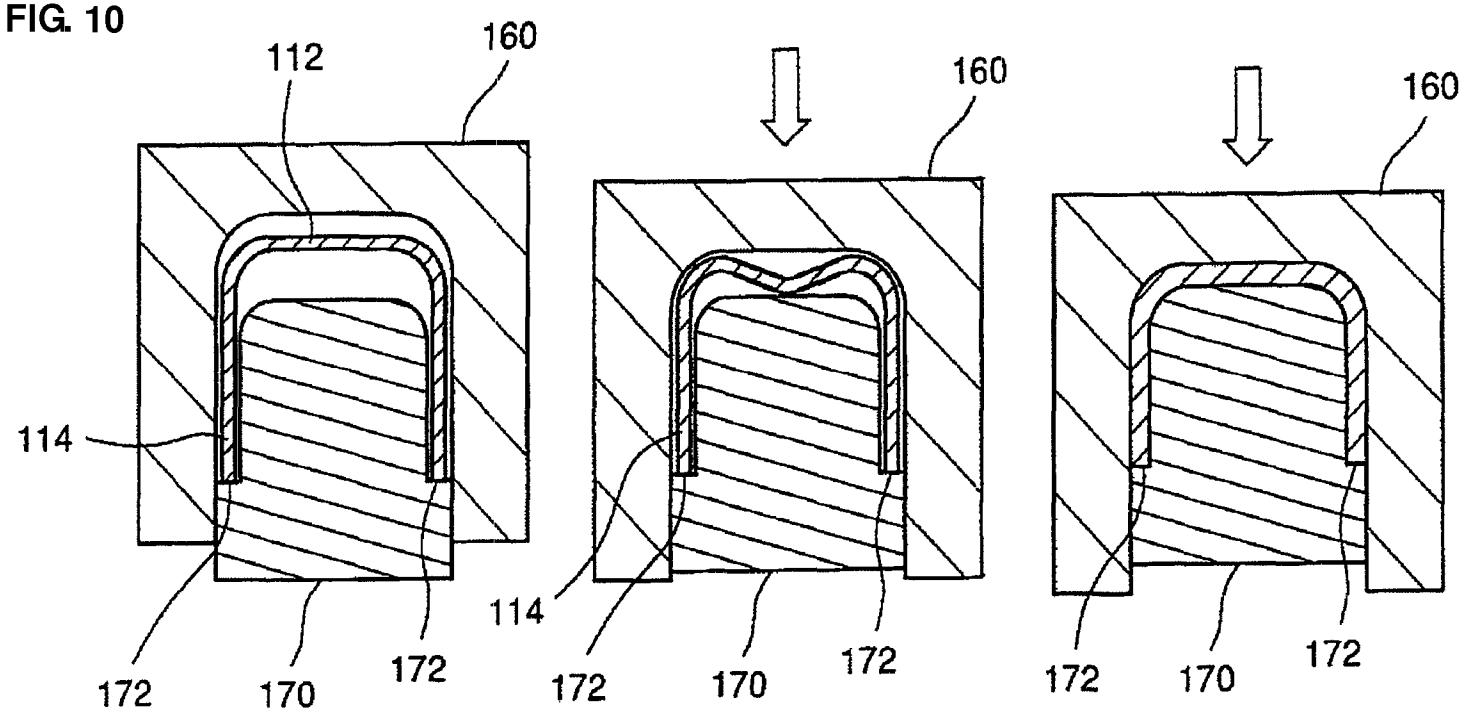
FIG. 10 is a cross-sectional view showing a procedure of forming the partial thickness increase portion in a method of manufacturing the press-molded product constructed in accordance with the first embodiment.
Figure 11:
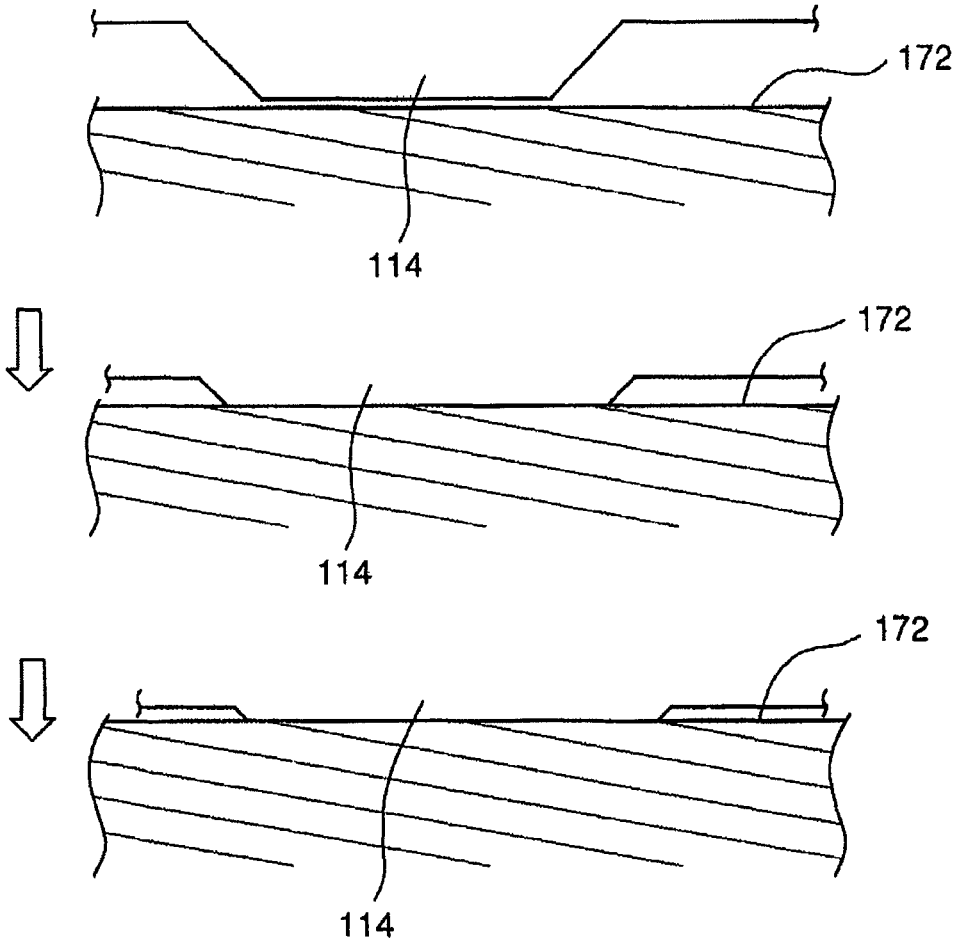
FIG. 11 is a cross-sectional view showing a pressing-in process of an extension of the blank shown in FIG. 10.
Figure 12:
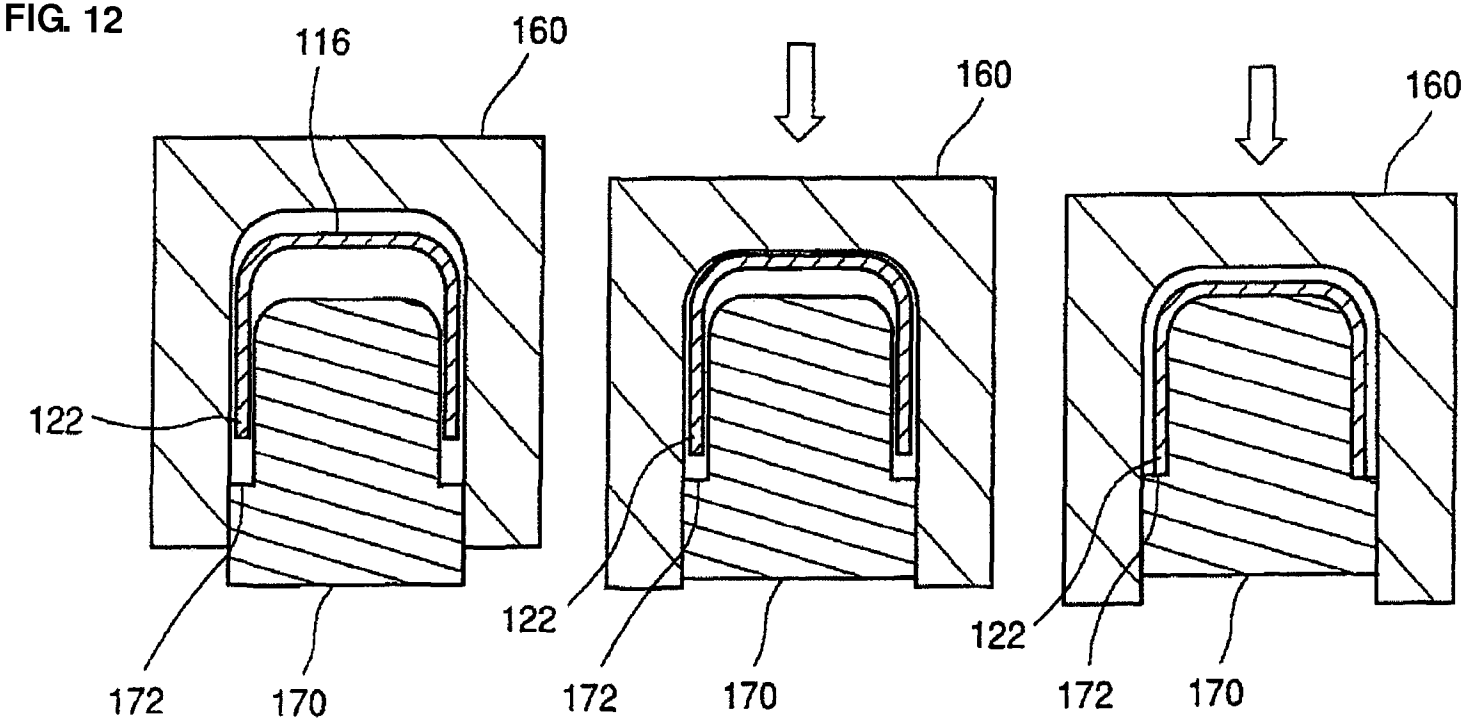
FIG. 12 is a cross-sectional view showing a procedure of forming the thickness non-increase portion adjacent to the partial thickness increase portion according to the first embodiment.

Next, a method of manufacturing the press-molded product constructed in accordance with the first embodiment is explained with reference to FIGS. 10-12.

The press-molding process includes a preparing process for preparing the blank 100, an arranging process for arranging the blank 100 between the upper mold 160 and the lower mold 170, a bending process for bending the connecting wall portion 106 to the gap within the mold and a thickness increasing process for increasing the plate thicknesses at both sides of the side wall portion 104 and connecting wall portion 106 by inserting the connecting wall portion 106 with the upper mold 160 and lower mold 170 when the connecting wall portion 106 is bent while compressing the side wall portion 104 from both sides along the length direction of the side wall portion 104 by the upper mold 160 and lower mold 170.

More specifically, the blank 100 is first arranged at the lower mold 170. The extension 114 of the blank 100 contacts the step portion 172 of the lower mold 170. The length of the cross-sectional periphery of the peripheral region including the thickness non-increase prearranged portion 116 is shorter than the length of the cross-sectional periphery of the peripheral region including the extension 114. Thus, the peripheral region including the thickness non-increase prearranged portion 116 is spaced from the step portion 172 of the lower mold 170.

When the upper mold 160 descends toward the lower mold 170 in order to press-mold by mold-clamping, the inner surface portion of the upper mold 160 contacts the connecting wall portion 106 of the blank 100 arranged at the lower mold 170. Since a mold-clamping force of the upper mold 160 presses the extension 114 of the blank 100 toward the step portion 172 of the lower mold 170, the extension 114 is deformed as shown in FIG. 11.

Along with the mold-clamping operation, there is a gap or space formed between the inner surface portion of the upper mold 160 and a top surface of the outer surface portion of the lower mold 170 wherein the space allows the material to flow. The connecting wall portion 106 of the blank 100 is positioned at the space. That is, in the course of mold-clamping, a gap formed between the connecting wall portion 106 and the lower mold 170 is greater than a gap formed between the side wall portion 104 and the lower mold 170. As such, the material of the extension 114 flows upwardly so as to be pressed-in.

At this time, the connecting wall portion 106 is bent by a pressing force exerted from the side wall portion 104 to the connecting wall portion 106 by contacting an end surface of the side wall portion 104 at a side opposite to the connecting wall portion 106 to the step portion 172 of the lower mold simultaneously with contacting the connecting wall portion 106 to the upper mold 160 and pressing the side wall portion 104 by the step portion 172 of the lower mold 170 and the upper mold 160. That is, a center portion of the connecting wall portion 106 is bent toward the lower mold side to form a curved portion by supporting the side wall portion 104 with the upper mold 160 and lower mold 170 while pressing-in the connecting wall portion 106 by the upper mold 106. At this time, a region of the molding surface of the upper mold 160 corresponding to the corner portion between the side wall portion 104 and connecting wall portion 106 of the blank 100 guides the corner portion to the connecting wall portion side.

Then, the curved portion of the connecting wall portion 106 disappears by inserting the connecting wall portion 106 with the upper mold 160 and lower mold 170 when the connecting wall portion 106 is bent while compressing the side wall portion 104 from both sides of the side wall portion 104 along the length direction by the upper mold 160 and lower mold 170. This increases the plate thicknesses at the side wall portion 104 and connecting wall portion 106.

The extension 114 is positioned at the edge portion 102 of the peripheral region including the thickness increase prearranged portion 112 and the cross-sectional thickness of the cavity at the time of mold-clamping in consideration of the thickness increase caused by the material flow. Thus, the material flow of the extension 114 causes an increase of the plate thickness of the thickness increase prearranged portion 112 as shown in FIG. 10. As such, the partial thickness increase portion 132 of the press-molded product 120 is formed.

Further, the lateral mold 180 is positioned at a lateral direction of the upper mold 160 and lower mold 170. The lateral mold 180 contacts the end surface 108 of the blank 100, thereby stopping the movement of the end surface 108. Since the material of the extension 114 is restrained from flowing along the length direction of the blank 100, the material of the extension 114 primarily flows along the peripheral direction of the blank 100. That is, the plate thickness in the peripheral region is efficiently increased.

Further, the peripheral region including the thickness non-increase prearranged portion 116 of the blank 100 is approximately identical to the peripheral region including the thickness non-increase portion 136 of the press-molded product 120 and does not include the extension 114. As such, since the lower mold 170 is not pressed-in by the step portion 172, and the material flow causing the increase of the plate thickness is not generated, the plate thickness is not increased as shown in FIG. 12. Consequently, the thickness non-increase portion 136 of the press-molded product is formed.

Figures 13, 14:
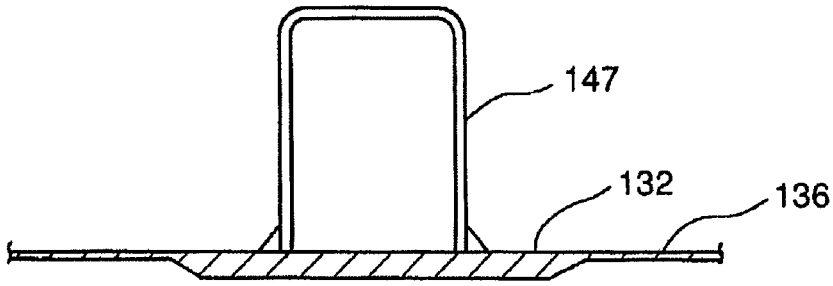
FIG. 13 is a chart showing a relationship between a pressing-in ratio and a press-molding result.
FIG. 14 is a cross-sectional view showing a first modification of the first embodiment.

FIG. 13 shows a relationship between a pressing-in ratio and a press-molding result. The pressing-in ratio is a value obtained by subtracting the length of the cross-sectional periphery of the peripheral region including the partial thickness increase portion 132 of the press-molded product 120 from the length of the cross-sectional periphery including the thickness increase prearranged portion 112 and extension 114 of the blank 100. The resultant is then divided by the length of the cross-sectional periphery of the peripheral region including the partial thickness increase portion 132.

Since the pressing-in ratio corresponds to an amount of the material flow, if the pressing-in ratio is larger, then the effect of thickness increase is improved. However, as shown in FIG. 13, when the pressing-in ratio is 30%, a desired molding performance is indicated. However, when the pressing-in ratio becomes 32%, a buckling is generated in the connecting wall portion 126 of the partial thickness increase portion 132 of the press-molded product 120.

That is, when the pressing-in ratio is excessively large, an excessive curved portion is formed in the connecting wall portion 106 of the blank 100 since the material excessively flows into the space generated between the inner surface portion of the upper mold and the top surface of the outer surface portion of the lower mold 170 at the time of press-molding. Since such a curved portion is not extended, the curved portion does not disappear, thereby generating the buckling. Pressing-in ratio equal to or lower than 30% can be used to avoid generation of the buckling.

Figure 15:
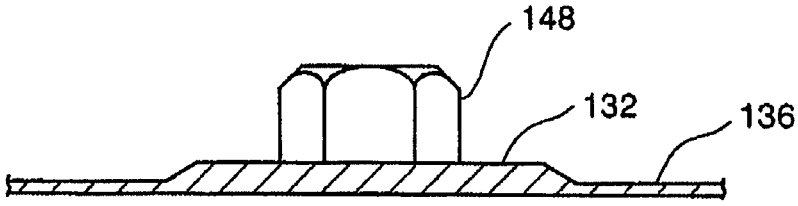
FIG. 15 is a cross-sectional view showing a second modification of the first embodiment.
Figure 16:
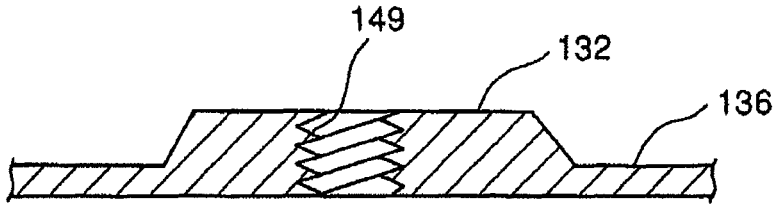
FIG. 16 is a cross-sectional view showing a third modification of the first embodiment.

FIGS. 14 to 16 are cross-sectional views showing first to third modifications of the first embodiment.

When the local region requiring the rigidity or strength is small, the partial thickness increase portion 132 of the press-molded product can be configured to take up a part of the peripheral region by adjusting the shape of the extension of the blank, the inner shape of the upper and lower molds and the cross-sectional thickness of the cavity at the time of mold-clamping.

For example, as shown in FIG. 14, when a bracket 147 smaller than the size of the suspension component 140 is applied, it is possible to effectively achieve the weight reduction of the suspension component 140 by arranging the partial thickness increase portion 132 in and around a region wherein the bracket 147 is installed by welding.

Further, when a nut 148 is fixed to perform the function of clamping, a reinforcing plate is conventionally applied in order to improve the strength of a base of the nut 148. However, as shown in FIG. 15, it is possible not to use the reinforcing plate by arranging the partial thickness increase portion 132 in a region wherein the nut 148 is installed.

Also, in order to clamp a separate component as shown in FIG. 16, it is also possible to form a hole portion 149 in the partial thickness increase portion 132. Compared to the thickness non-increase portion 136, the partial thickness increase portion 132 is desirable since the hole portion 149 can be easily formed. In particular, the hole portion 149 can be used as an alternative to the nut 148 by performing a tap operation to demolish the nut 148.

As described above, according to the manufacturing method of the first embodiment, the press-molded product comprising the partial thickness increase portion is manufactured wherein the plate thicknesses at both sides of the side wall portion and the connecting wall portion are increased in the partial thickness increase portion. As such, although the thin blank is applied, since the rigidity or strength of the press-molded product is secured by the partial thickness increase portion, it is possible to easily enhance of the weight reduction of the press-molded product. Also, compared to the tailored blank applying the butt welding operation, since the partial thickness increase portion is formed by the press-molding operation with the desirable productivity, the manufacturing costs may be reduced.

Further, the press-molded product constructed in accordance with the first embodiment comprises the partial thickness increase portion wherein the plate thicknesses at both sides of the side wall portion and the connecting wall portion are increased. The partial thickness increase portion is arranged at the local region requiring the rigidity or strength. As such, although the peripheral portion of the partial thickness increase portion is thin, since the rigidity or strength of the press-molded product is secured by the partial thickness increase portion, it is possible to easily enhance the weight reduction of the press-molded product. Further, compared to the tailored blank applying the butt welding operation, since the partial thickness increase portion is formed by the press-molding operation with the desirable productivity, the manufacturing costs may be reduced.

Also, according to the manufacturing apparatus of the first embodiment, it is possible to manufacture the press-molded product comprising the partial thickness increase portion, wherein the plate thicknesses at both sides of the side wall portion and the connecting wall portion are increased, by press-molding the preform using a plurality of the molds comprising the punch portion and the die portion. As such, although the thin preform is applied, since the rigidity or strength of the press-molded product is secured by the partial thickness increase portion, it is possible to easily enhance the weight reduction of the press-molded product. Further, compared to the tailored blank applying the butt welding operation, since the portion in which the plate thickness is increased is formed by the press-molding operation with the desirable productivity, the manufacturing costs can be reduced. Thus, it is possible to enhance the reduction of the weight and manufacturing costs of the press-molded product.

As such, according to the first embodiment, it is possible to enhance the reduction of the weight and manufacturing costs of the press-molded product.

Also, since the peripheral length extending portion of the first embodiment is constituted by the extension arranged at the edge portion of the side wall portion of the blank, it is possible to effectively increase the thickness of the side wall portion of the press-molded product.

Further, it also is possible to arrange the extension at the end surface portion in the length direction or only one side portion of the blank. Also, it is possible to arrange a plurality of extensions along the length direction of the blank by a gap as well. In such a case, the press-molded product allows the partial thickness increase portion to be arranged along the length direction of the press-molded product by a gap.

The length of the cross-sectional periphery of the peripheral region including the thickness increase prearranged portion of the blank is not required to be longer than the length of the cross-sectional periphery of the peripheral region including the thickness non-increase expecting region. That is, the extension of the blank is not limited to a shape protruded from the edge portion of the peripheral region including the thickness non-increase expecting region. Rather, it may be positioned at the same planar shape as the edge portion or have a retracted shape from the edge portion, such as a concave shape, depending on the shape of the press-molded product. In such a case, it is possible to press-in the extension by forming a protruding region in the step portion of the lower mold wherein the protruding region contacts the extension.

Figure 17:
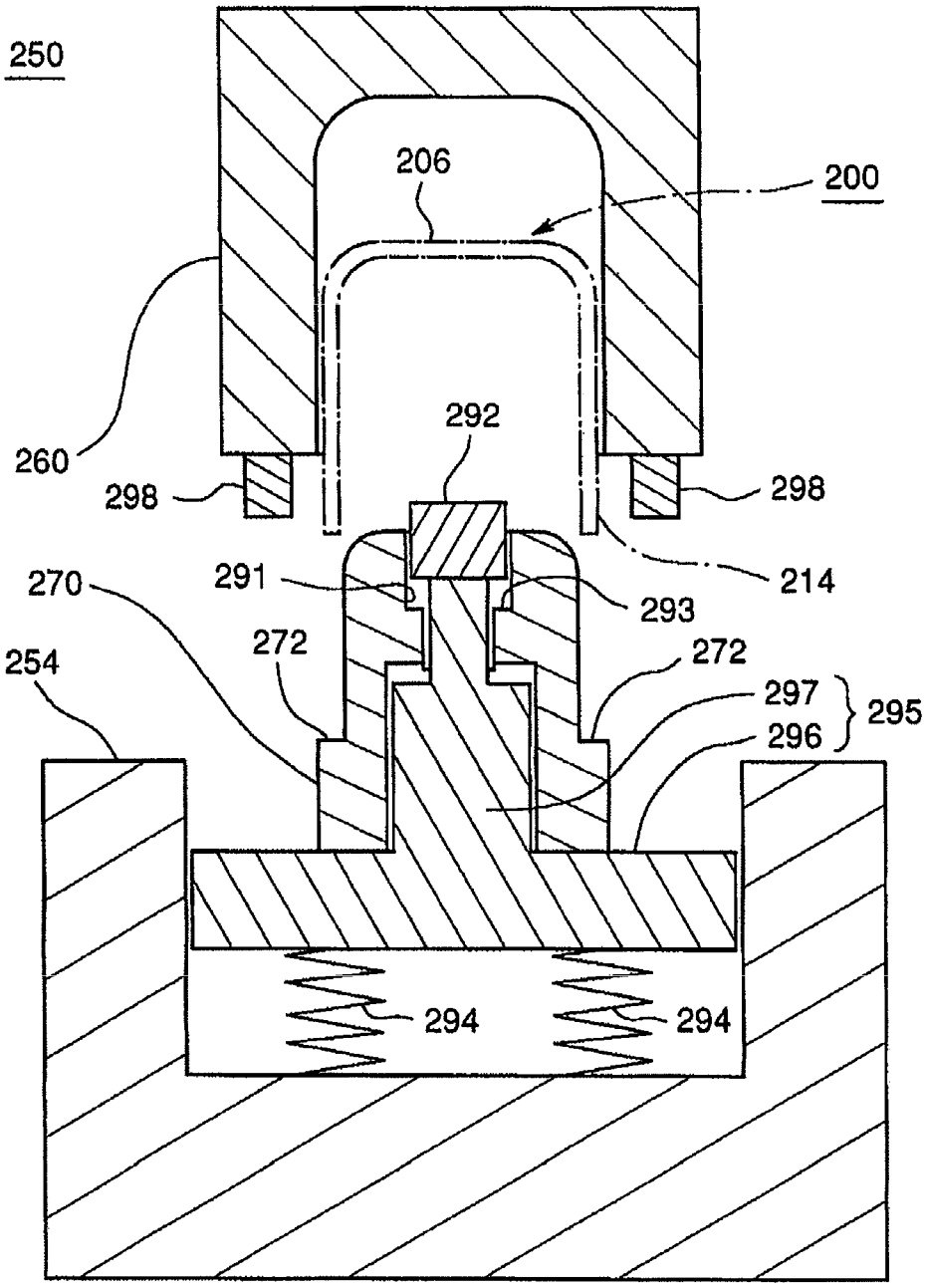
FIG. 17 is an exploded view showing an apparatus for manufacturing a press-molded product constructed in accordance with a second embodiment.
Figure 18:
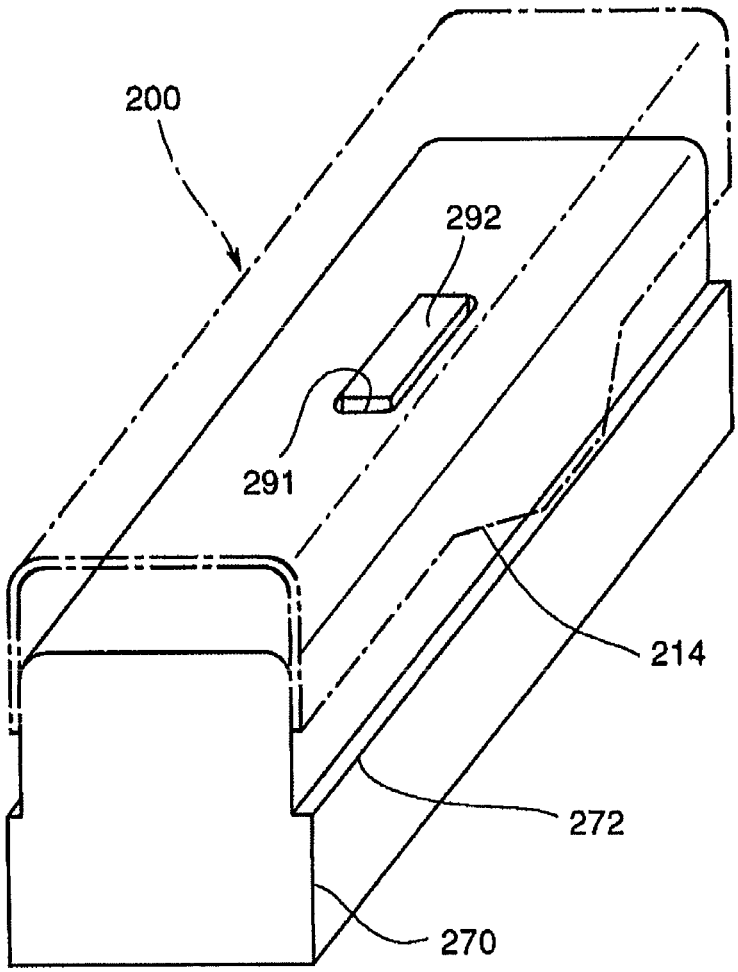
FIG. 18 is a perspective view showing a lower mold shown in FIG. 17.

Next, a second embodiment of the invention is explained initially with reference to FIGS. 17 and 18.

An apparatus for manufacturing a press-molded product constructed in accordance with the second embodiment generally differs from the apparatus for manufacturing the press-molded product constructed in accordance with the first embodiment in that it comprises a restraining mechanism for restraining a bending degree of a connecting wall portion 206 of a blank 200 arranged at a lower mold 270.

The restraining mechanism comprises a through hole 291, a pad portion 292, which acts as a supporting member, a stopper 293, a spring mechanism 294, a supporting member 295 and a pin member 298. The through hole 291 is arranged at a top portion of the lower mold 270. The pad portion 292 is arranged so that it can appear and disappear from the through hole 291 and be pressed toward a direction protruded from the through hole 291. A pressing force of the pad portion 292 is weaker than a mold-clamping force of the lower mold 270 and upper mold 260.

Since the pad portion 292 is retracted toward an inner portion of the through hole 291 as the upper mold 260 descends, the pad portion 292 does not affect a mold-clamping of the lower mold 270 and upper mold 260. Further, since the connecting wall portion 206 of the blank 200 arranged at the lower mold 270 is pressed by an inner surface portion of the upper mold 260, the connecting wall portion 206 is seized by being supported by the pad portion 292.

Thus, at an initial press-molding operation, since a space generated between the inner surface portion of the upper mold 260 and the pad portion 292 is constantly maintained, the connecting wall portion 206 of the blank 200 avoids being excessively curved by a material flow from an extension 214. As such, since a bending degree is restrained, it is possible to restrain a buckling of the connecting wall portion 206. That is, although a pressing-in ratio is formed to be greater, it is possible to further enhance the thickness increase of the partial thickness increase portion of the press-molded product.

The stopper 293 performs the function of stopping a retraction of the pad portion 292 in the through hole 291 of the lower mold 270. It is formed of a diameter reducing portion arranged at the through hole 291 wherein a diameter of the stopper 293 is smaller than a diameter of the pad portion 292. A position of the stopper 293 is established such that the end surface of the stopped pad portion 292 and the top portion of the lower mold 270 are positioned at the same planar surface. Thus, since the material of the connecting wall portion 206 of the blank 200 is restrained from flowing into the through hole 291, formation of a mark or concave portion corresponding to the through hole 291 is prevented.

The spring mechanism 294 performs the function of generating the pressing force of the pad portion 292. An actuator or hydraulic cylinder, for example, may be used instead of the spring mechanism 294. Further, reference numeral 254 refers to a base portion of the press-mold wherein the spring mechanism 294 is arranged.

The supporting member 295 comprises a base portion 296 and a shaft portion 297 and is arranged between the pad portion 292 and the spring mechanism 294. The base portion 296 is positioned at a downward direction of the lower mold 270 and may contact the lower mold 270. The shaft portion 297 is inserted through the through hole 291 of the lower mold 270 and detachably supports the pad portion 292.

A length of the shaft portion 297 is established such that when the base portion 296 contacts the lower mold 270, the pad portion 292 protrudes from the through hole 291 of the lower mold 270. Since the shaft portion 297 is not connected to the pad portion 292, although the retraction of the pad portion 292 is stopped by the stopper 293, the supporting member 295 may continue to retract.

The pin member 298 is arranged to face the base portion 296 of the supporting member 295 and protrudes from the upper mold 260. If the upper mold 260 descends in order to mold-clamp, the pin member 298 contacts the base portion 296 of the supporting member 295, thereby allowing the supporting member 295 to descend. As such, the pad portion 292 positioned at an upward direction of the shaft portion 297 of the supporting member 295 descends while supporting the connecting wall portion 206 of the blank 200. That is, the restraining mechanism comprises a linkage mechanism for operating the mold-clamping of the upper mold 260 and lower mold 270 and the support of the connecting wall portion 206 of the blank 200 by the pad portion 292.

Next, a method of manufacturing the press-molded product constructed in accordance with the second embodiment is explained with reference to FIGS. 19-23.

The present manufacturing method generally differs from that of the first embodiment since the buckling of the connecting wall portion 206 is restrained by restraining the bending degree of the connecting wall portion 206 of the blank 200.

More specifically, the blank 200 is first arranged at the lower mold 270. The extension 214 of the blank 200 contacts a step portion 272 of the lower mold 270. The pad portion 292 is pressed via the supporting member 295 by the spring mechanism 294 and protrudes from the through hole 291 of the lower mold 270.

Figure 19:
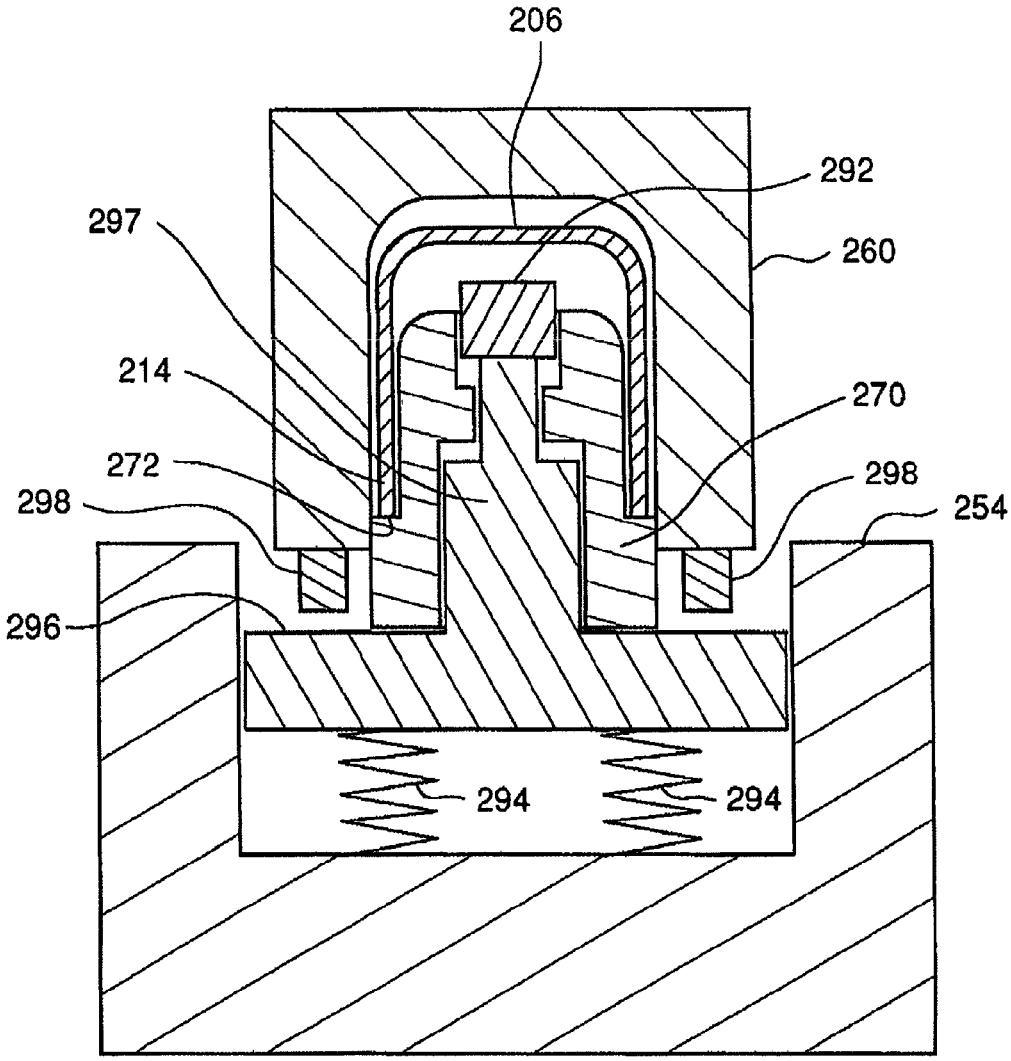
FIG. 19 is a cross-sectional view showing a method of manufacturing the press-molded product of the second embodiment and illustrating a descent of an upper mold shown in FIG. 18.
Figure 20:
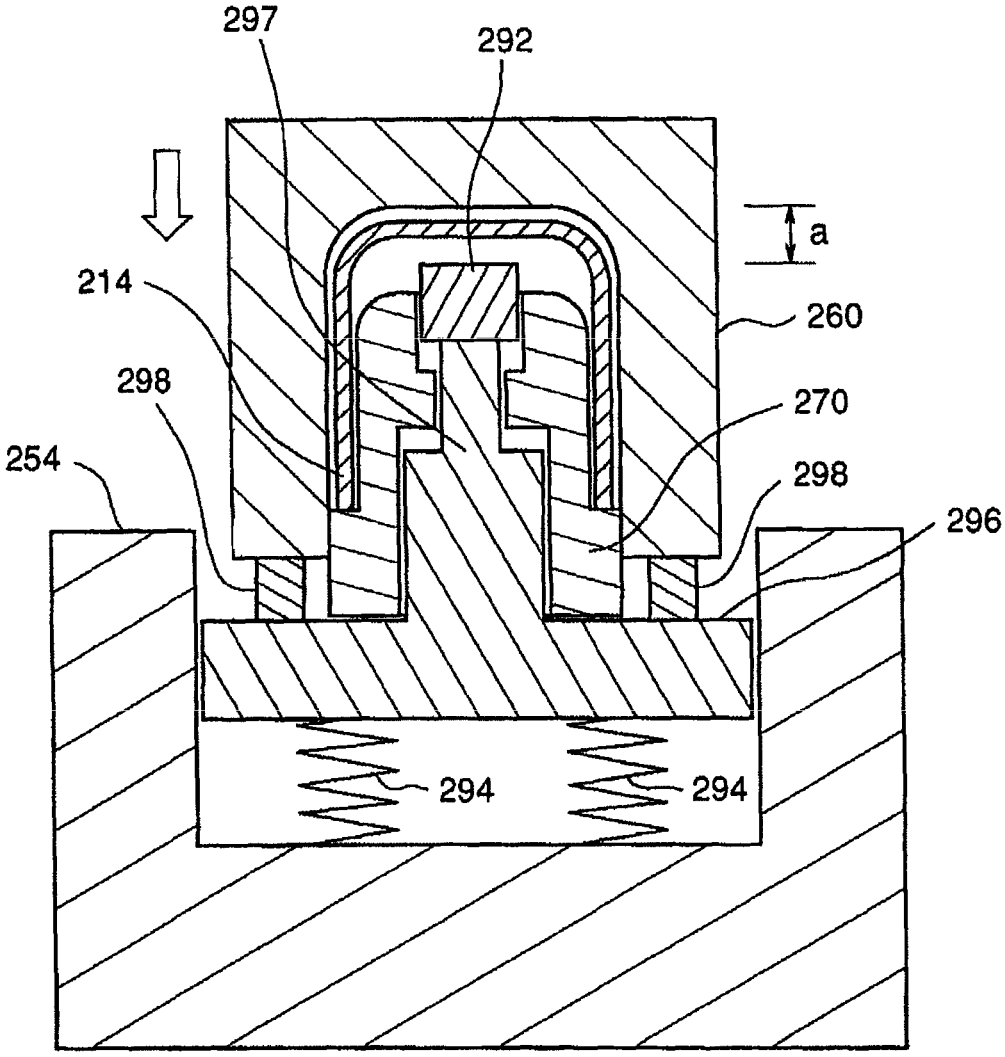
FIG. 20 is a cross-sectional view showing a contact of an upper mold and a pin member of a restraining mechanism subsequent to FIG. 19.

In order to press-mold by mold-clamping, the upper mold 260 descends toward the lower mold 270 as shown in FIG. 19. The pin member 298 protruding from the upper mold 260 contacts the base portion 296 of the supporting member 295 as shown in FIG. 20. At this time, there is a space between the inner surface portion of the upper mold 260 and the pad portion 292.

Further, if the inner surface portion of the upper mold 270 contacts the connecting wall portion 206 of the blank 200 arranged at the lower mold 270, since a mold-clamping force of the upper mold 260 presses the extension 214 of the blank 200 toward the step portion 272 of the lower mold 270, the extension 214 is deformed.

A center portion of the connecting wall portion 206 is bent toward the lower mold side to form a curved portion by a pressing force exerted from the side wall portion 204 to the connecting wall portion 206. This is achieved by contacting the connecting wall portion 206 with the upper mold 260 while contacting the end surface of the side wall portion 204 opposite to the connecting wall portion 206 with the step portion 272 of the lower mold 270 and pressing the side wall portion 204 by the step portion 272 of the lower mold 270 and the upper mold 260. At this time, a region of the molding surface of the upper mold 260 corresponding to a corner portion between the side wall portion 204 and connecting wall portion 206 of the blank 200 guides the corner portion to the connecting wall portion side.

The curved portion of the connecting wall portion 206 then disappears by inserting the connecting wall portion 206 between the upper mold 260 and lower mold 270 when the connecting wall portion 206 is bent while compressing the side wall portion 204 from both sides of the length direction of the side wall portion 204 by the upper mold 260 and lower mold 270. This increases the plate thicknesses at both sides of the side wall portion 204 and connecting wall portion 206.

Figure 21:
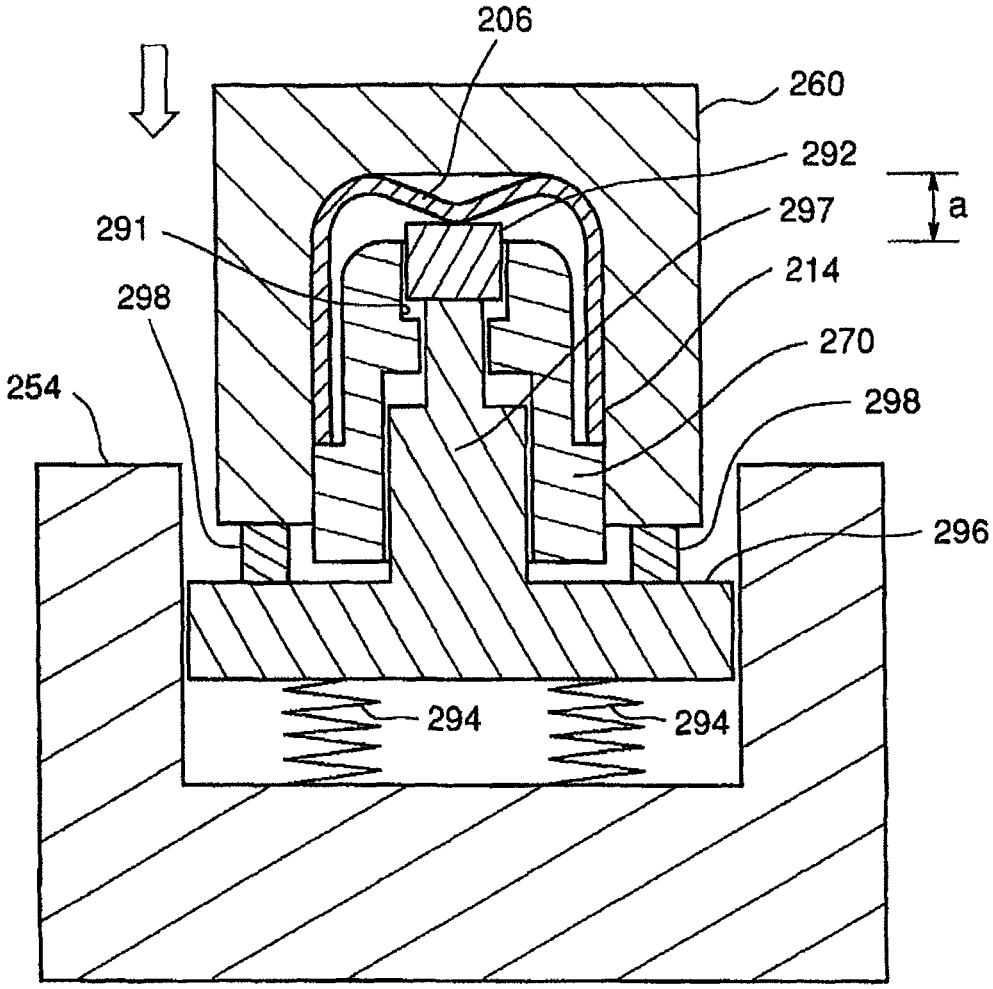
FIG. 21 is a cross-sectional view showing a curved portion formed at a connecting wall portion of the blank subsequent to FIG. 20.

In the course of the descent of the upper mold 260, the pad portion 292 is retracted as it is linked with the movement of the upper mold 260 supporting the connecting wall portion 206. A space "a" generated between the inner surface portion of the upper mold 260 and the pad portion 292 is constantly maintained as shown in FIG. 21.

Figure 22:
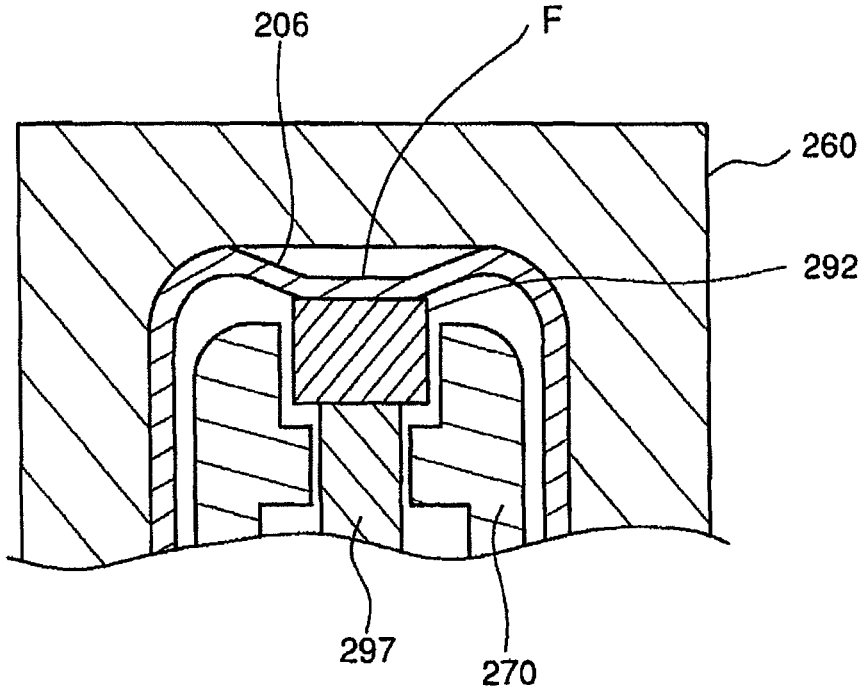
FIG. 22 is a cross-sectional view showing a flat portion formed at the curved portion subsequent to FIG. 21.

Further, if the descent of the upper mold 260 continues, then the pad portion 292 deforms the curved portion of the connecting wall portion 206 of the blank 200, thereby generating a flat portion F as shown in FIG. 22. As such, since the connecting wall portion 206 of the blank 200 is hindered from being excessively deformed, the curved portion buckles.

Figure 23:
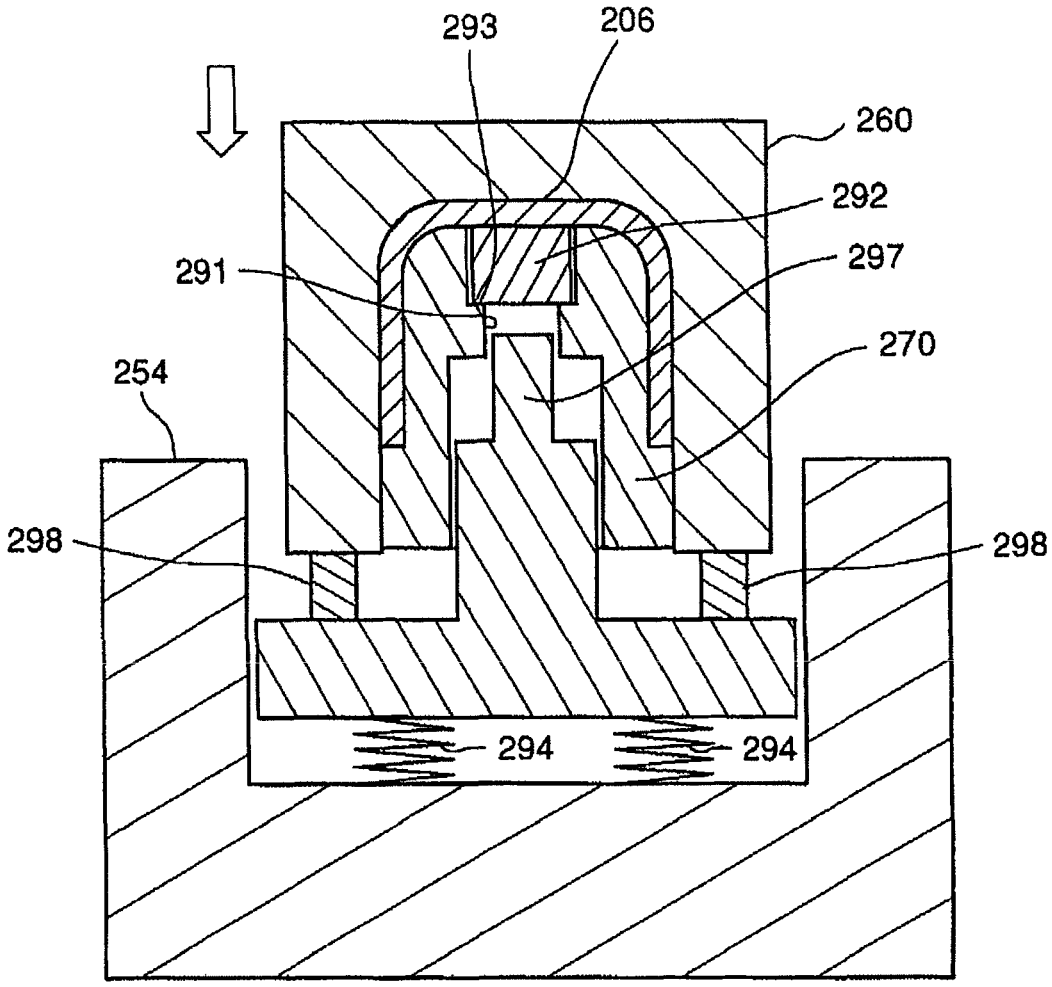
FIG. 23 is a cross-sectional view showing a disappearance of the curved portion subsequent to FIG. 22.

If the descent of the upper mold 260 further continues, since the pressing force of the pad portion 292 is weaker than the mold-clamping force of the lower mold 270 and upper mold 260, the pad portion 292 retracts to the through hole 291 of the lower mold 270 and is stopped by the stopper 293. The shaft portion 297 of the supporting member 295 supporting the pad portion 292 is spaced from the pad portion 292, and the supporting member 295 continues to retract. As such, the space generated between the inner surface portion of the upper mold 260 and the pad portion 292 becomes gradually smaller. Further, the curved portion of the connecting wall portion 206 of the blank 200 is pressed by the upper mold 260 and disappears as shown in FIG. 23.

Further, since a cross-sectional surface of the pad portion 292 stopped by the stopper 293 and a top portion of the lower mold 270 are positioned at the same planar surface, a mark or concave portion corresponding to the through hole 291 is prevented from forming in the press-molded product.

As described above, in the second embodiment, although the pressing-in ratio is greater, it is possible to restrain the buckling of the blank by restraining the bending degree of the connecting wall portion of the blank and to further enhance the thickness increase of the partial thickness increase portion of the press-molded product compared to the first embodiment.

Figure 24:
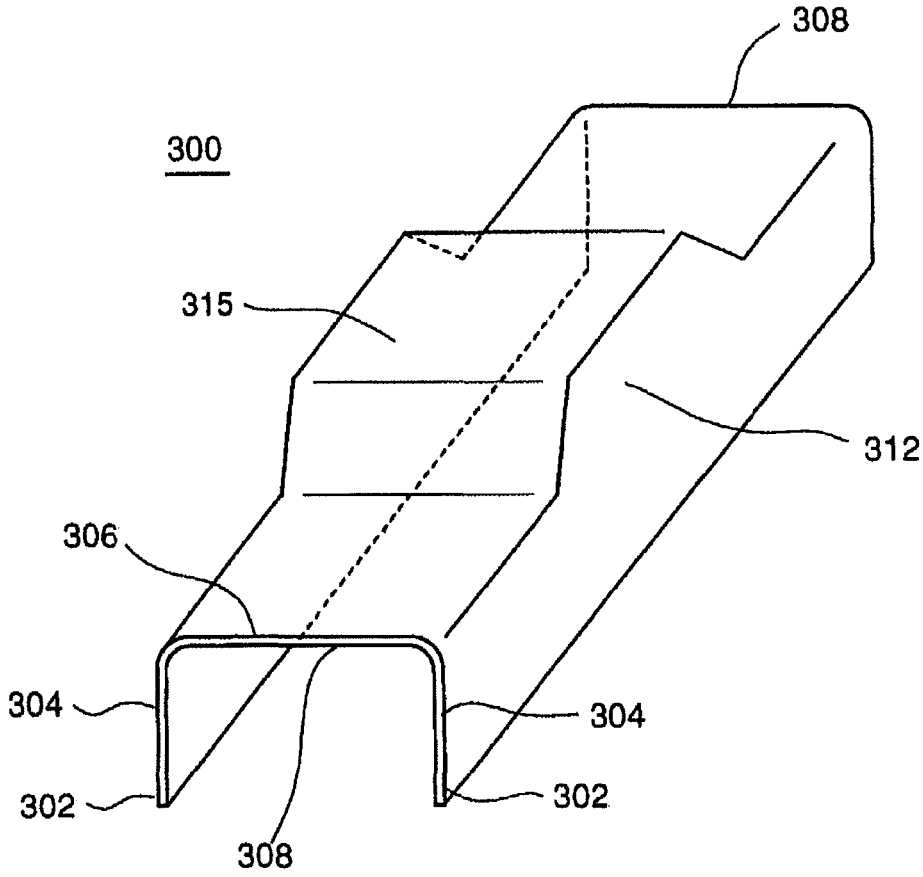
FIG. 24 is a perspective view showing a blank constructed in accordance with a third embodiment.

Next, a third embodiment of the present invention is explained with reference to FIGS. 24-26.

A blank 300 constructed in accordance with the third embodiment comprises a protrusion 315 in a surface at an upper mold side of a connecting wall portion 306 bulging to an outer side surface. The protrusion 315 is positioned at a peripheral region including a thickness increase prearranged portion 312 corresponding to the partial thickness increase portion of the press-molded product. A length of a cross-sectional periphery of the peripheral region is formed to be longer than a length of a cross-sectional periphery of the peripheral region including the partial thickness increase portion of the press-molded product.

That is, the protrusion 315 constitutes a peripheral length extension. Unlike the first embodiment including extension 114 arranged at the edge portion 102 of the side wall portion 104, it is possible to effectively increase the thickness of the connecting wall portion of the press-molded product as described below. The protrusion may be formed at the same time of molding the blank 300 by a rolling material.

Figure 25:
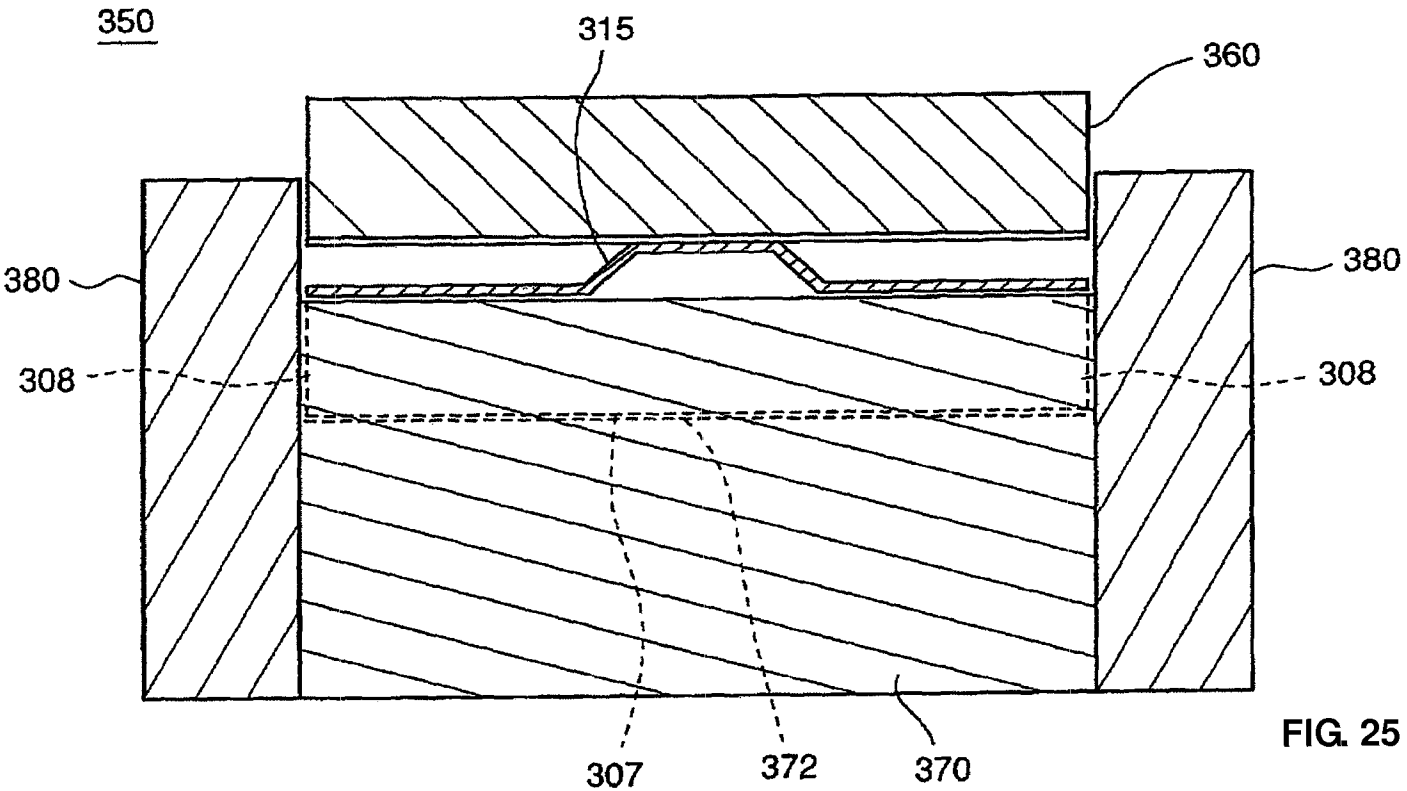
FIG. 25 is a cross-sectional view showing an apparatus for manufacturing a press-molded product constructed in accordance with the third embodiment.
Figure 26:
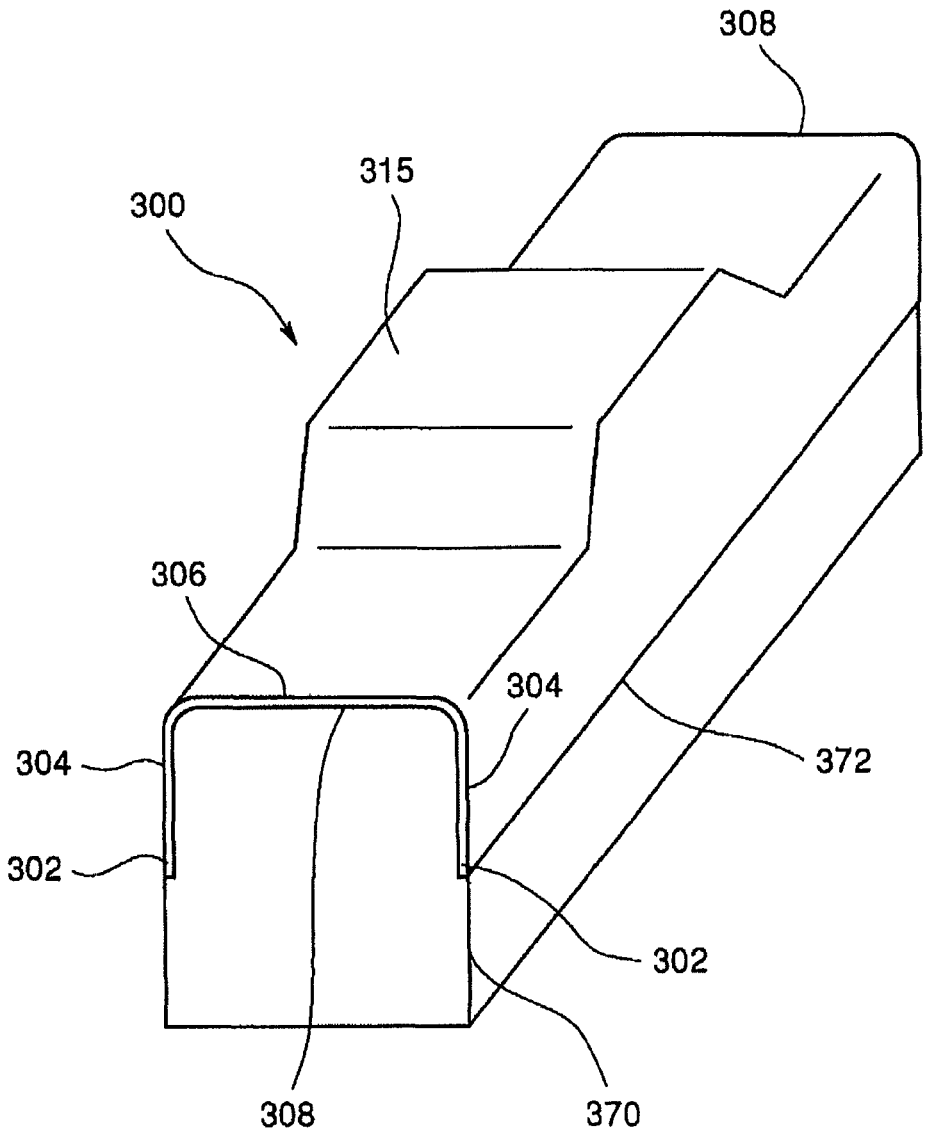
FIG. 26 is a perspective view showing a lower mold shown in FIG. 25.

An apparatus for manufacturing the press-molded product constructed in accordance with the third embodiment comprises an upper mold 360, a lower mold 370 and a lateral mold 380 as shown in FIG. 25. The lower mold 370 comprises a step portion 372 extending along an edge portion 302 of the arranged blank 300. The lateral mold 380 is arranged at a lateral direction of the upper mold 360 and lower mold 370 and is positioned to face an end surface 308 of the blank 300.

According to the method of manufacturing the press-molded product of the third embodiment, the blank 300 is first arranged at the lower mold 370. The edge portion 302 of the blank 300 contacts the step portion 372 of the lower mold 370.

When the upper mold 360 descends toward the lower mold 370 in order to press-mold by mold-clamping, then an inner surface portion of the upper mold 360 contacts the protrusion 315 arranged at the connecting wall portion 306 of the blank 300 arranged at the lower mold 370. A mold-clamping force of the upper mold 360 presses the protrusion 315 toward an inner surface portion of the lower mold 370. Further, the end surface 308 of the edge portion 302 of the blank 300 is stopped by the step portion 372 of the lower mold 370.

Thus, the protrusion 315 is deformed such that a material of the protrusion 315 flows into the connecting wall portion 306 and side wall portion 304 of the blank 300, thereby causing an increase in the plate thickness of the thickness increase prearranged portion 312. That is, the press-molded product comprising the partial thickness increase portion can be obtained. Since the protrusion 315 is arranged at the connecting wall portion 306, the thickness of the connecting wall portion of the press-molded product is effectively increased.

Figure 27:
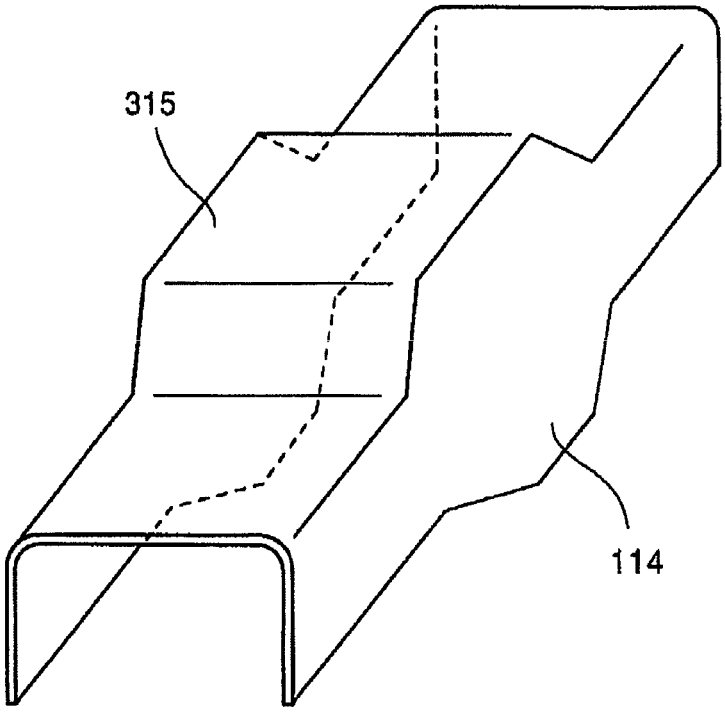
FIG. 27 is a perspective view showing a modification of the third embodiment.

FIG. 27 is a perspective view showing a modification of the third embodiment. In this modification, the protrusion 315 is not exclusive to the extension 114 of the first embodiment. For example, it is possible to constitute the peripheral length extending region by the protrusion 315 and the extension 114. In such a case, it is possible to effectively increase the thicknesses of the connecting wall portion and side wall portion of the press-molded product.

As described above, as in the first embodiment, it is possible to enhance the reduction of the weight and manufacturing costs of the press-molded product according to the third embodiment. Further, since the peripheral length extending region of the third embodiment is constituted by the protrusion arranged at the connecting wall portion of the blank, it is possible to effectively increase the thickness of the connecting wall portion of the press-molded product.

Further, it is possible to arrange the protrusion at an end surface portion of a length direction of the blank. Also, it is possible to arrange a plurality of protrusions along the length direction of the blank by a gap. In such a case, the press-molded product has the partial thickness increase portion arranged along the length direction of the press-molded product by a gap.

The partial thickness increase portion of the press-molded product can be configured to take up a part of the peripheral region by adjusting the shape of the protrusion or cross-sectional thickness of the cavity at the time of mold-clamping when the local region requiring the rigidity or strength is small. For example, it is possible to effectively achieve the reduction of the weight of the press-molded product by allowing the protrusion to be smaller and forming the partial thickness increase portion in a part of the connecting wall portion of the press-molded product according to the first to third modifications of the first embodiment.

Figure 28:
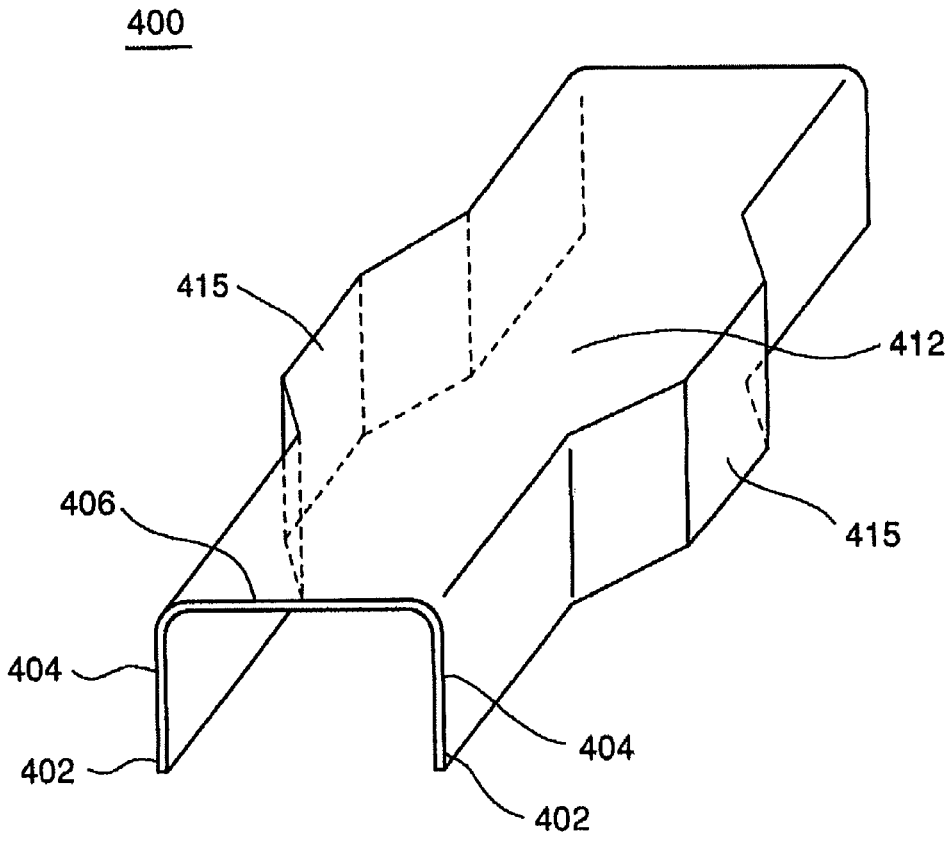
FIG. 28 is a perspective view showing a blank constructed in accordance with a fourth embodiment.
Figure 29:
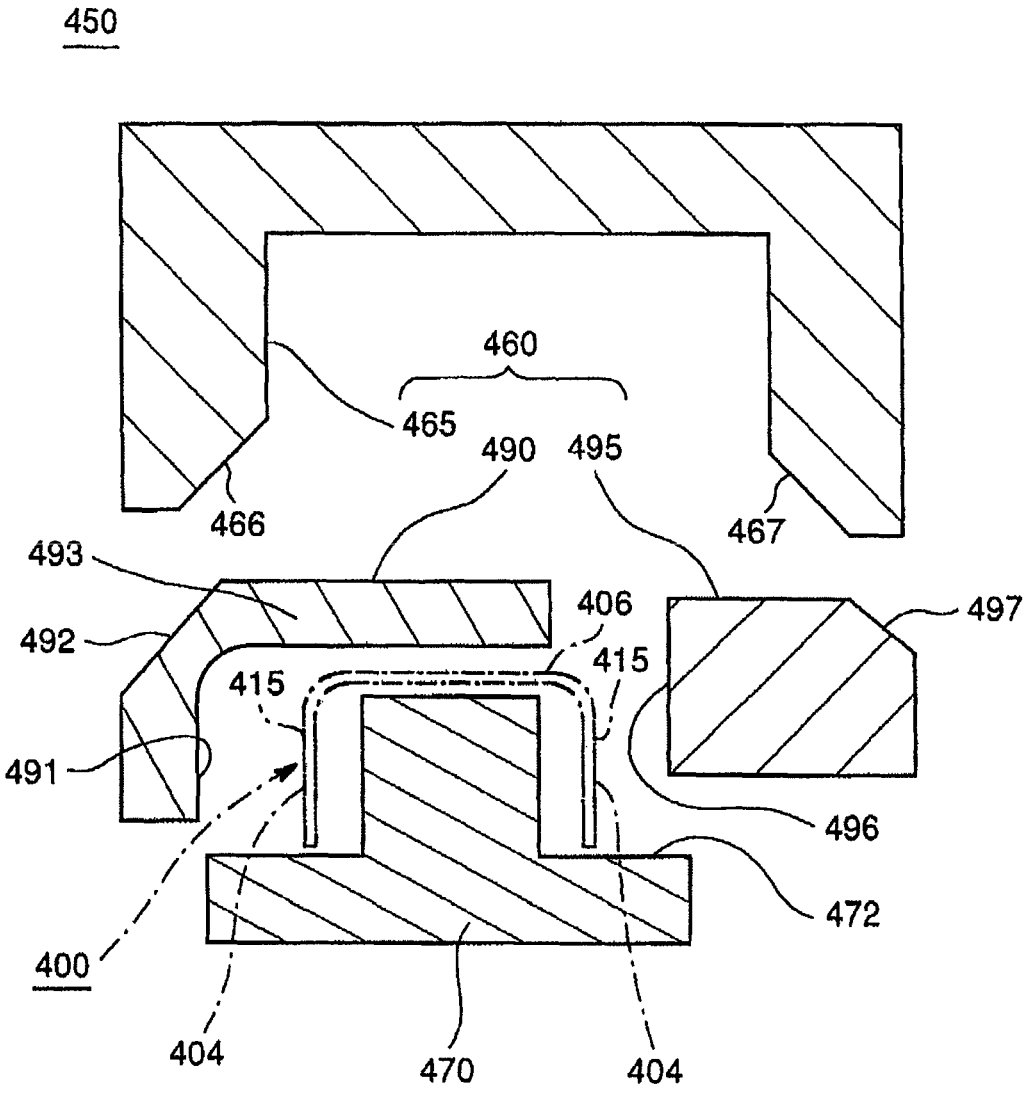
FIG. 29 is an exploded view showing an apparatus for manufacturing a press-molded product constructed in accordance with the fourth embodiment.

Next, a fourth embodiment of the invention is explained with reference to FIGS. 28 and 29.

A blank 400 constructed in accordance with the fourth embodiment comprises a protrusion 415 on each side wall portion 404 wherein the protrusion 415 is configured to bulge therefrom. It generally differs from the blank 300 of the third embodiment comprising the protrusion 315 arranged at a connecting wall portion 306.

An apparatus 450 for manufacturing the press-molded product of the fourth embodiment comprises an upper mold 460, a lower mold 470 and a lateral mold (not shown).

The upper mold 460 comprises a plurality of divided molds including a first transversal mold 490, a second transversal mold 495 and an upward direction mold 465. The first and second transversal molds 490 and 495 form a first divided mold, which comprises an inner surface portion that can be closely spaced and integrated, thereby corresponding to an outer surface shape of the press-molded product. The upward direction mold 465 is a second divided mold that faces the lower mold 470 via the first and second transversal molds 490 and 495. The upward direction mold 465 is used for generating a mold-clamping force of the upper and lower molds 460 and 470 by driving the first and second transversal molds 490 and 495.

The first transversal mold 490 comprises a side wall portion 491, an extension 493 and an inclined surface 492. The side wall portion 491 faces the protrusion 415 and comprises an inner surface portion corresponding to an outer surface shape of the side wall portion 404 of the press-molded product. The extension 493 faces the connecting wall portion 406 of the blank 400 and comprises an inner surface portion corresponding to an outer surface shape of the connecting wall portion 406. The inclined surface 492 is arranged at an outer periphery of a corner portion that connects the side wall portion 491 and the extension 493. A cross-sectional thickness of a cavity at the time of mold-clamping between the extension 493 and a top surface of the lower mold 470 is greater than a plate thickness of the blank 400 in consideration of a thickness increase by a material flow.

The second transversal mold 495 comprises an inclined surface 497 and a side wall portion 496. The inclined surface 497 is arranged at an outer periphery of a corner portion in an upward direction. The inclined surface 497 and the inclined surface 492 of the first transversal mold 490 are inclined in opposing directions.

The side wall portion 496 faces the protrusion 415 and comprises an inner surface portion corresponding to an outer surface shape of the side wall portion 404 of the press-molded product opposite to the side wall portion 491. A height of the side wall portion 496 is approximately the same as a height of the side wall portion 491 of the first transversal mold 490. The second transversal mold 495 is insertable into a space formed between the extension 493 of the first transversal mold 490 and a step portion 472 of the lower mold 470.

A stop position when the first and second transversal molds 490 and 495 become closer is established in consideration of the thickness increase by the material flow. That is, a cross-sectional thickness of a cavity at the time of mold-clamping between the side wall portions 491 and 496 and the lower mold 470 at the stop position is greater than the plate thickness of the blank 400.

Thus, if the first and second transversal molds 490 and 495 drive closer to each other, then the side wall portion 491 of the first transversal mold 490 and the side wall portion 496 of the second transversal mold 495 contact the protrusion 415 and generate the material flow causing an increase of the plate thickness by pressing-in the protrusion 415. At this time, since the protrusion 415 is arranged at the side wall portion 404, a thickness of the side wall portion 404 of the press-molded product is effectively increased.

The upward direction mold 465 is a cross-sectional concave shape and comprises a base portion and a protrusion extending from both ends of the base portion. The upward direction mold 465 can be closely spaced to the first and second transversal molds 490 and 495. The protrusion of the upward direction mold 465 comprises opposed, inclined surfaces 466 and 467 respectively corresponding to the inclined surfaces 492 and 497 of the first and second transversal molds 490 and 495.

When the upward direction mold 465 becomes closer to the lower mold 470, then the inclined surfaces 466 and 467 respectively contact the inclined surfaces 492 and 497 of the first and second transversal molds 490 and 495, thereby pressing the inclined surfaces 492 and 497 in a direction in which they become closer. As such, the first and second transversal molds 490 and 495 become closer to each other, thereby contacting the protrusion 415 and pressing-in.

The manufacturing apparatus of the fourth embodiment comprises a linkage mechanism for linking the movement of the upward direction mold 465 close to the lower mold 470 and the contact of the first and second transversal molds 490 and 495 with the protrusion 415. In particular, since the present linkage mechanism uses the contact of the inclined surfaces 466, 467, 492 and 497, the linkage mechanism is desirable for its simple structure. Further, it is also possible to apply an independent driving mechanism or driving apparatus to each of the first and second transversal molds 490 and 495.

Figure 30:
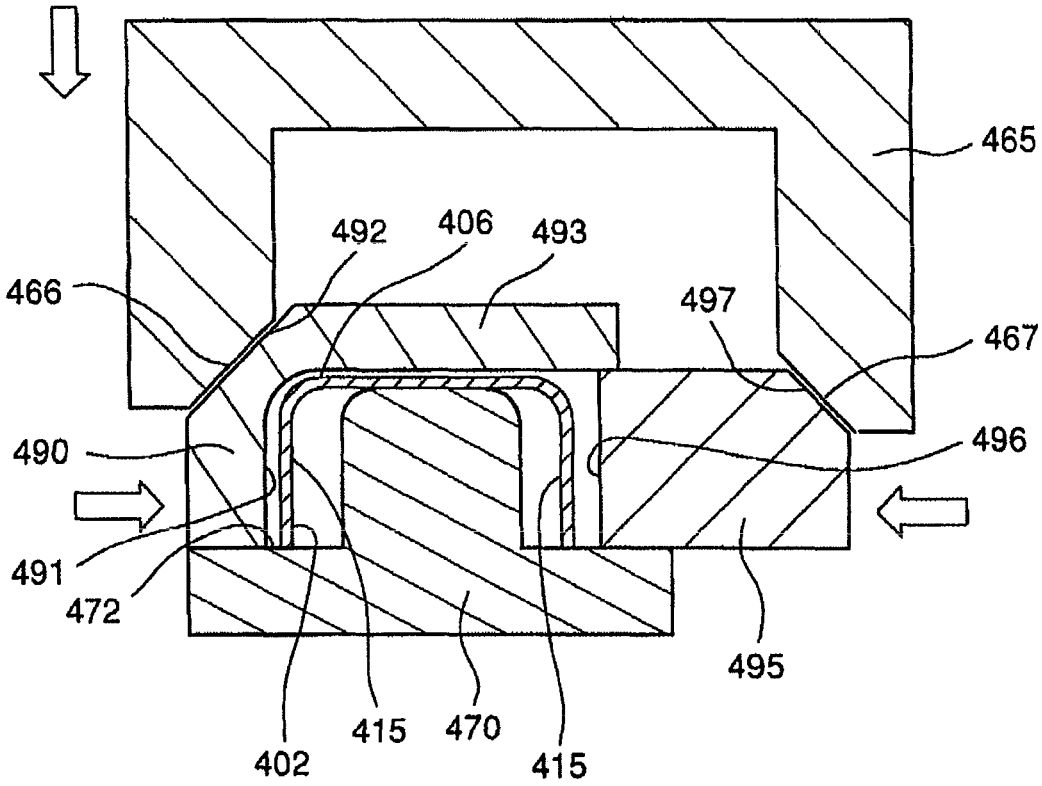
FIG. 30 is a cross-sectional view showing a method of manufacturing the press-molded product constructed in accordance with the fourth embodiment and illustrating a descent of an upper mold shown in FIG. 29.
Figure 31:
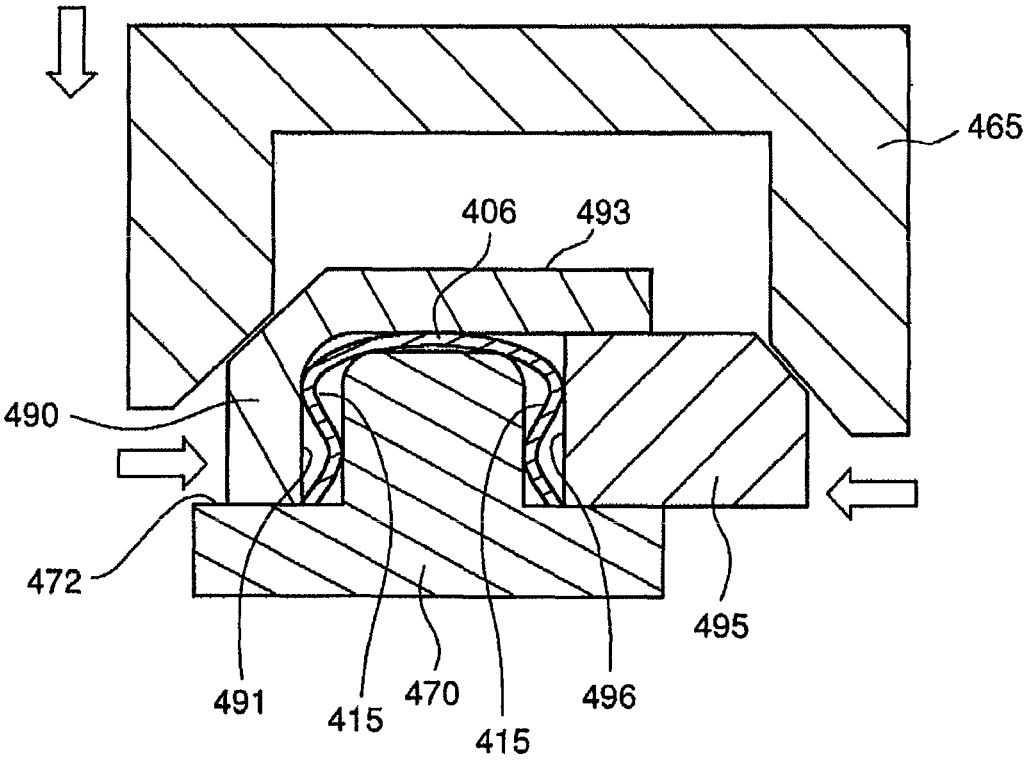
FIG. 31 is a cross-sectional view showing a curved portion formed at a side wall portion of the blank subsequent to FIG. 30.
Figure 32:
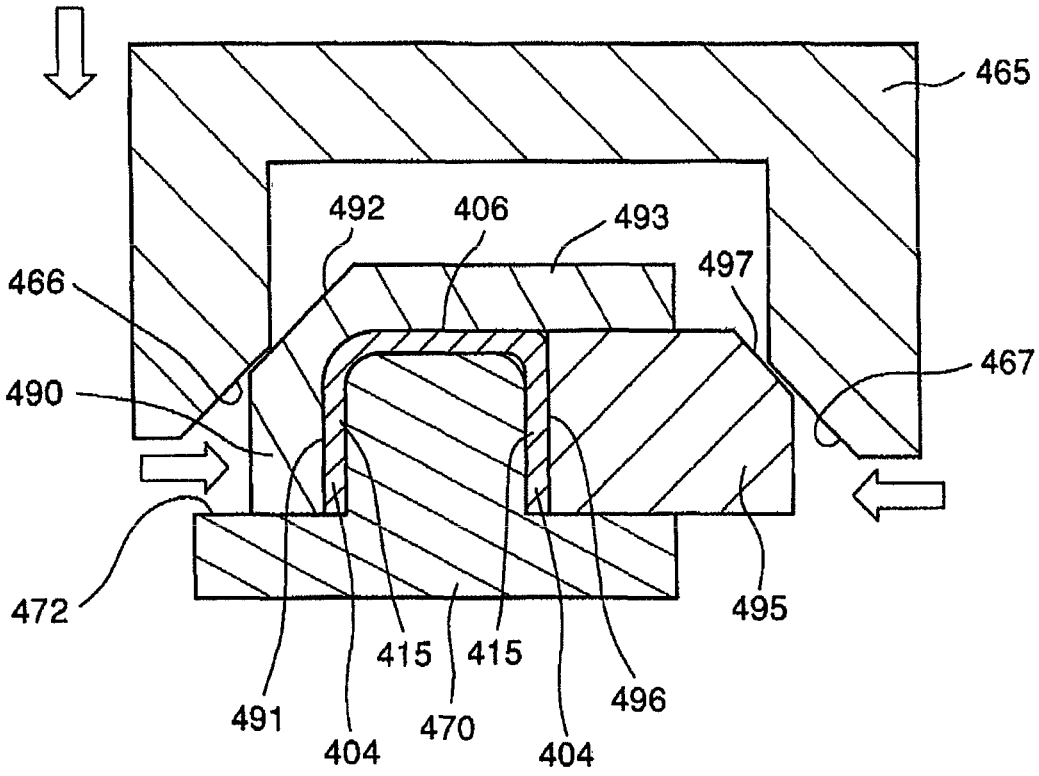
FIG. 32 is a cross-sectional view showing a disappearance of the curved portion subsequent to FIG. 31.

Next, a method of manufacturing the press-molded product constructed in accordance with the fourth embodiment is explained with reference to FIGS. 30-32.

First, the blank 400 is arranged at the lower mold 470. The edge portion 402 of the blank 400 contacts the step portion 472 of the lower mold 470.

The first and second transversal molds 490 and 495 are arranged at an outer side of the blank 400. At this time, the side wall portion 491 and extension 493 of the first transversal mold 490 face the protrusion 415 at one side and the connecting wall portion 406 of the blank 400. Further, the side wall portion 496 of the second transversal mold 495 is position-determined to face the protrusion 415 at the other side. A corner portion comprises a molding surface in an arc shaped cross-section wherein the corner portion is positioned between the side wall portion 491 and the extension 493 and connects the side wall portion 491 and the extension 493. The corner portion corresponds to the corner portion between the side wall portion 404 and connecting wall portion 406 of the blank 400. The corner portion provides a guide for bending the side wall portion 404 by guiding the corner portion of the blank 400 to the side wall portion side.

When the upward direction mold 465 descends toward the lower mold 470 in order to press-mold by mold-clamping, then the inclined surfaces 466 and 467 of the upward direction mold 465 respectively contact the inclined surfaces 492 and 497 of the first and second transversal molds 490 and 495 positioned at an upward direction of the lower mold 470. This can be seen in FIG. 30.

A mold-clamping force of the upward direction mold 465 presses the inclined surfaces 492 and 497 via the inclined surfaces 466 and 467 such that the inclined surfaces 492 and 497 become closer. This drives the first and second transversal molds 490 and 495 closer to each other.

There are spaces for allowing a flow of material between the side wall portion 491 of the first transversal mold 490 and a side surface of the outer surface portion of the lower mold 470 and between the side wall portion 496 of the second transversal mold 495 and the side surface of the outer surface portion of the lower mold 470. The protrusion 415 of the blank 400 is positioned in these spaces. That is, in the course of mold-clamping, a gap formed between the side wall portion 404 and the lower mold 470 is greater than a gap formed between the connecting wall portion 406 and the lower mold 470. As such, the material of the protrusion 415 flows into a lateral direction upon being pressed-in.

At this time, the side wall portion 404 is bent by a pressing force exerted from the connecting wall portion 406 to the side wall portion 404 by pressing the side wall portion 404 with the side wall portion 491 of the first transversal mold 490 and the side wall portion 496 of the second transversal mold 495 while contacting the connecting wall portion 406 with the extension 493 of the first transversal mold 490. This can be seen in FIG. 31.

That is, a center portion of the side wall portion 404 is bent toward the lower mold side to form a curved portion by supporting the connecting wall portion 406 using the extension 493 of the first transversal mold 490 and the lower mold 470 while pressing-in the side wall portion 404 toward the lower mold side by the side wall portion 491 of the first transversal mold 490 and the side wall portion 496 of the second transversal mold 495. The corner portion 492 of the first transversal mold 490 guides the corner portion of the blank 400 to the side wall portion side.

Further, if the descent of the upward direction mold 465 continues, then the side wall portion 491 of the first transversal mold 490 and the side wall portion 496 of the second transversal mold 495 become even closer. A space generated between the side wall portions 491 and 496 of the first and second transversal molds 490 and 495 and the outer surface portion of the lower mold 470 become smaller as shown in FIG. 32. That is, the curved portion of the side wall portion 404 disappears by inserting the side wall portion 404 with the side wall portion 491 of the first transversal mold 490, the side wall portion 496 of the second transversal mold 495 and the lower mold 470. Then, the side wall portion 404 is bent while compressing the connecting wall portion 406 from both sides of the connecting wall portion 406 along the length direction using the side wall portion 491 of the first transversal mold 490 and the side wall portion 496 of the second transversal mold 495. This increases the plate thicknesses at both sides of the side wall portion 404 and connecting wall portion 406. As such, the press-molded product comprising a partial thickness increase portion can be obtained.

Since the protrusion 415 is arranged at the side wall portion 404, the thickness of the side wall portion of the press-molded product is effectively increased. Further, the cross-sectional thickness of the cavity at the time of mold-clamping between the extension 493 of the first transversal mold 490 and the connecting wall portion 406 of the blank 400 is established so as to allow the material flow. Thus, the material of the protrusion 415 smoothly flows in, thereby effectively increasing the thickness of the connecting wall portion of the press-molded product.

As described above, according to the fourth embodiment, it is possible to enhance the reduction of the weight and manufacturing costs of the press-molded product as in the first embodiment. Further, since the peripheral length extending region of the fourth embodiment is constituted by the protrusion arranged at the connecting wall portion of the blank, it is possible to effectively increase the thickness of the connecting wall portion of the press-molded product.

Also, it is possible to arrange the protrusion at an end surface or only at one side surface of the blank. Moreover, it is possible to arrange a plurality of protrusions along the length direction of the blank by a gap. In such a case, the press-molded product has the partial thickness increase portion arranged at the length direction of the press-molded product by a gap.

The partial thickness increase portion of the press-molded product can take up a part of the peripheral region by adjusting the shape of the protrusion or cross-sectional thickness of the cavity at the time of mold-clamping, particularly when a local region requiring the rigidity or strength is small. For example, it is possible to effectively achieve the reduction of the weight of the press-molded product by allowing the protrusion to be smaller and forming the partial thickness increase portion in a part of the connecting wall portion of the press-molded product as in the first to third modifications of the first embodiment.

Next, a fifth embodiment of the invention is initially explained with reference to FIGS. 33-35.

The fifth embodiment generally differs from the first embodiment in terms of the application of a blank 500 formed of a plate-shaped plate material that is not preformed.

Figure 33:
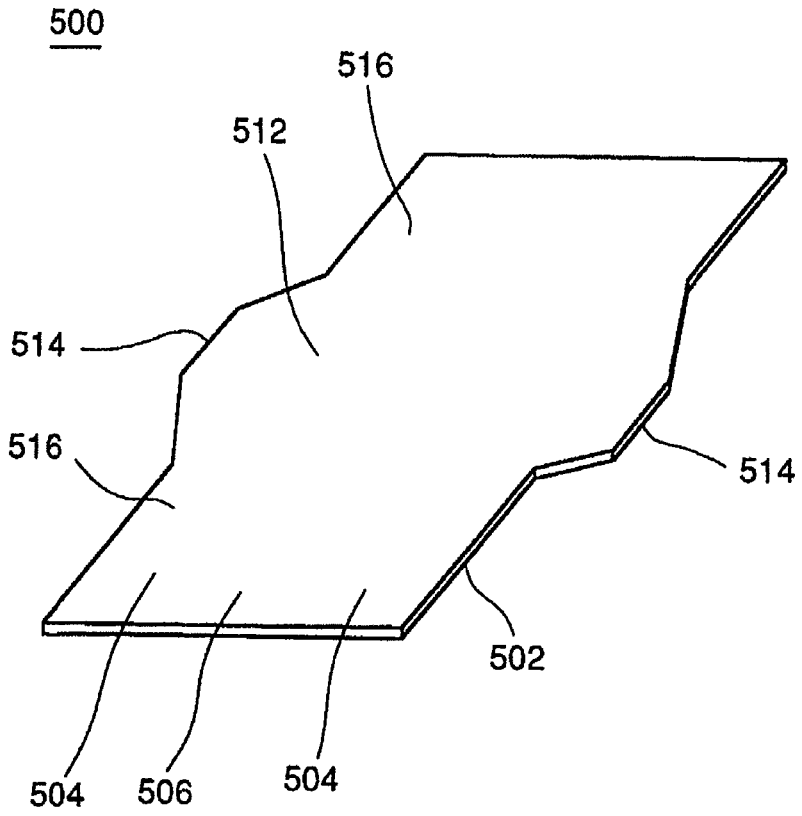
FIG. 33 is a perspective view showing a blank constructed in accordance with a fifth embodiment.
Figure 35:
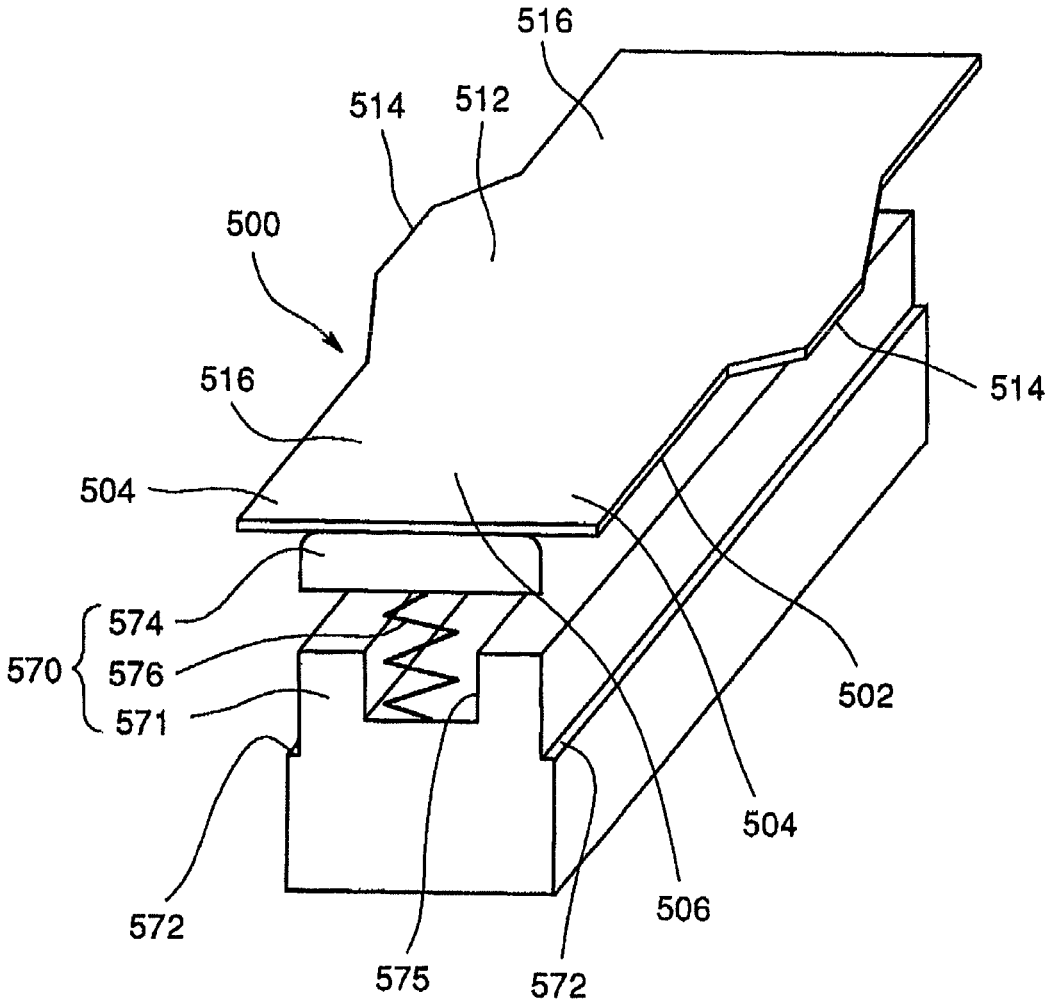
FIG. 35 is a cross-sectional view showing a lower mold shown in FIG. 34.

As seen in FIGS. 33 and 35, the blank 500 comprises a central extension 506 and a lateral extension 504 positioned at a lateral direction on each side of the central extension 506. The central extension 506 corresponds to the connecting wall portion of the press-molded product. The lateral extension 504 corresponds to the side wall portion of the press-molded product. Further, the blank 500 comprises a thickness increase prearranged portion 512 and a thickness non-increase prearranged portion 516 corresponding to the partial thickness increase portion and thickness non-increase portion of the press-molded product. A peripheral region including the thickness increase prearranged portion 512 comprises an extension 514 arranged at an edge portion 502. A length of a cross-sectional periphery of the peripheral region is longer than a length of a cross-sectional periphery of the peripheral region including the partial thickness increase portion of the press-molded product.

Figure 34:
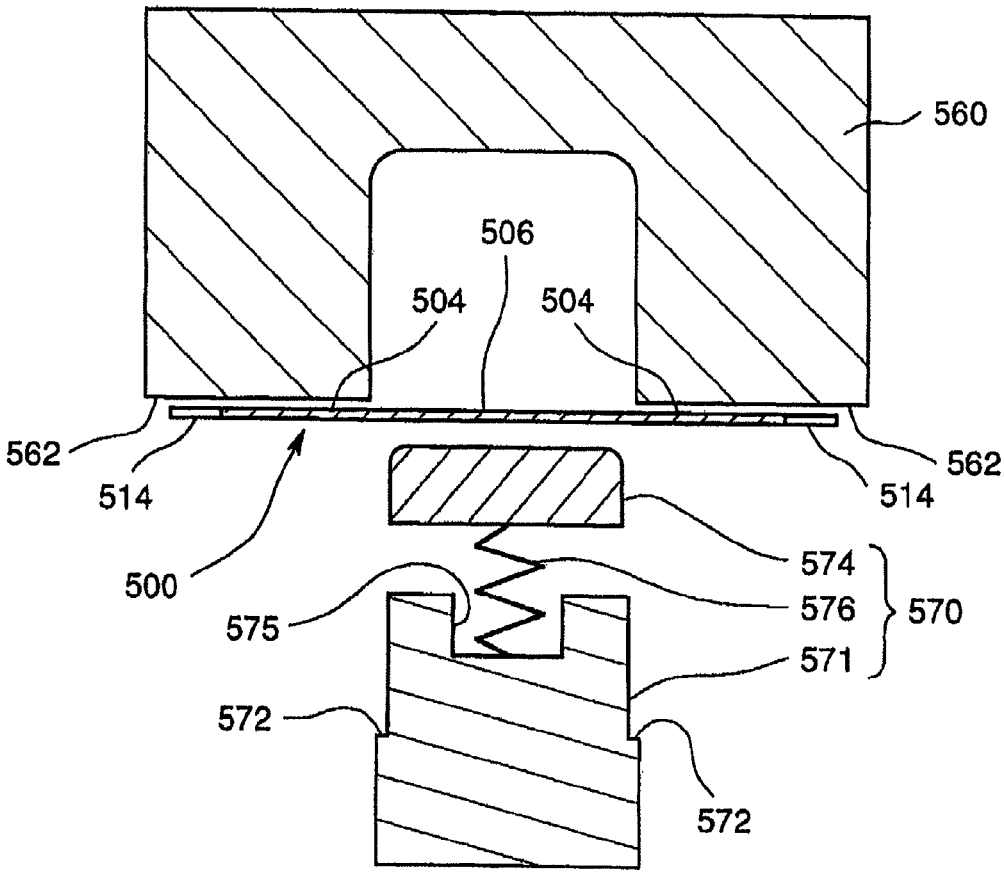
FIG. 34 is a cross-sectional view showing an apparatus for manufacturing a press-molded product constructed in accordance with the fifth embodiment.

As seen in FIG. 34, a press-mold includes a preforming function of the blank 500 and comprises an upper mold 560, a lower mold 570 and a lateral mold (not shown).

The lower mold 570 comprises a lower mold base portion 571, a divided mold 574 and a spring mechanism 576. The lower mold base portion 571 comprises a step portion 572 extended along a lateral direction and a concave portion 575 for receiving the spring mechanism 576.

At the time of mold-clamping, the divided mold 574 contacts the central extension 506 of the blank 500 and pressed-in against an inner surface portion of the upper mold 560, thereby molding the blank 500. By doing so, corresponding to the shape of the press-molded product, the blank 500 comprises an edge portion, a side wall portion extended from the edge portion and a connecting wall portion for connecting the side wall portion. Further, since the extension 514 of the preformed blank 500 is contacted and pressed-in, the step portion 572 generates a material flow that causes an increase of a plate thickness.

The spring mechanism 576 is arranged at the concave portion 575 of the lower mold base portion 571 positioned at a downward direction of the divided mold 574, thereby pressing the divided mold 574 upwardly. A pressing force of the divided mold 574 is weaker than a mold-clamping force.

Next, a method of manufacturing a press-molded product constructed in accordance with the fifth embodiment is explained with reference to FIGS. 36-40.

In the press-molding process according the present manufacturing method, the blank 500 is arranged between the upper mold 560 and the lower mold 570. The central extension 506 of the blank 500 contacts the divided mold 574 of the lower mold 570 as shown in FIGS. 34 and 35.

Figure 36:
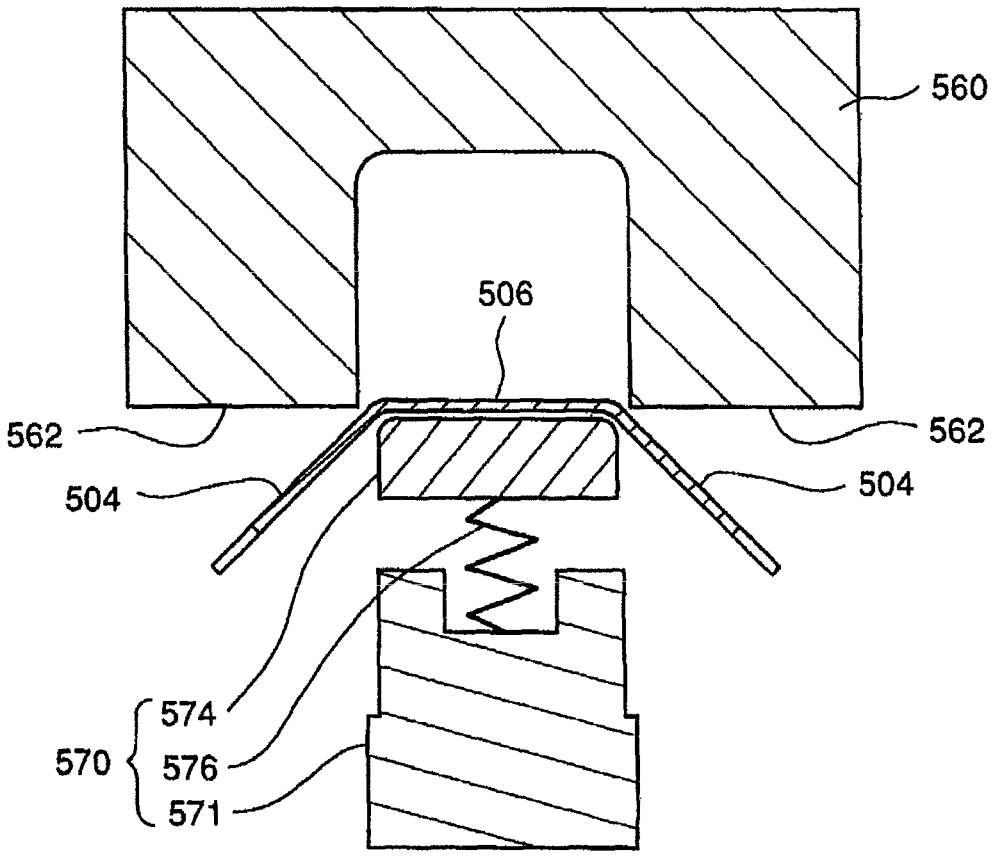
FIG. 36 is a cross-sectional view showing a method of manufacturing the press-molded product constructed in accordance with the fifth embodiment and illustrating a start of a preforming procedure.

In order to press-mold by mold-clamping, when the upper mold 560 descends toward the lower mold 570, then an end surface 562 of the upper mold 560 contacts the lateral extension 504 of the blank 500. A mold-clamping force of the upper mold 560 presses the lateral extension 504 of the blank 504 downwardly, thereby deforming the lateral extension 504 as shown in FIG. 36.

Figure 37:
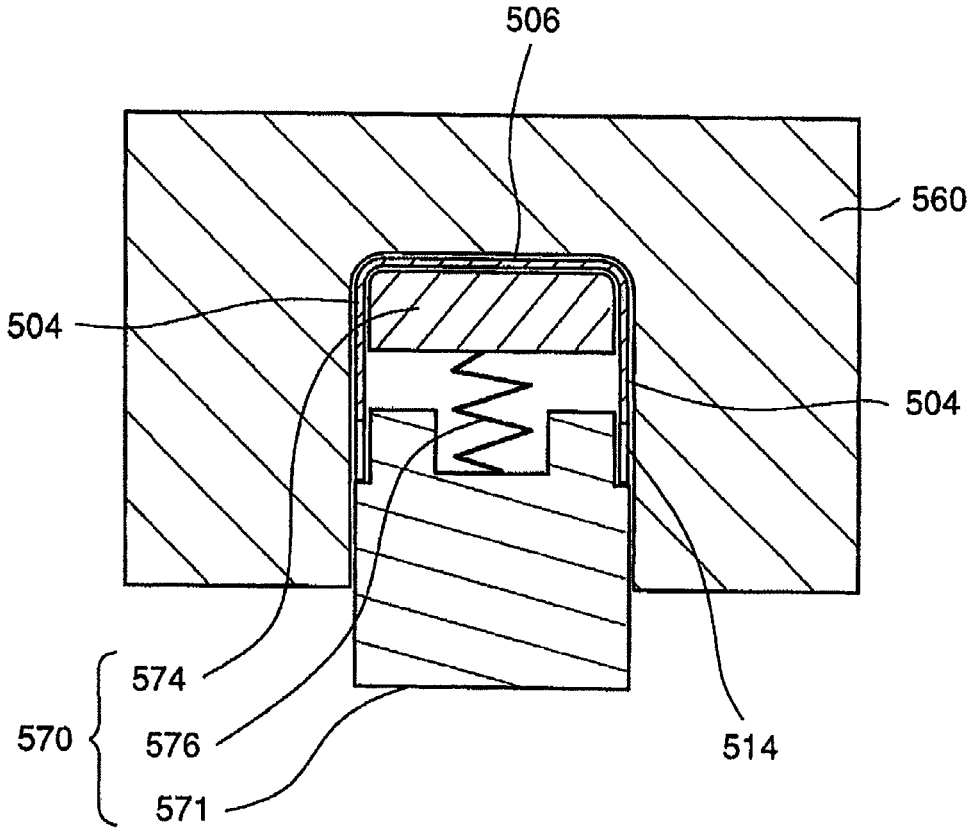
FIG. 37 is a cross-sectional view showing a completion of the preforming procedure subsequent to FIG. 36.
Figure 38:
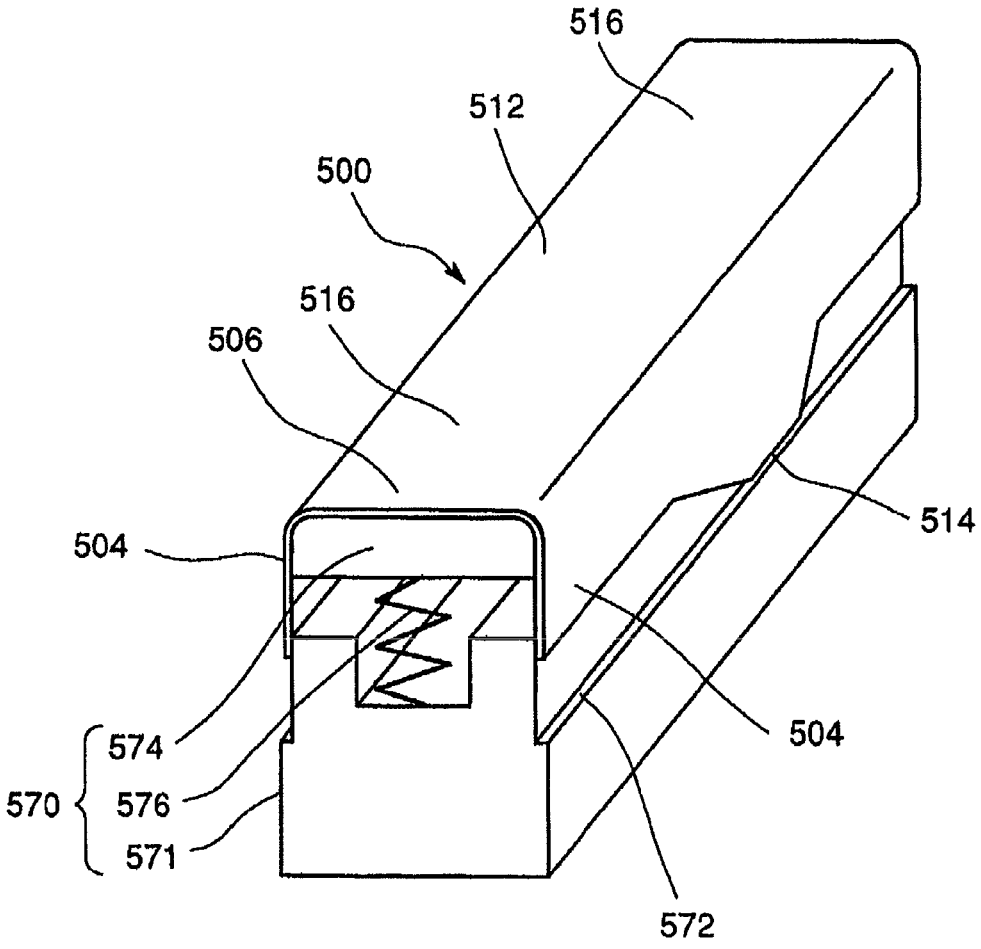
FIG. 38 is a perspective view showing the blank shown in FIG. 37.

As the descent of the upper mold 560 continues, the blank 500 is preformed as a shape, in this case a hat-shaped cross-section, according to an outer surface portion of the lower mold 570 as shown in FIGS. 37 and 38. By doing so, the blank 500 comprises the edge portion, the side wall portion extended from the edge portion and the connecting wall portion for connecting the connecting wall portion similar to other embodiments. Further, the extension 514 contacts the step portion 572 of the lower mold base portion 571.

Figure 39:
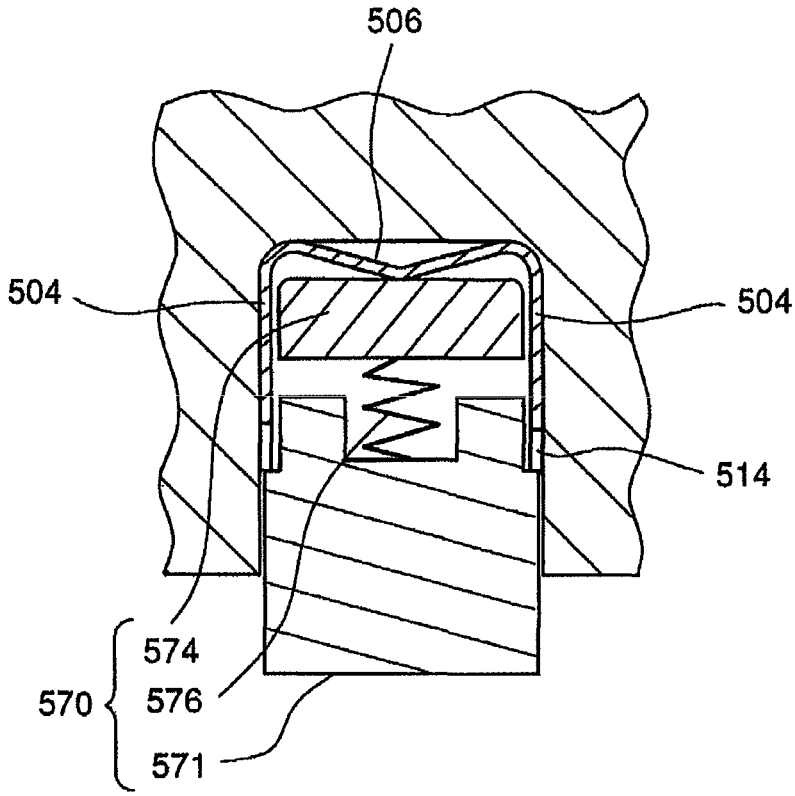
FIG. 39 is a cross-sectional view showing a procedure of forming a partial thickness increase portion subsequent to FIG. 37.
Figure 40:
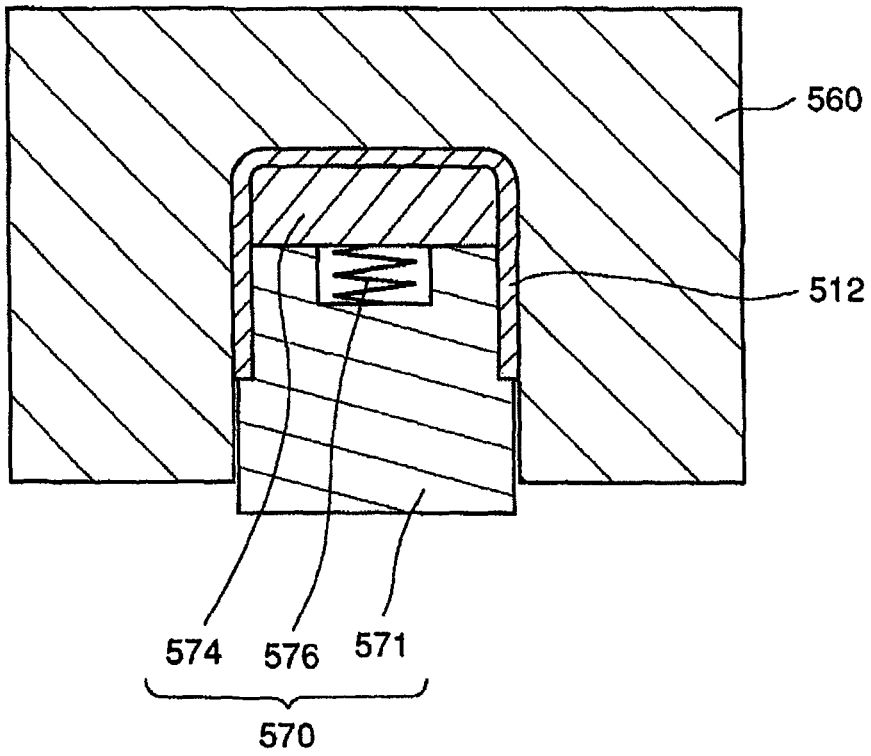
FIG. 40 is a cross-sectional view showing a completion of the procedure of forming the partial thickness increase portion subsequent to FIG. 39.

When the descent of the upper mold 560 further continues, since the mold-clamping force of the upper mold 560 presses the extension 514 of the blank 500 toward the step portion 572 of the lower mold base portion 571, the extension 514 is deformed. A material of the extension 514 flows upwardly to thereby be pressed-in as shown in FIGS. 39 and 40. Since the extension 514 is positioned at the edge portion of the peripheral region including the thickness increase prearranged portion 512 and a cross-sectional thickness of a cavity at the time of mold-clamping in consideration of the thickness increase by the material flow is established, the material flow of the extension 514 causes an increase of the plate thickness of the thickness increase prearranged portion 512. Further, since the pressing force of the divided mold 574 is weaker than the mold-clamping force and reduced as the extension 514 is deformed, the pressing force of the divided mold 574 does not affect the deformation of the extension 514.

As described above, according to the fifth embodiment, the preforming process, the bending process and the thickness increasing process are sequentially performed in an orderly manner by mold-clamping one time through arrangement of the plate-shaped blank 500 between the upper mold 560 and the lower mold 570 to thereby be mold-clamped. A preform with a hat-shaped cross-section is molded from the plate-shaped blank 500 in the preforming process. Thus, it is possible to enhance the reduction of manufacturing costs by improving productivity.

Figure 41:
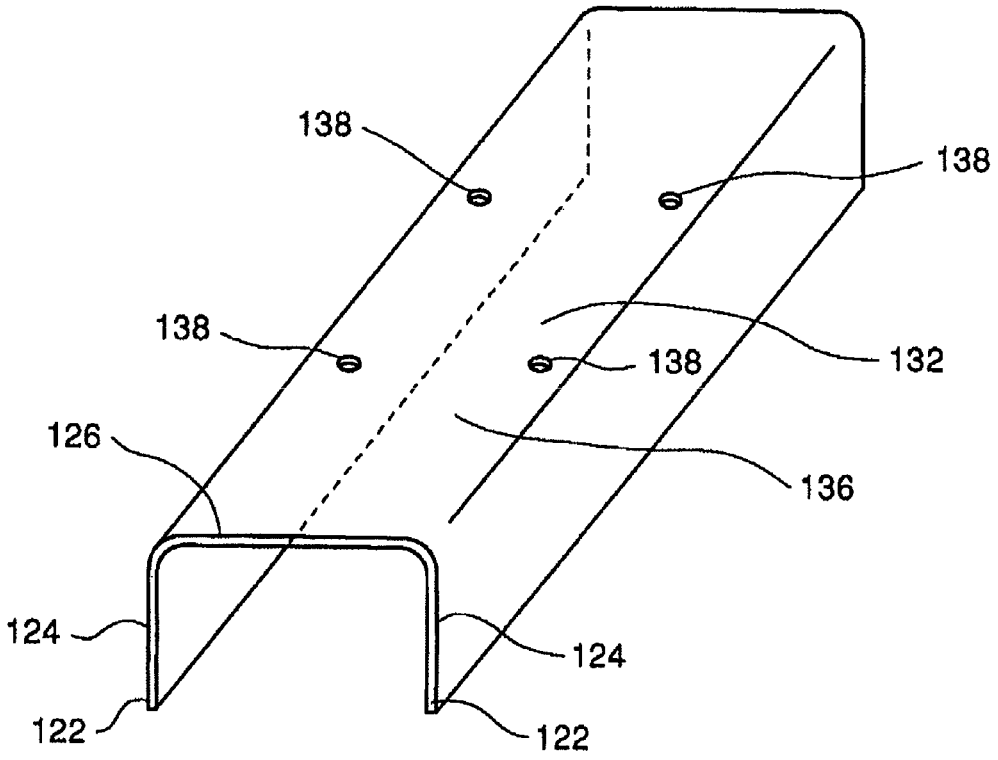
FIG. 41 is a perspective view showing a press-molded product constructed in accordance with a sixth embodiment.
Figure 42:
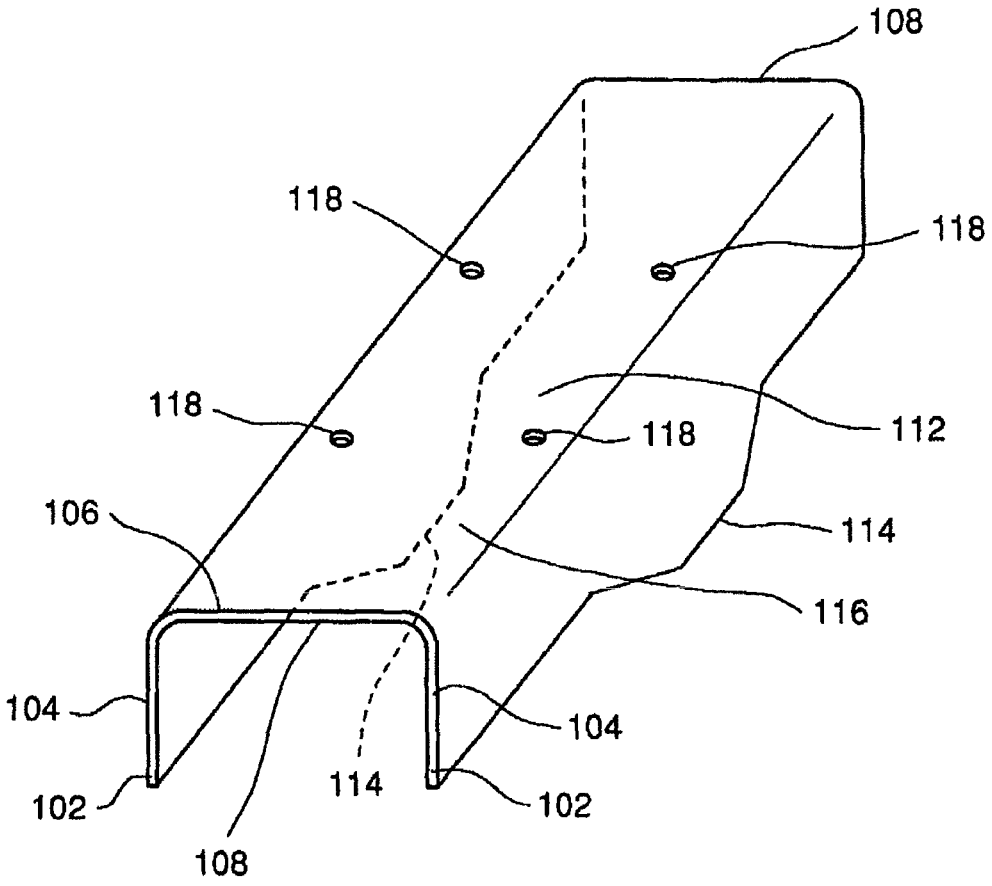
FIG. 42 is a perspective view showing a blank constructed in accordance with the sixth embodiment.
Figure 43:
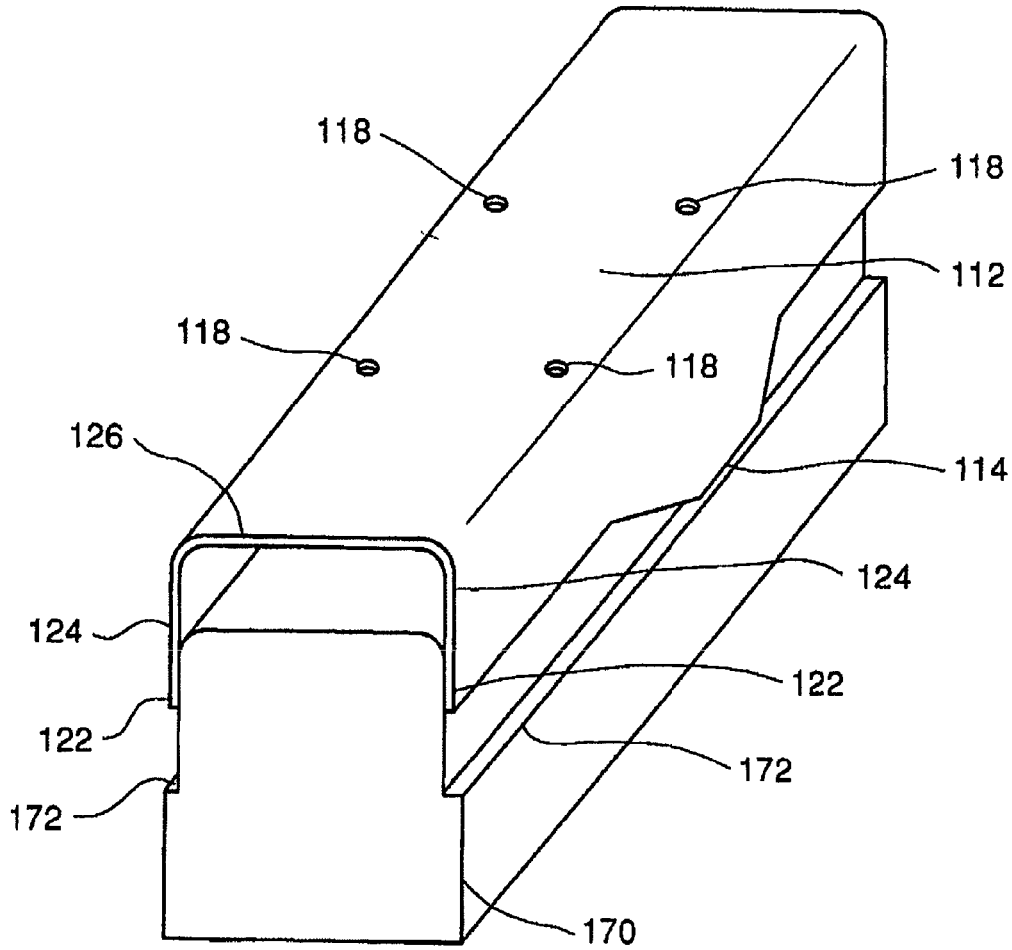
FIG. 43 is a perspective view showing a lower mold constructed in accordance with the sixth embodiment.

Next, a sixth embodiment of the invention is discussed with respect to FIGS. 41-43.

The sixth embodiment relates to a constitution of the connecting wall portion that generally differs from the first embodiment. The connecting wall portion 126 of the press-molded product constructed in accordance with the sixth embodiment comprises though holes 138 arranged at edge portions of the partial thickness increase portion 132 as seen in FIG. 41, while the connecting wall portion 106 of the blank comprises through holes 118 arranged at edge portions of the thickness increase prearranged portion 112 as seen in FIG. 42.

The through holes 118 of the blank correspond to the through holes 138 of the press-molded product and retard a transfer of the compression stress. The through hole 118 performs the function of restraining a flow of a material into a peripheral portion wherein the material causes an increase of the cross-sectional thickness. The through hole 118 performs the function of improving the efficiency of a thickness increase of the partial thickness increasing portion 132.

In order to avoid the stress concentration at the time of press-molding, a shape of the through hole 118 can be circular in shape but is not specifically limited to the circular shape. Further, when considering productivity and costs, the extension 114 and through hole 118 can be formed by a punching operation when the blank is molded by rolling material. However, it is also possible to separately form the extension 114 and through hole 118 by a mechanical process. The blank is not limited to being formed of the rolling material but a casting product, for example, may be applied thereto.

The blank constructed in accordance with the sixth embodiment is substantially the same as the blank constructed in accordance with the first embodiment with the exception of the through hole 118. Thus, it is possible to manufacture the press-molded product constructed in accordance with the sixth embodiment by applying the apparatus and method for manufacturing the press-molded product constructed in accordance with the first embodiment as shown in part in FIG. 43. As such, explanations of the apparatus and method for manufacturing the press-molded product constructed in accordance with the sixth embodiment are omitted to avoid any repetition.

As described above, according to the sixth embodiment, since the flow of the material that causes the increase of the cross-sectional thickness into the peripheral portion is restrained by the through hole, the thickness increase efficiency obtained is comparable to that of the first embodiment. Further, since the through hole is arranged at the connecting wall portion of the blank, it is possible to effectively increase the thickness of the connecting wall portion of the press-molded product. Also, since the peripheral length extending region is constituted by the extension arranged at the edge portion of the side wall portion of the blank, it is possible to effectively increase the thickness of the side wall portion of the press-molded product.

It is possible to arrange the through hole at the side wall portion or at both sides of the connecting wall portion and the side wall portion. Further, the through hole can also be arranged at a fixing surface of the partial thickness increase portion with other components. In such a case, since the other component serves as a reinforcing material, it is possible to restrain the effect of the through hole to the rigidity of the press-molded product. It is also possible to arrange the through hole at the edge portion of the side wall portion of the blank or at the edge portion in one side. Appropriately establishing a size and number of through holes can depend on the side and shape of the thickness increase prearranged portion of the blank and the partial thickness increase portion of the press-molded product.

Figure 44:
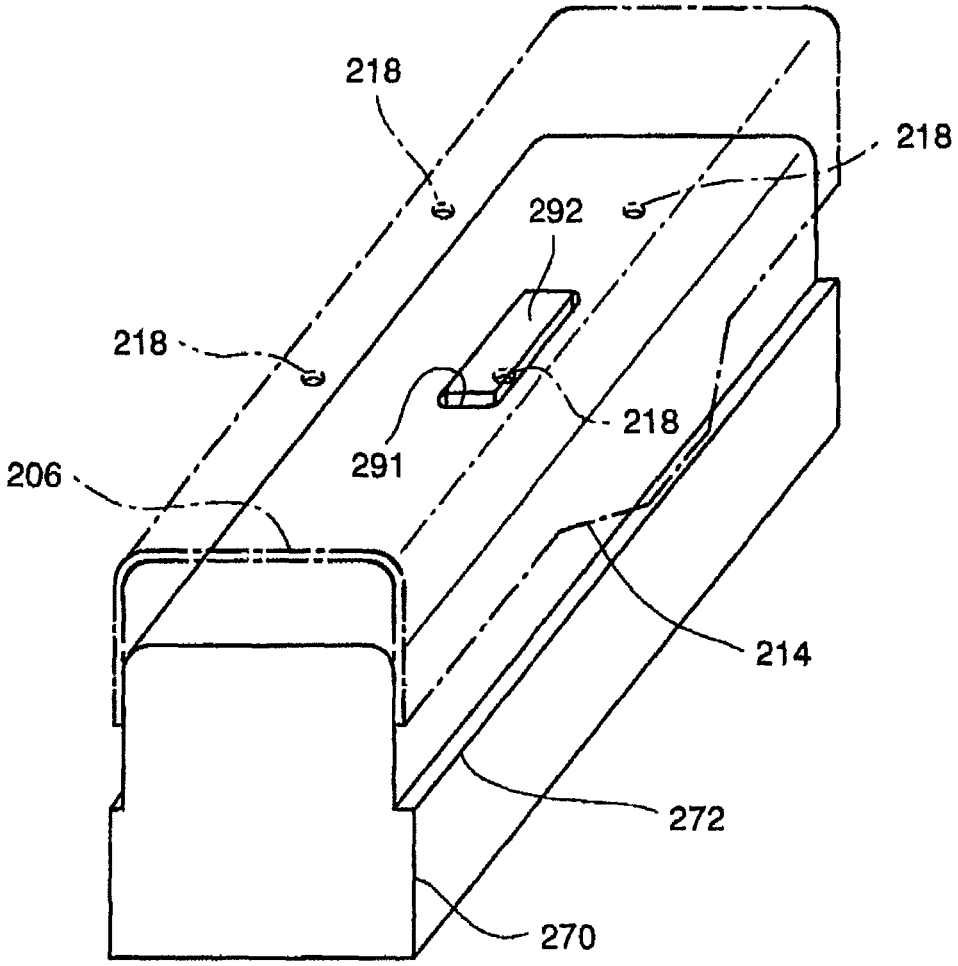
FIG. 44 is a perspective view showing a lower mold constructed in accordance with a seventh embodiment.

Next, a seventh embodiment of the invention is explained with reference to FIG. 44.

The seventh embodiment relates to an apparatus and method for manufacturing a press-molded product. The seventh embodiment generally follows the sixth embodiment but comprises the restraining mechanism for restraining the bending degree of the connecting wall portion 206 of the blank arranged at the lower mold 270. Since the apparatus and method for manufacturing the press-molded product constructed in accordance with the second embodiment are applied to the seventh embodiment, explanations thereof are omitted herein to avoid repetition.

As described above, according to the seventh embodiment, even when the pressing-in ratio is large, it is possible to restrain a buckling of the blank by supporting the connecting wall portion 206 of the blank comprising the through hole 218 by the pad portion 292 and restraining the bending degree thereof. Further, compared to the sixth embodiment, it is possible to further enhance the thickness increase of the partial thickness increase portion of the press-molded product.

Figure 45:
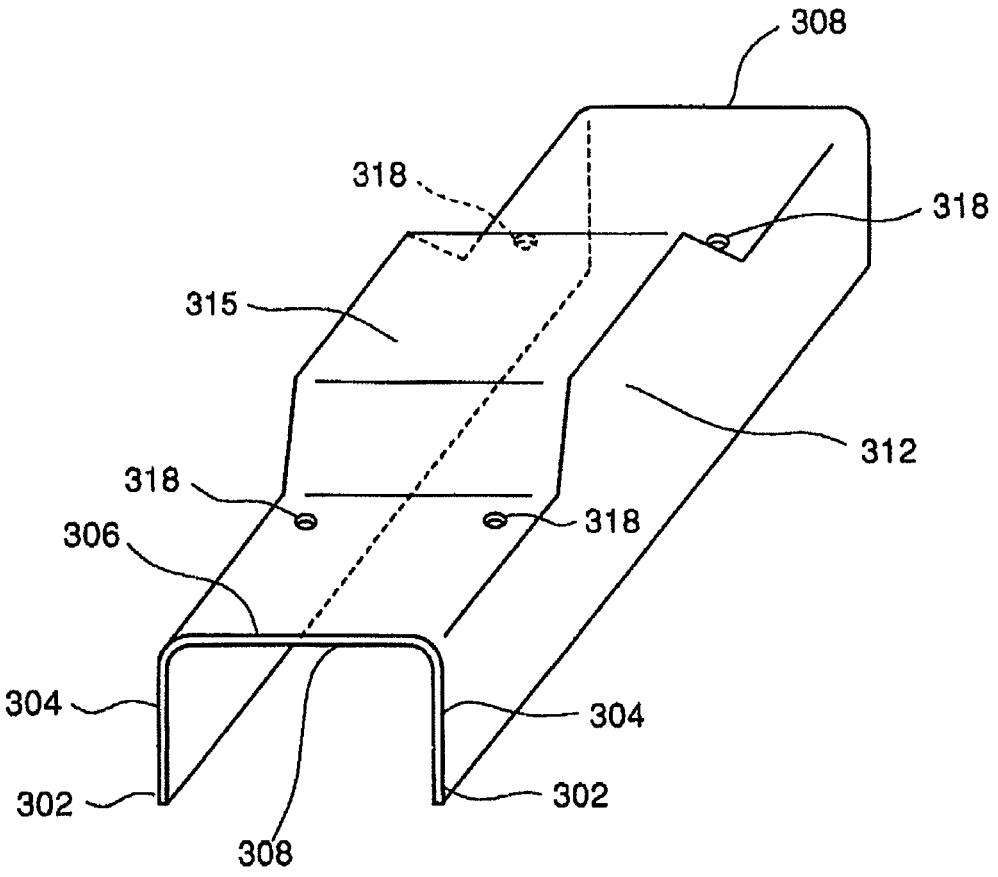
FIG. 45 is a perspective view showing a blank constructed in accordance with an eighth embodiment.
Figure 46:
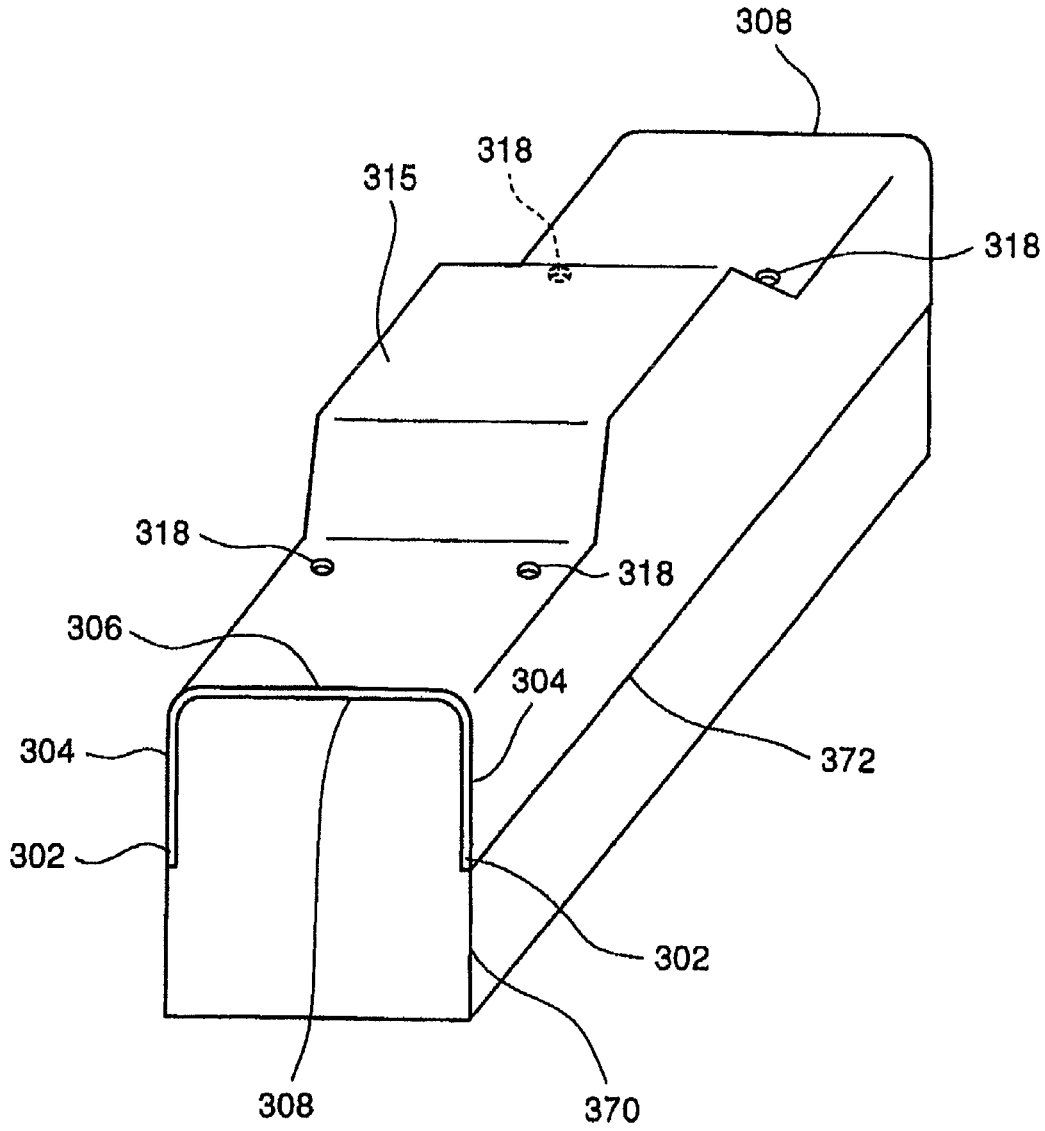
FIG. 46 is a perspective view showing a lower mold constructed in accordance with the eighth embodiment.

Next, an eighth embodiment of the invention is explained with reference to FIGS. 45-47.

The eighth embodiment relates to a constitution of the connecting wall portion of the blank that generally differs from the sixth embodiment. The connecting wall portion 306 of the blank constructed in accordance with the eighth embodiment includes a protrusion 315 similar to the blank 300 constructed in accordance with the third embodiment as seen in FIGS. 45 and 46. Further, through holes 318 are adjacent to the protrusion 315 and positioned at the edge portion of the thickness increase prearranged portion 312 of the connecting wall portion 306. The through holes 318 restrain the flow from the thickness increase prearranged portion 312 to the thickness non-increase prearranged portion by retarding the transfer of the compression stress. This effectively improves the thickness increase efficiency of the connecting wall portion 306 of the press-molded product.

Figure 47:
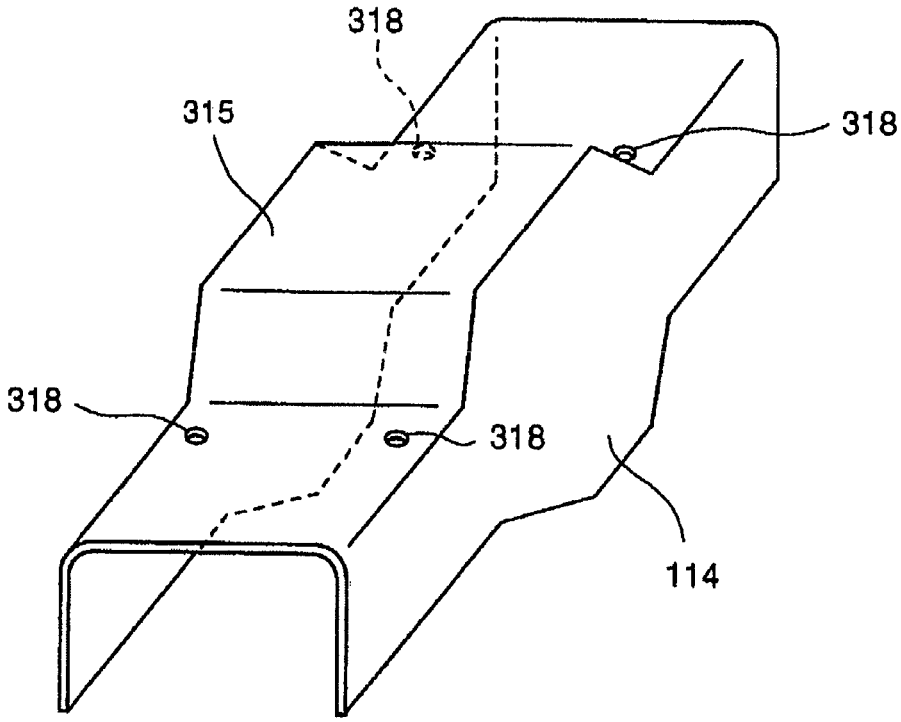
FIG. 47 is a perspective view showing a modification of the eighth embodiment.

As shown in FIG. 47, the protrusion 315 is not exclusive to the extension 114 of the sixth embodiment. For example, it is possible to constitute the peripheral length extending region by the protrusion 315 and the extension 114. In such a case, it is possible to effectively increase the thicknesses of the connecting wall portion 306 and side wall portion 304 of the press-molded product.

Further, since the apparatus and method for manufacturing the press-molded product constructed in accordance with the third embodiment are applied to the eighth embodiment, explanations thereof are omitted herein to avoid repetition.

As described above, according to the eighth embodiment, it is possible to enhance the reduction of weight and manufacturing costs of the press-molded product as in the sixth embodiment. Further, since the peripheral length extending region of the eighth embodiment is constituted by the protrusion 315 arranged at the connecting wall portion 306 of the blank, it is possible to effectively increase the thickness of the connecting wall portion 306 of the press-molded product.

Figure 48:
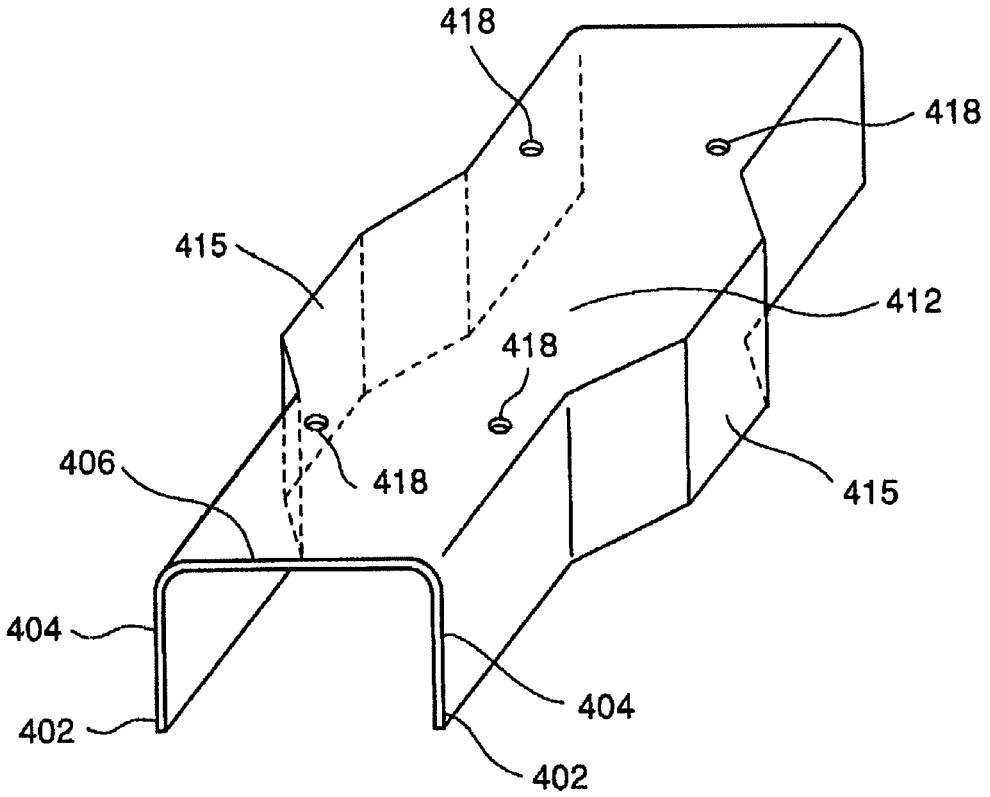
FIG. 48 is a perspective view showing a blank constructed in accordance with a ninth embodiment.

Next, a ninth embodiment of the invention is explained with reference to FIG. 48.

The ninth embodiment relates to a constitution of the protrusion of the blanks that differs in part from the eighth embodiment. The protrusion 415 of the blank constructed in accordance with the ninth embodiment is arranged at each side wall portion 404 similarly to the blank 400 constructed in accordance with the fourth embodiment. Further, through holes 418 are positioned at the edge portion of the thickness increase prearranged portion 412 of the connecting wall portion 406. The through holes 418 restrain the flow from the thickness increase prearranged portion 412 to the thickness non-increase prearranged portion by retarding the transfer of the compression stress. This effectively improves the thickness increase efficiency of the connecting wall portion of the press-molded product.

Further, since the apparatus and method for manufacturing the press-molded product constructed in accordance with the fourth embodiment are applied to the ninth embodiment, explanations thereof are omitted herein to avoid repetition.

As described above, according to the ninth embodiment, it is possible to enhance the reduction of weight and manufacturing costs of the press-molded product as in the sixth embodiment. Further, since the peripheral length extending region of the ninth embodiment is constituted by the protrusion arranged at the connecting wall portion of the blank, it is possible to effectively increase the thickness of the connecting wall portion of the press-molded product.

Figure 49:
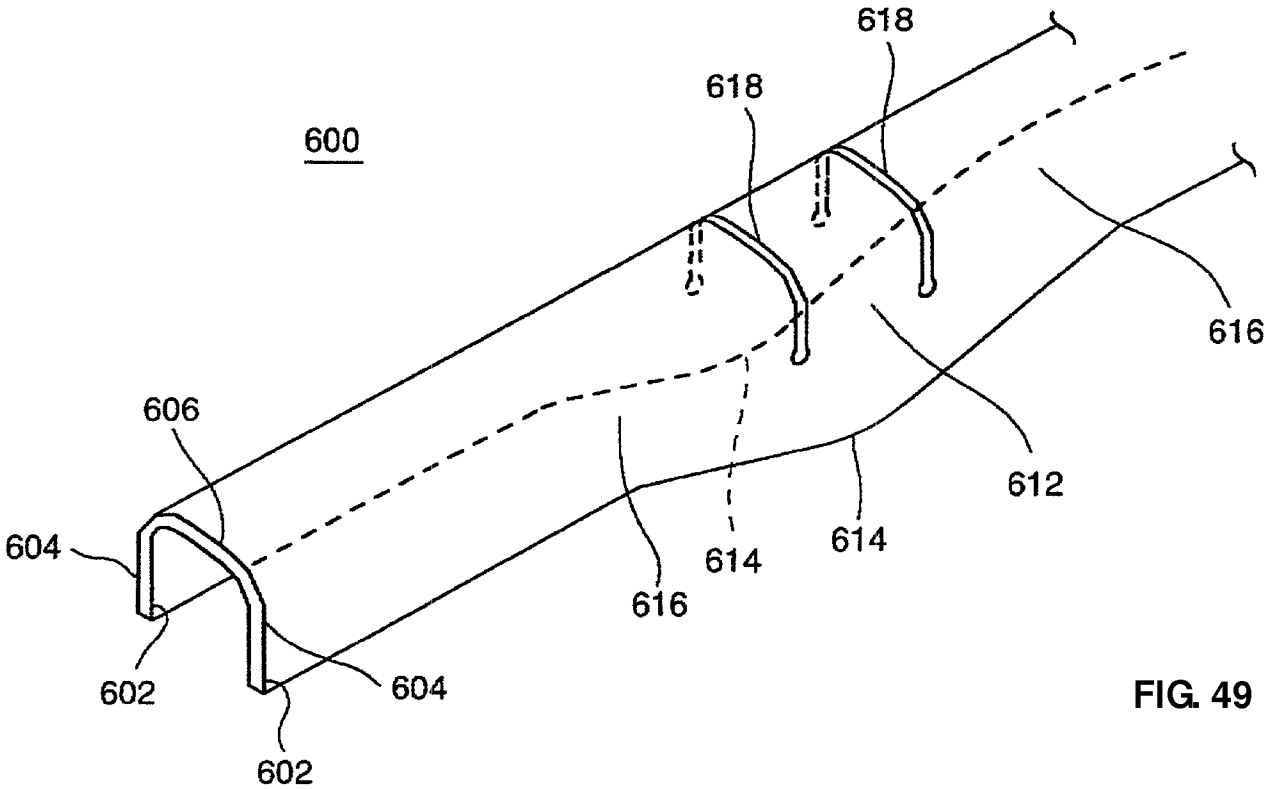
FIG. 49 is a perspective view showing a slit provided in a blank constructed in accordance with a tenth embodiment.
Figure 50:
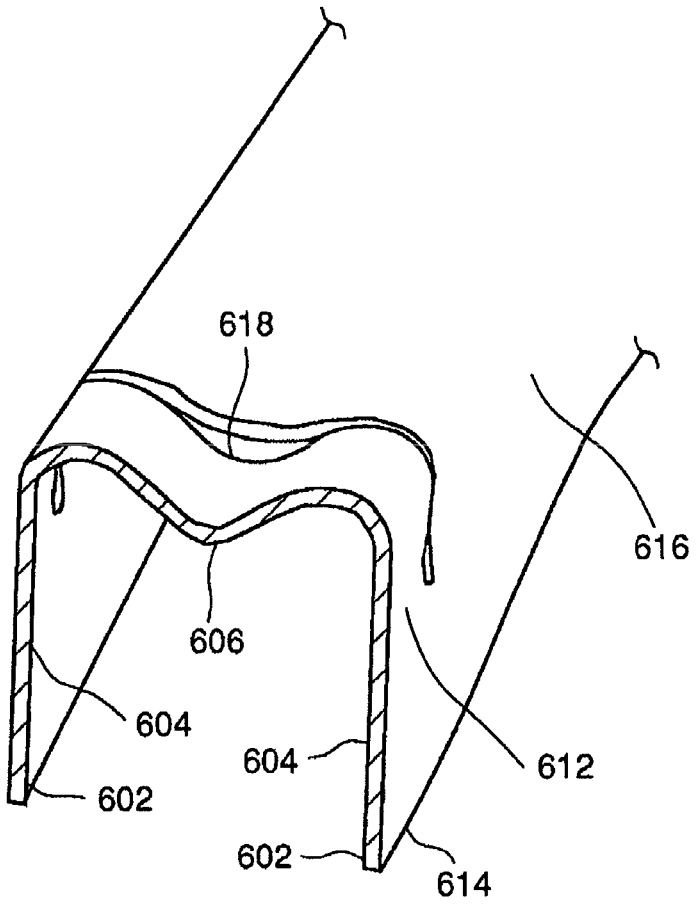
FIG. 50 is a perspective view showing a press-molding process in accordance with the tenth embodiment.

Next, a tenth embodiment of the invention is explained with reference to FIGS. 49 and 50.

The tenth embodiment differs from the sixth embodiment in that the structure that performs a function of restraining the flow of the material is constituted by at least one slit 618, whereas the structure that performs the function of restraining is constituted by the through hole 118 in the sixth embodiment. Further, since the apparatus for manufacturing the press-molded product constructed in accordance with the tenth embodiment is substantially the same as that in accordance with the sixth embodiment, explanations thereof are not repeated herein.

Since the slit 618 is arranged at an edge portion of a thickness increase prearranged portion 612 of a blank 600 to thereby extend a side wall portion 604 and a connecting wall portion 606, it is possible to retard the transfer of the compression stress via the side wall portion 604 and connecting wall portion 606. An extension 614 is arranged at an edge portion 602 of a peripheral region including a thickness increase prearranged portion 612, wherein the extension 614 constitutes a peripheral length extending region. A length of a cross-sectional periphery of the peripheral region including the thickness increase prearranged portion 612 is longer than a length of a cross-sectional periphery of a peripheral region including a thickness non-increase prearranged portion 616.

Thus, in a press-molding process, since the extension 614 of the blank 600 is pressed toward a step portion of a lower mold, the extension 614 is deformed and a material thereof flows upwardly. At this time, since the extension 614 is positioned at the edge portion 602 of the peripheral region including the thickness increase prearranged portion 612 and a cross-sectional thickness of a cavity at the time of mold-clamping in consideration of the thickness increase caused by the material flow is established, the material flow of the extension 614 causes an increase of a cross-sectional thickness of the thickness increase prearranged portion 612.

Further, the slit 618 is positioned at the edge portion of the thickness increase prearranged portion 612. The slit 618 retards the transfer of the compression stress, thereby restraining the flow from the thickness increase prearranged portion 612 to the thickness non-increase prearranged portion 616 as shown in FIG. 50. Since the slit 618 extends the side wall portion 604 and connecting wall portion 606, the material flow via the connecting wall portion 604 in addition to the material flow via the connecting wall portion 606 are restrained. That is, the material dispersed via the side wall portion 604 flows into the connecting wall portion 606. Thus, it is possible to further improve the effect of thickness increase of the connecting wall portion of the press-molded product.

As described above, according to the tenth embodiment, since the slit is arranged at the side wall portion and connecting wall portion, the material flow via the side wall portion in addition to the material flow via the connecting wall portion are restrained. In this regard, compared to the sixth embodiment, it is possible to improve the effect of thickness increase of the connecting wall portion of the press-molded product.

Further, when the blank is molded with the rolling material, the slit 618 can be formed by a punching operation. However, it is possible to separately form the slit 618 by a mechanical operation. Appropriately establishing a width and length of the slit depends on the sizes and shapes of the thickness increase prearranged portion of the blank and the partial thickness increase portion of the press-molded product.

The slit can be arranged to be positioned at a fixing surface of the partial thickness increase portion with another component. In such a case, since the other component serves as a reinforcing material, it is possible to restrain an effect of the slit to the rigidity of the press-molded product. It is possible to secure the rigidity by bonding the slit via a welding operation. Further, it is also possible to arrange the slit at one of the side wall portion and connecting wall portion or at one side of the side wall portion.

Figure 51:
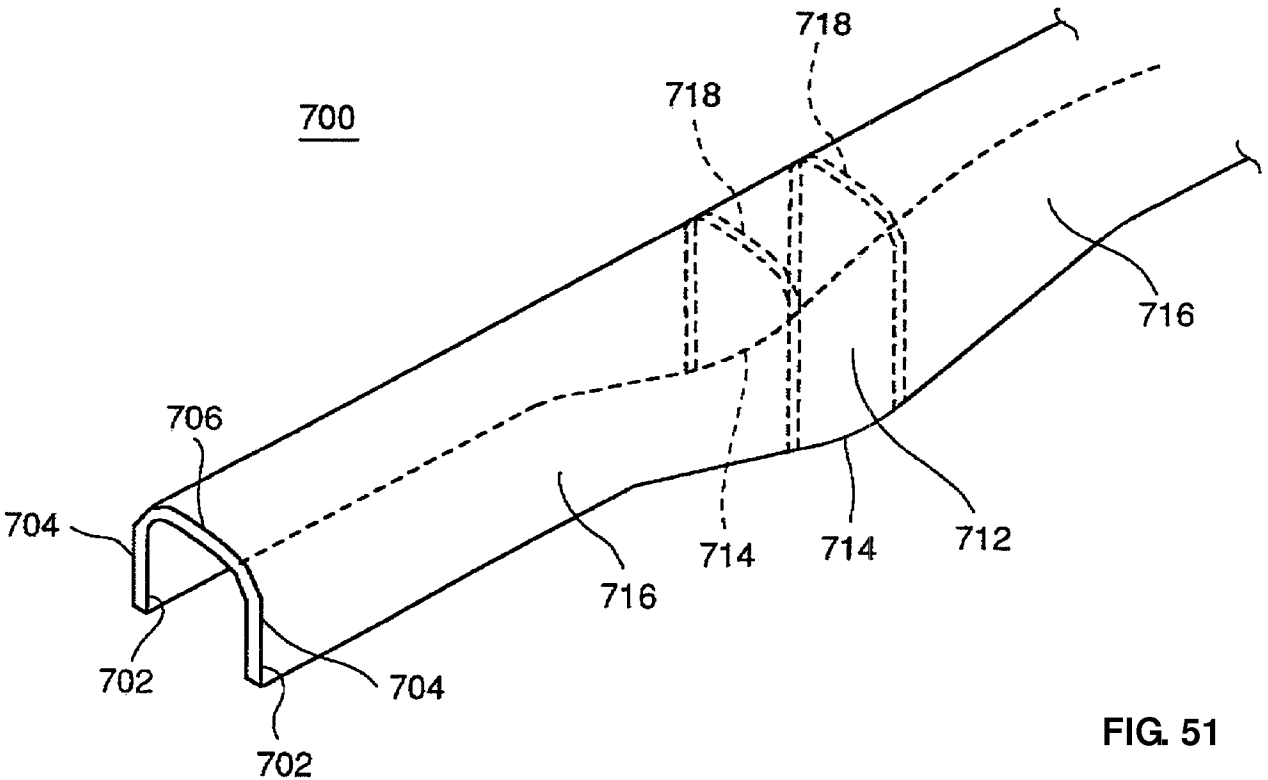
FIG. 51 is a perspective view showing a blank constructed in accordance with an eleventh embodiment.
Figure 52:
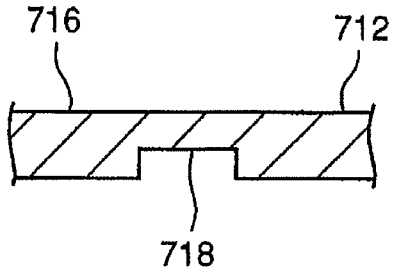
FIG. 52 is a cross-sectional view showing a concave portion shown in FIG. 51.

Next, an eleventh embodiment of the invention is explained with reference to FIGS. 51 and 52.

The eleventh embodiment differs from the tenth embodiment in that the structure that performs the function of restraining the flow of the material is constituted by a concave portion 718, in contrast to the slit 618 in the tenth embodiment. Further, since the apparatus for manufacturing the press-molded product constructed in accordance with the eleventh embodiment is approximately the same as that used in accordance with the sixth embodiment, explanations thereof are not repeated herein.

The concave portion 718 is formed of a thin wall portion arranged at an inner surface of an edge portion of a thickness increase prearranged portion 712 of a blank 700, and the concave portion 718 extends a side wall portion 704 and a connecting wall portion 706. Thus, it is possible to retard the transfer of the compression stress via the side wall portion 704 and connecting wall portion 706. Compared to the slit 618, the concave portion 718 has a reduced effect on rigidity. An extension 714 is arranged at an edge portion 702 of a peripheral region including the thickness increase prearranged portion 712 wherein the extension 714 constitutes a peripheral length extending region. A length of a cross-sectional periphery of the peripheral region including the thickness increase prearranged portion 712 is longer than a length of a cross-sectional periphery of a peripheral region including a thickness non-increase prearranged portion 716.

Thus, in the press-molding process, since the extension 714 of the blank 700 is pressed toward the step portion of a lower mold, the extension 714 is deformed and a material thereof flows upwardly. Since the extension 714 is positioned at the edge portion 702 of the peripheral region including the thickness increase prearranged portion 712, and a cross-sectional thickness of a cavity at the time of mold-clamping in consideration of the thickness increase caused by the material flow is established, the material flow of the extension 714 causes an increase in the cross-sectional thickness of the thickness increase prearranged portion 712.

Further, the concave portion 718 is positioned at the edge portion of the thickness increase prearranged portion 712. The concave portion 718 retards the transfer of the compression stress, thereby restraining the flow from the thickness increase prearranged portion 712 to the thickness non-increase prearranged portion 716. Since the concave portion 718 extends the side wall portion 704 and connecting wall portion 706, the material flow via the connecting wall portion 704 in addition to the material flow via the connecting wall portion 706 are restrained.

That is, since the material dispersed via the side wall portion 704 flows in the connecting wall portion 706, it is possible to further improve the effect of thickness increase of the connecting wall portion of the press-molded product. Further, since the concave portion 718 is reduced by the material flow from the connecting wall portion 706, a concave portion 738 remaining in a partial thickness increase portion 732 of the press-molded product becomes smaller than the concave portion 718 of the blank 700.

Figure 53:
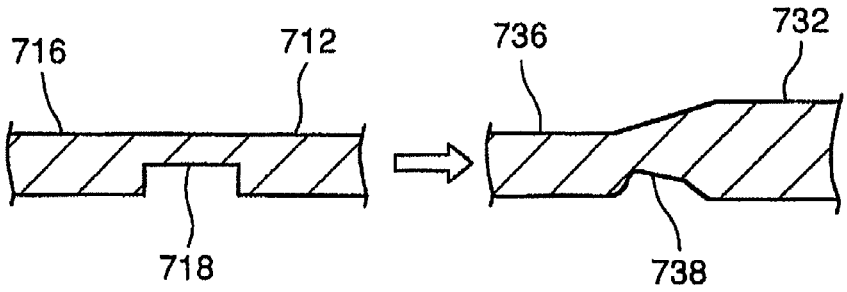
FIG. 53 is a cross-sectional view showing a first modification of the eleventh embodiment and illustrating the concave portion before and after press-molding.
Figure 54:
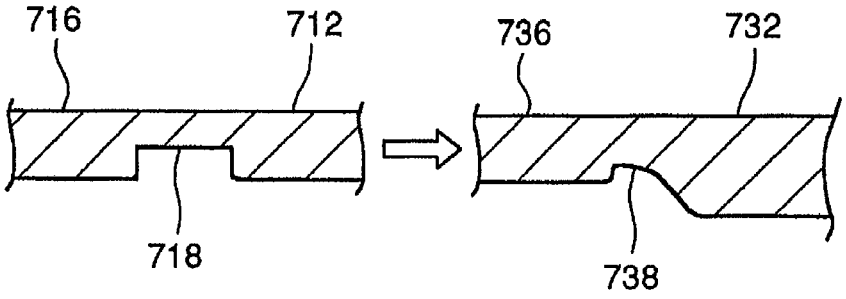
FIG. 54 is a cross-sectional view showing a second modification of the eleventh embodiment and illustrating the concave portion before and after press-molding.
Figure 55:
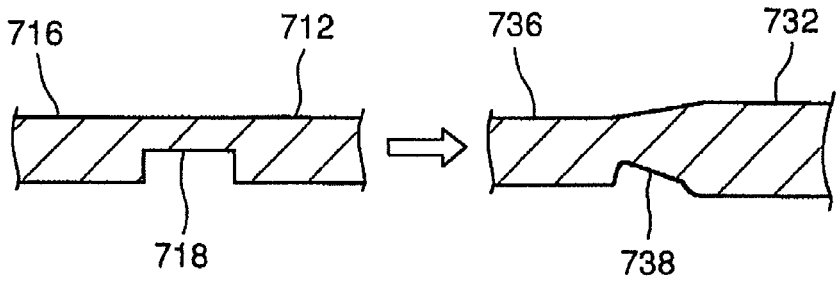
FIG. 55 is a cross-sectional view showing a third modification of the eleventh embodiment and illustrating the concave portion before and after press-molding.

FIGS. 53 to 55 are cross-sectional views showing first to third modifications of the eleventh embodiment and illustrate the concave portion before and after press-molding.

It is possible to expand a space, which allows the flow of the material and thickness increase, as to an upper part of the thickness increase prearranged portion 712 by enlarging a gap between the thickness increase prearranged portion 712 and an inner surface region of the upper mold by forming the concave portion 718 in the inner surface region of the upper mold facing the thickness increase prearranged portion 712 of the blank 700. In such a case, the partial thickness increase portion 732 can be obtained wherein a thickness of an upper surface is increased in the partial thickness increase portion 732 as shown in FIG. 53. Further, reference numeral 736 refers to a thickness non-increase portion.

Further, it is possible to expand a space, which allows the flow of the material and thickness increase, as to a lower part of the thickness increase prearranged portion 712 by enlarging a gap between the thickness increase prearranged portion 712 and an inner surface region of the lower mold by forming the concave portion 718 in the inner surface region of the lower mold facing the thickness increase prearranged portion 712. In such a case, the partial thickness increase portion 732 can be obtained wherein a thickness of a lower surface is increased in the partial thickness increase portion 732 as shown in FIG. 54.

Also, it is possible to expand a space, which allows the flow of the material and thickness increase, as to the upper and lower parts of the thickness increase prearranged portion 712 by enlarging the gap between the thickness increase prearranged portion 712 and the inner surface region of the upper mold and the gap between the thickness increase prearranged portion 712 and the inner surface region of the lower mold by forming the concave portion 718 in the inner surface regions of the upper and lower molds facing the thickness increase prearranged portion 712. In such a case, the partial thickness increase portion 732 can be obtained wherein thicknesses of the upper and lower surfaces are increased in the partial thickness increase portion 732 as shown in FIG. 55.

Figure 56:
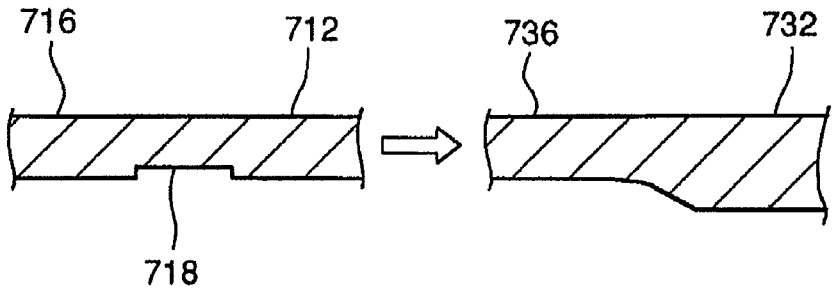
FIG. 56 is a cross-sectional view showing a fourth modification of the eleventh embodiment and illustrating the concave portion before and after press-molding.

FIG. 56 is a cross-sectional view showing a fourth modification of the eleventh embodiment and illustrates the concave portion before and after press-molding.

As for the press-molded product to be obtained, if it is not desirable that the concave portion 718 remains, then such a configuration can be addressed by adjusting a shape of the concave portion 718. For example, when the concave portion 718 is shallow, it is possible to allow the partial thickness increase portion 732 of the press-molded product to eliminate the concave portion 738 by the material flow from the connecting wall portion 706.

As described above, since the concave portion of the eleventh embodiment has reduced effect on rigidity compared to the slit of the tenth embodiment, it is possible to easily secure the rigidity of the press-molded product compared to the tenth embodiment.

Further, when considering productivity and costs, the concave portion can be formed by a press-molding operation when the blank is molded with the rolling material. However, it is also possible to separately form the concave portion by a mechanical operation. Alternatively, it is possible to form the concave portion at the time of the casting operation when the casting operation is applied to the blank. Appropriately establishing a width and length of the concave portion depends on the sizes and shapes of the thickness increase prearranged portion of the blank and the partial thickness increase portion of the press-molded product.

Figure 57:
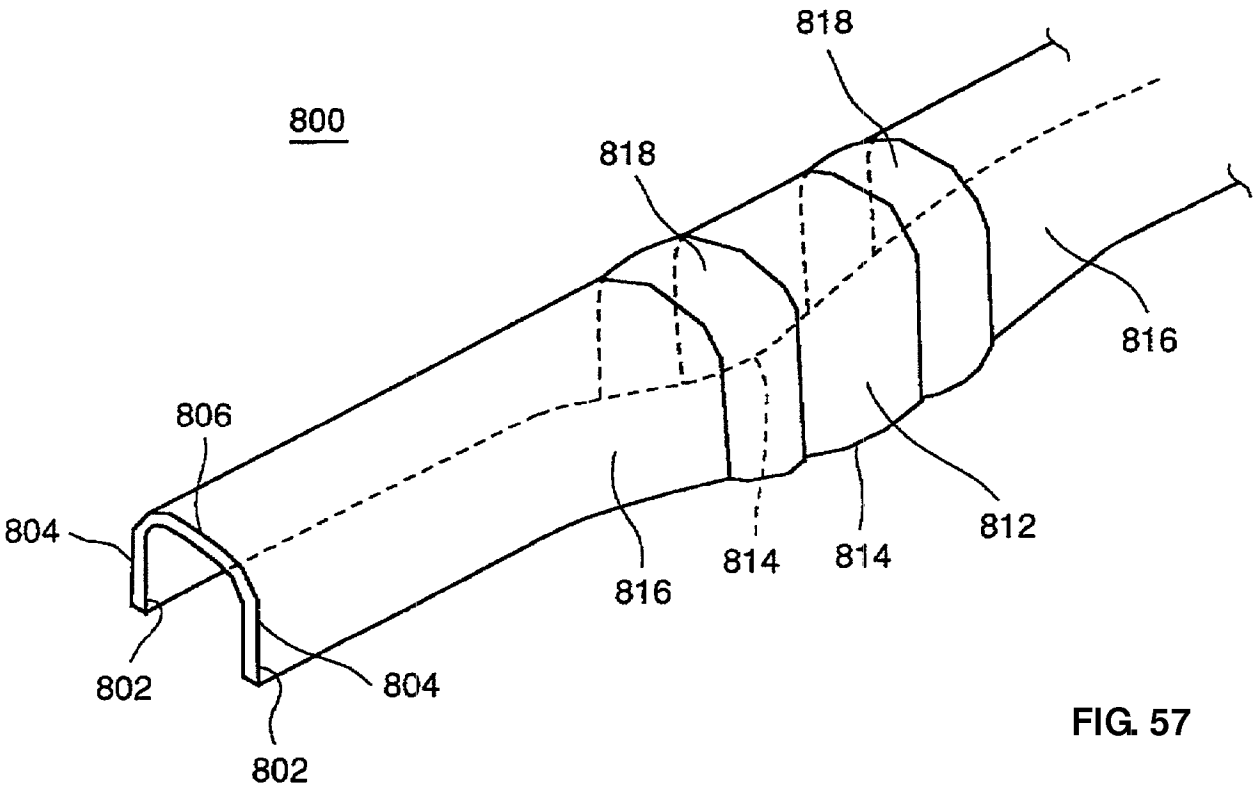
FIG. 57 is a perspective view showing a blank constructed in accordance with a twelfth embodiment.
Figure 58:
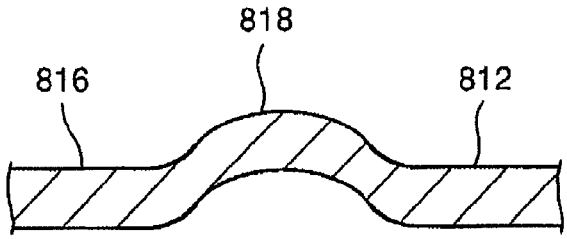
FIG. 58 is a cross-sectional view showing a bent portion shown in FIG. 57.

The concave portion can be positioned at a fixing surface of the partial thickness increase portion with another component. In such a case, since the other component serves as a reinforcing material, it is possible to restrain an effect of the concave portion to the rigidity of the press-molded product. Further, it is also possible to arrange the concave portion at the outer surface of the blank, at one of the side wall portion and connecting wall portion, or at one side of the side wall portion. Also, it is possible to arrange a plurality of concave portions along the periphery by a gap Next, a twelfth embodiment of the invention is explained with reference to FIGS. 57 and 58.

The twelfth embodiment differs from the eleventh embodiment in that the structure that performs the function of retaining the flow of the material is constituted by a bent portion 818, instead of the concave portion 718 in the eleventh embodiment. Further, since the apparatus for manufacturing the press-molded product constructed in accordance with the twelfth embodiment is substantially the same as that of the sixth embodiment, explanations thereof is not repeated herein.

Since the bent portion 818 is arranged at an outer surface of an edge portion of a thickness increase prearranged portion 812 of a blank 800 to thereby extend a side wall portion 804 and a connecting wall portion 806, it is possible to retard the transfer of the compression stress via the side wall portion 804 and connecting wall portion 806. Compared to the concave portion 718 formed of the thin wall portion, the bent portion 818 has a reduced effect on rigidity. A cross-sectional shape of the bent portion 818 is not specifically limited, but can include a deformable shape such as, for example, a moderate arc shape to thereby reduce or make any residual mark disappear in the press-molded product.

An extension 814 is arranged at an edge portion 802 of a peripheral region including the thickness increase prearranged portion 812 wherein the extension 814 constitutes a peripheral length extending region. A length of a cross-sectional periphery of the peripheral region including the thickness increase prearranged portion 812 is longer than a length of a cross-sectional periphery of a peripheral region including a thickness non-increase prearranged portion 816.

Thus, in the press-molding process, since the extension 814 of the blank 800 is pressed toward the step portion of a lower mold, the extension 814 is deformed and a material thereof flows upwardly. Since the extension 814 is positioned at the edge portion 802 of the peripheral region including the thickness increase prearranged portion 812, and a cross-sectional thickness of a cavity at the time of mold-clamping in consideration of the thickness increase caused by the material flow is established, the material flow of the extension 814 causes an increase of a cross-sectional thickness of the thickness increase prearranged portion 812.

Further, the bent portion 818 is positioned at the edge portion of the thickness increase prearranged portion 812. The bent portion 818 retards the transfer of the compression stress, thereby restraining the flow from the thickness increase prearranged portion 812 to the thickness non-increase prearranged portion 816. Since the bent portion 818 extends the side wall portion 804 and connecting wall portion 806, the material flow via the connecting wall portion 804 in addition to the material flow via the connecting wall portion 806 are restrained. That is, since the material dispersed via the side wall portion 804 flows in the connecting wall portion 806, it is possible to further improve the effect of thickness increase of the connecting wall portion of the press-molded product. Also, the bent portion 818 is pressed toward the upper and lower molds to thereby deform and reduce the bent portion 818 or to make the bent portion 818 disappear completely.

Figure 59:
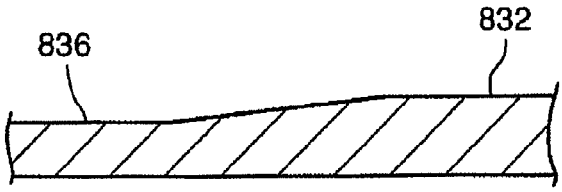
FIG. 59 is a cross-sectional view showing a first modification of the twelfth embodiment and illustrating the bent portion before and after press-molding.
Figure 60:
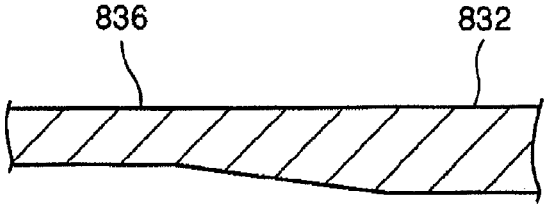
FIG. 60 is a cross-sectional view showing a second modification of the twelfth embodiment and illustrating the bent portion before and after press-molding.
Figure 61:
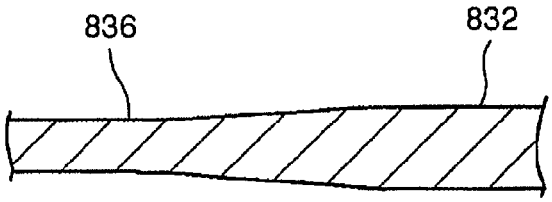
FIG. 61 is a cross-sectional view showing a third modification of the twelfth embodiment and illustrating the bent portion before and after press-molding.

FIGS. 59 to 61 are cross-sectional views showing first to third modifications of the twelfth embodiment and illustrate the bent portion before and after press-molding.

It is possible to expand a space, which allows the flow of the material and thickness increase, as to an upper part of the thickness increase prearranged portion 812 by enlarging a gap between the thickness increase prearranged portion 812 and an inner surface region of the upper mold by forming the concave portion in the inner surface region of the upper mold facing the thickness increase prearranged portion 812 of the blank 800. In such a case, a partial thickness increase portion 832 can be obtained wherein a thickness of an upper surface is increased in the partial thickness increase portion 832 as shown in FIG. 59. Further, reference numeral 836 refers to a thickness non-increase portion.

Further, it is possible to expand a space, which allows the flow of the material and thickness increase, as to a lower part of the thickness increase prearranged portion 812 by enlarging a gap between the thickness increase prearranged portion 812 and an inner surface region of the lower mold by forming the concave portion in the inner surface region of the lower mold facing the thickness increase prearranged portion 812. In such a case, the partial thickness increase portion 832 can be obtained wherein a thickness of a lower surface is increased in the partial thickness increase portion 832 as shown in FIG. 60.

Also, it is possible to expand a space, which allows the flow of the material and thickness increase, as to the upper and lower parts of the thickness increase prearranged portion 812 by enlarging the gap between the thickness increase prearranged portion 812 and the inner surface region of the upper mold and the gap between the thickness increase prearranged portion 812 and the inner surface portion of the lower mold by forming the concave portion in the inner surface regions of the upper and lower molds facing the thickness increase prearranged portion 812. In such a case, the partial thickness increase portion 832 can be obtained wherein thicknesses of the upper and lower surfaces are increased in the partial thickness increase portion 832 as shown in FIG. 61.

As described above, since the bent portion of the twelfth embodiment has a reduced effect on the rigidity compared to the concave portion of the eleventh embodiment, it is possible to easily secure the rigidity of the press-molded product compared to the eleventh embodiment.

Further, when considering productivity and costs, the bent portion can be formed by a press-molding operation when the blank is molded by the rolling material. However, when a casting operation is applied to the blank, it is possible to form the bent portion at the time of the casting operation. Appropriately establishing the size and length of the bent portion depends on the sizes and shapes of the thickness increase prearranged portion of the blank and the partial thickness increase portion of the press-molded product.

Also, it is possible to arrange the bent portion at an inner surface of the blank, at one of the side wall portion and connecting wall portion, or at one side of the side wall portion. Additionally, it is possible to arrange a plurality of bent portions along the peripheral direction by a gap.

While certain embodiments of the invention are described above, the present invention should not be limited to the above-mentioned embodiments but may include other embodiments and modifications without deviating from the subject matter or scope of the present invention.

For example, the first to third modifications of the first embodiment may be applied to the second to fourth embodiments or the sixth to ninth embodiments. Further, the second embodiment may be applied to the third embodiment and its modifications. Also, the tenth to twelfth embodiments may be applied to the seventh to ninth embodiments. The first to third modifications of the eleventh embodiment may be applied to the sixth to tenth embodiments.

Further, the structural elements that perform the function of restraining the flow of the material is not specifically limited to the through hole, the slit, the concave portion and the bent portion as long as the structure performs the function of retarding the transfer of the compression stress.

The press-molded product is not limited to a type applied to the suspension component but may be applied to other structural members of a vehicle. Other structural members of the vehicle may include, for example, a link component, a bracket component, a body component such as a side seal outer reinforce and a frame member such as a ladder frame.

The shapes of the side wall portion and connecting wall portion of the blank and press-molded product are not limited to the approximately planar shapes, but may include curved or bent shapes. Further, it is also possible to apply to a blank and press-molded product having an angle shape wherein each end of the side wall portions is connected so as not to comprise the connecting wall portion. Also, the local region requiring rigidity or strength may include a region wherein another structural member is welded.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A method of manufacturing a press-molded product using a preform, the preform comprising a pair of spaced side walls connected by a connecting wall and having a cross sectional thickness, the preform having a protrusion along a partial length thereof, with the protrusion defining the partial length as a prearranged portion of the preform and being such that a cross sectional periphery of the preform is longer along the prearranged portion than along a portion of the preform surrounding the prearranged portion, the method comprising:

pressing the preform within a mold cavity formed between a die portion and a punch portion received within the die portion, the cavity having a cross sectional thickness when the punch portion is fully received in the die portion that is greater than the cross sectional thickness of the preform; and increasing the cross sectional thickness of the preform along the prearranged portion by compressing the protrusion to flow material of the protrusion into the connecting wall and at least one of the side walls of the prearranged portion.

2. The method according to claim 1, the step of increasing the cross sectional thickness of the preform along the prearranged portion further comprising:

reducing the cross sectional periphery of the preform along the prearranged portion until it is substantially the same as the cross sectional periphery of the preform along the portion surrounding the prearranged portion.

3. The method according to claim 1, further comprising:

arranging the preform over the punch portion;

arranging the die portion about the punch portion to create the mold cavity, such that a gap formed between the punch portion and the connecting wall and first portions of the side walls adjacent the connecting wall is greater than a gap formed between the punch portion and second portions of the side walls opposite the connecting wall;

supporting the second side wall portions by the punch portion and the die portion; and pressing-in the connecting wall and first portions of the side walls toward the punch portion using the die portion to bend a center portion of the connecting wall toward the punch portion.

4. The method according to claim 3, further comprising:

restraining a bending degree of the connecting wall by supporting the center portion of the connecting wall during bending.

5. The method according to claim 4, the step of restraining further comprising:

positioning a supporting member within a space between the punch portion and the connecting wall to contact and support the center portion of the connecting wall after bending of the center portion begins; and retracting the supporting member toward the punch portion while supporting the center portion of the connecting wall using the supporting member during bending of the center portion.

6. The method according to claim 1, wherein the protrusion protrudes from a distal second side wall portion opposite the connecting wall, the step of pressing the preform further comprising:

arranging the preform over the punch portion, such that the protrusion contacts a contacting surface extending radially from the punch portion and spaces the second side wall portion from the contacting surface;

bending the connecting wall by contacting the connecting wall with the die portion; and guiding a corner portion connecting a first portion of the side wall opposite the second side wall portion and the connecting wall while pressing the first portion of the side wall with contacting surfaces of the punch portion and the die portion.

7. The method according to claim 1, wherein the protrusion is a bulge protruding from the connecting wall, the step of increasing the cross sectional thickness of the preform along the prearranged portion further comprising:

reducing the cross sectional periphery of the preform along the prearranged portion until it is substantially the same as the cross sectional periphery of the preform along the portion surrounding the prearranged portion by flowing material of the protrusion into at least the pair of side walls.

8. The method according to claim 7, the step of pressing the preform further comprising:

arranging the preform over the punch portion, such that distal second side wall portions opposite the connecting wall contact a contacting surface extending radially from the punch portion.

9. The method according to claim 7, wherein the protrusion further protrudes from a distal second side wall portion opposite the connecting wall, the step of pressing the preform further comprising:

arranging the preform over the punch portion, such that the protrusion contacts a contacting surface extending radially from the punch portion and spaces the second side wall portion from the contacting surface.

10. The method according to claim 1, wherein the protrusion is a bulge protruding from a side wall, the step of increasing the cross sectional thickness of the preform along the prearranged portion further comprising:

reducing the cross sectional periphery of the preform along the prearranged portion until it is substantially the same as the cross sectional periphery of the preform along the portion surrounding the prearranged portion by flowing material of the protrusion into at least the connecting wall.

11. The method according to claim 10, the step of pressing the preform further comprising:

arranging the preform over the punch portion, such that distal second side wall portions opposite the connecting wall contact a contacting surface extending radially from the punch portion; and guiding a corner portion connecting a first portion of the side wall and the connecting wall and the side wall toward the connecting wall with the die portion.

12. The method according to claim 1, further comprising:

preparing the preform before pressing the preform and increasing the cross sectional thickness of the preform along the prearranged portion, the step of preparing the preform comprising:

arranging a plate-shaped material having the cross sectional thickness between the punch portion and the die portion and then mold-clamping to form the preform.

13. The method according to claim 1, further comprising:

increasing a hardness of the preform along the prearranged portion.

14. The method according to claim 1, wherein the preform is an elongated structure with a hat shaped cross section, opposing longitudinal ends and a longitudinally extending prearranged portion, the method further comprising:

controlling a movement of both longitudinal ends of the preform using a lateral mold during the step of increasing the cross sectional thickness of the preform along the prearranged portion.

15. The method according to claim 1, the step of increasing the cross sectional thickness of the preform along the prearranged portion further comprising:

restraining a material flow to the portion of the preform surrounding the prearranged portion.

16. The method according to claim 15, wherein the step of restraining is achieved by one of a through hole, a slit, a concave portion or a curved portion arranged adjacent a periphery of the prearranged portion and configured to mitigate transfer of a compression stress.

17. A method of manufacturing a press-molded product using an elongate preform, the preform having an original plate thickness and comprising a pair of spaced side walls connected by a connecting wall, such that the preform has a generally hat shaped cross section, the preform having a protrusion along a partial length thereof, with the protrusion defining the partial length as a longitudinal prearranged portion of the preform and being such that a cross sectional periphery of the preform is longer along the prearranged portion than along a portion of the preform surrounding the prearranged portion, the method comprising:

pressing the preform within a mold cavity formed between a die portion and a punch portion received within the die portion and a lateral mold, the cavity having a cross sectional thickness when the punch portion is fully received in the die portion that is greater than the original plate thickness, the lateral mold controlling a movement of opposing longitudinal ends of the preform; and compressing the protrusion to flow material of the protrusion into the connecting wall and the side walls of the prearranged portion, such that the cross sectional periphery of the preform along the prearranged portion is substantially the same as the cross sectional periphery of the preform along the portion surrounding the prearranged portion, a cross sectional thickness of the prearranged portion is increased from original the plate thickness, and an length of the preform is substantially unchanged.

* * * * *